US011217261B2

(12) United States Patent
Ravelli et al.

(10) Patent No.: US 11,217,261 B2
(45) Date of Patent: Jan. 4, 2022

(54) ENCODING AND DECODING AUDIO SIGNALS

(71) Applicant: Fraunhofer-Gesellschaft zur Förderung der angewandten Forschung e.V., Munich (DE)

(72) Inventors: Emmanuel Ravelli, Erlangen (DE); Adrian Tomasek, Erlangen (DE); Manfred Lutzky, Erlangen (DE); Conrad Benndorf, Nuremberg (DE)

(73) Assignee: Fraunhofer-Gesellschaft zur Förderung der angewandten Forschung e.V., Munich (DE)

( * ) Notice: Subject to any disclaimer, the term of this patent is extended or adjusted under 35 U.S.C. 154(b) by 0 days.

(21) Appl. No.: 16/868,057

(22) Filed: May 6, 2020

(65) Prior Publication Data

US 2020/0265855 A1 Aug. 20, 2020

Related U.S. Application Data

(63) Continuation of application No. PCT/EP2018/080350, filed on Nov. 6, 2018.

(51) Int. Cl.
*G10L 19/26* (2013.01)
*G10L 19/005* (2013.01)

(52) U.S. Cl.
CPC ..... *G10L 19/26* (2013.01); *G10L 19/005* (2013.01)

(58) Field of Classification Search
CPC ..... G10L 19/26; G10L 19/005
See application file for complete search history.

(56) References Cited

U.S. PATENT DOCUMENTS

| | | | |
|---|---|---|---|
| 4,972,484 | A | 11/1990 | Link et al. |
| 5,012,517 | A | 4/1991 | Chhatwal et al. |
| 5,581,653 | A | 12/1996 | Todd |
| 5,651,091 | A | 7/1997 | Chen et al. |
| 5,781,888 | A | 7/1998 | Herre |
| 5,812,971 | A | 9/1998 | Herre |
| 5,819,209 | A | 10/1998 | Inoue |
| 5,909,663 | A | 6/1999 | Iijima et al. |
| 5,999,899 | A | 12/1999 | Robinson |

(Continued)

FOREIGN PATENT DOCUMENTS

| | | | |
|---|---|---|---|
| CN | 101140759 | A | 3/2008 |
| CN | 102779526 | A | 11/2012 |

(Continued)

OTHER PUBLICATIONS

"Decision on Grant Patent for Invention for RU Application No. 2020118949", dated Nov. 11, 2020, Rospatent, Russia.

(Continued)

*Primary Examiner* — Bryan S Blankenagel
(74) *Attorney, Agent, or Firm* — Novick, Kim & Lee, PLLC; Jae Youn Kim; Jihun Kim

(57) ABSTRACT

In methods and apparatus and non-transitory memory units for encoding/decoding audio signal information, the encoder side may determine if a signal frame is useful for long term post filtering and/or packet lost concealment and may encode information in accordance to the results of the determination, and the decoder side may apply the LTPF and/or PLC in accordance to the information obtained from the encoder.

7 Claims, 14 Drawing Sheets

(56) References Cited

U.S. PATENT DOCUMENTS 6,018,706 A 1/2000 Huang et al.
6,148,288 A 11/2000 Park
6,167,093 A 12/2000 Tsutsui et al.
6,507,814 B1 1/2003 Gao
6,570,991 B1 5/2003 Scheirer et al.
6,665,638 B1 12/2003 Kang et al.
6,735,561 B1 5/2004 Johnston et al.
7,009,533 B1 3/2006 Wegener
7,353,168 B2 4/2008 Chen et al.
7,395,209 B1 7/2008 Dokic et al.
7,539,612 B2 5/2009 Chen et al.
7,546,240 B2 6/2009 Chen et al.
8,015,000 B2 9/2011 Chen et al.
8,095,359 B2 1/2012 Boehm et al.
8,280,538 B2 10/2012 Kim et al.
8,473,301 B2 6/2013 Chen et al.
8,543,389 B2 9/2013 Ragot et al.
8,554,549 B2 10/2013 Oshikiri et al.
8,612,240 B2 12/2013 Fuchs et al.
8,682,681 B2 3/2014 Fuchs et al.
8,738,385 B2 5/2014 Chen
8,751,246 B2 6/2014 Bayer et al.
8,847,795 B2 9/2014 Faure et al.
8,891,775 B2 11/2014 Mundt et al.
8,898,068 B2 11/2014 Fuchs et al.
9,026,451 B1 5/2015 Kleijn et al.
9,123,350 B2 9/2015 Zhao et al.
9,489,961 B2 11/2016 Kovesi et al.
9,595,262 B2 3/2017 Fuchs et al.
10,726,854 B2 7/2020 Ghido et al.
2003/0101050 A1 5/2003 Cuperman et al.
2005/0015249 A1 1/2005 Chen et al.
2006/0288851 A1 12/2006 Naoki et al.
2007/0033056 A1 2/2007 Groeschl et al.
2007/0118369 A1 5/2007 Chen
2007/0127729 A1 6/2007 Breebaart et al.
2007/0129940 A1 6/2007 Geyersberger et al.
2007/0276656 A1 11/2007 Solbach et al.
2008/0033718 A1 2/2008 Zopf et al.
2008/0126086 A1 5/2008 Kandhadai et al.
2008/0126096 A1 5/2008 Choo et al.
2009/0076805 A1 3/2009 Du et al.
2009/0076830 A1 3/2009 Taleb
2009/0089050 A1 4/2009 Mo et al.
2009/0138267 A1 5/2009 Davidson et al.
2009/0254352 A1 10/2009 Zhao
2010/0010810 A1 1/2010 Morii
2010/0070270 A1 3/2010 Gao
2010/0094637 A1 4/2010 Vinton
2010/0115370 A1 5/2010 Ramo et al.
2010/0198588 A1 8/2010 Osada et al.
2010/0312552 A1 12/2010 Kandhadai et al.
2010/0312553 A1 12/2010 Fang et al.
2010/0324912 A1 12/2010 Oh et al.
2011/0015768 A1 1/2011 Kim et al.
2011/0022924 A1 1/2011 Malenovsky et al.
2011/0035212 A1 2/2011 Briand et al.
2011/0060597 A1 3/2011 Chen et al.
2011/0071839 A1 3/2011 Budnikov et al.
2011/0095920 A1 4/2011 Ashley et al.
2011/0096830 A1 4/2011 Ashley et al.
2011/0116542 A1 5/2011 Antonini et al.
2011/0125505 A1 5/2011 Gournay et al.
2011/0145003 A1 6/2011 Bessette
2011/0196673 A1 8/2011 Park et al.
2011/0200198 A1 8/2011 Bayer et al.
2011/0238425 A1 9/2011 Lecomte et al.
2011/0238426 A1 9/2011 Borsum et al.
2012/0010879 A1 1/2012 Kikuiri et al.
2012/0022881 A1 1/2012 Geiger et al.
2012/0072209 A1 3/2012 Krishnan et al.
2012/0109659 A1 5/2012 Chen et al.
2012/0214544 A1 8/2012 Rodriguez et al.
2012/0265540 A1 10/2012 Fuchs et al.
2012/0265541 A1 10/2012 Geiger et al.
2013/0030819 A1 1/2013 Carlsson et al.
2013/0226594 A1 8/2013 Fuchs et al.
2013/0282369 A1 10/2013 Ryu et al.
2014/0052439 A1 2/2014 Nanjundaswamy et al.
2014/0067404 A1 3/2014 Baumgarte
2014/0074486 A1 3/2014 Dietz et al.
2014/0108020 A1 4/2014 Bai et al.
2014/0142957 A1 5/2014 Lee et al.
2014/0358531 A1 12/2014 Vos
2015/0010155 A1 1/2015 Lang et al.
2015/0081312 A1 3/2015 Fuchs et al.
2015/0142452 A1 5/2015 Lee et al.
2015/0154969 A1 6/2015 Craven et al.
2015/0170668 A1 6/2015 Kovesi et al.
2015/0221311 A1 8/2015 Jeon et al.
2015/0228287 A1 8/2015 Bruhn et al.
2015/0302859 A1 10/2015 Aguilar et al.
2015/0325246 A1 11/2015 Chen et al.
2015/0371647 A1 12/2015 Faure et al.
2016/0027450 A1 1/2016 Gao
2016/0078878 A1 3/2016 Ravelli et al.
2016/0086616 A1* 3/2016 Resch ..... G10L 19/09 704/500
2016/0111094 A1 4/2016 Dietz et al.
2016/0189721 A1 6/2016 Johnston et al.
2016/0225384 A1 8/2016 Kjörling et al.
2016/0285718 A1 9/2016 Bruhn
2016/0293174 A1 10/2016 Atti et al.
2016/0293175 A1 10/2016 Atti et al.
2016/0307576 A1 10/2016 Doehla et al.
2016/0365097 A1 12/2016 Guan et al.
2016/0372125 A1 12/2016 Atti et al.
2016/0372126 A1 12/2016 Atti et al.
2016/0379655 A1 12/2016 Truman et al.
2017/0011747 A1 1/2017 Faure et al.
2017/0053658 A1 2/2017 Atti et al.
2017/0078794 A1 3/2017 Bongiovi et al.
2017/0103769 A1 4/2017 Laaksonen et al.
2017/0110135 A1 4/2017 Disch et al.
2017/0133029 A1 5/2017 Markovic et al.
2017/0140769 A1 5/2017 Ravelli et al.
2017/0154631 A1 6/2017 Bayer et al.
2017/0154635 A1 6/2017 Doehla et al.
2017/0221495 A1 8/2017 Sung et al.
2017/0236521 A1 8/2017 Atti et al.
2017/0256266 A1 9/2017 Sung et al.
2017/0294196 A1 10/2017 Bradley et al.
2017/0303114 A1 10/2017 Johansson et al.
2019/0027156 A1 1/2019 Sung et al.

FOREIGN PATENT DOCUMENTS

CN 107103908 A 8/2017
EP 0716787 A1 6/1996
EP 0732687 B2 9/1996
EP 1791115 A2 5/2007
EP 2676266 B1 12/2013
EP 2980796 A1 2/2016
EP 2980799 A1 2/2016
EP 3111624 A1 1/2017
FR 2944664 A1 10/2010
JP H05-281996 A 10/1993
JP H07-28499 A 1/1995
JP H0811644 A 1/1996
JP H9-204197 A 8/1997
JP H10-51313 A 2/1998
JP H1091194 A 4/1998
JP 2004-138756 A 5/2004
JP 2006-527864 A 12/2006
JP 2007-525718 A 9/2007
JP 2009-003387 A 1/2009
JP 2009-008836 A 1/2009
JP 2009-538460 A 11/2009
JP 2010-500631 A 1/2010
JP 2010-501955 A 1/2010
JP 2012-533094 A 12/2012
JP 2016-523380 A 8/2016
JP 2016-200750 A 12/2016
JP 2017-522604 A 8/2017

(56) References Cited

FOREIGN PATENT DOCUMENTS

| | | | |
|---|---|---|---|
| JP | 2017-528752 | A | 9/2017 |
| KR | 100261253 | B1 | 7/2000 |
| KR | 20030031936 | A | 4/2003 |
| KR | 20170000933 | A | 1/2017 |
| RU | 2337414 | C2 | 10/2008 |
| RU | 2376657 | C2 | 12/2009 |
| RU | 2413312 | C2 | 2/2011 |
| RU | 2419891 | C2 | 5/2011 |
| RU | 2439718 | C1 | 1/2012 |
| RU | 2483365 | C2 | 5/2013 |
| RU | 2520402 | C2 | 6/2014 |
| RU | 2568381 | C2 | 11/2015 |
| RU | 2596594 | C2 | 9/2016 |
| RU | 2596596 | C2 | 9/2016 |
| RU | 2015136540 | A | 3/2017 |
| RU | 2628162 | C2 | 8/2017 |
| RU | 2016105619 | A | 8/2017 |
| TW | 200809770 | A | 2/2008 |
| TW | 201005730 | A | 2/2010 |
| TW | 201126510 | A | 8/2011 |
| TW | 201131550 | A | 9/2011 |
| TW | 201207839 | A | 2/2012 |
| TW | 201243832 | A | 11/2012 |
| TW | 201612896 | A | 4/2016 |
| TW | 201618080 | A | 5/2016 |
| TW | 201618086 | A | 5/2016 |
| TW | 201642246 | A | 12/2016 |
| TW | 201642247 | A | 12/2016 |
| TW | 201705126 | A | 2/2017 |
| TW | 201711021 | A | 3/2017 |
| TW | 201713061 | A | 4/2017 |
| TW | 201724085 | A | 7/2017 |
| TW | 201732779 | A | 9/2017 |
| WO | 3916050 | A1 | 4/1999 |
| WO | 2004/072951 | A1 | 8/2004 |
| WO | 2005/086138 | A1 | 9/2005 |
| WO | 2005/086139 | A1 | 9/2005 |
| WO | 2007/073604 | A1 | 7/2007 |
| WO | 2007/138511 | A1 | 12/2007 |
| WO | 2008/025918 | A1 | 3/2008 |
| WO | 2008/046505 | A1 | 4/2008 |
| WO | 2009/066869 | A1 | 5/2009 |
| WO | 2011/048118 | A1 | 4/2011 |
| WO | 2011/086066 | A1 | 7/2011 |
| WO | 2011/086067 | A1 | 7/2011 |
| WO | 2012/000882 | A | 1/2012 |
| WO | 2012/000882 | A1 | 1/2012 |
| WO | 2012/126893 | A | 9/2012 |
| WO | 2014/165668 | A | 10/2014 |
| WO | 2014/202535 | A | 12/2014 |
| WO | 2014/202535 | A1 | 12/2014 |
| WO | 2015/063045 | A1 | 5/2015 |
| WO | 2015/063227 | A1 | 5/2015 |
| WO | 2015/071173 | A1 | 5/2015 |
| WO | 2015/174911 | A1 | 11/2015 |
| WO | 2016/016121 | A1 | 2/2016 |
| WO | 2016/142002 | A1 | 9/2016 |
| WO | 2016/142337 | A1 | 9/2016 |

OTHER PUBLICATIONS

P.A. Volkov, "Office Action for RU Application No. 2020120251", dated Oct. 28, 2020, Rospatent, Russia.
P.A. Volkov, "Office Action for RU Application No. 2020120256", dated Oct. 28, 2020, Rospatent, Russia.
D.V.Travnikov, "Decision on Grant for RU Application No. 2020118969", dated Nov. 2, 2020, Rospatent, Russia.
Guojun Lu et al., "A Technique towards Automatic Audio Classification and Retrieval, Forth International Conference an Signal Processing", 1998, IEEE, Oct. 12, 1998, pp. 1142 to 1145.
Hiroshi Ono, "Office Action for JP Application No. 2020-526135", dated May 21, 2021, JPO Japan.
O.E. Groshev, "Office Action for RU Application No. 2020118947", dated Dec. 1, 2020, Rospatent, Russia.
O.I. Starukhina, "Office Action for RU Application No. 2020118968", dated Dec. 23, 2020, Rospatent, Russia.
Santosh Mehtry, "Office Action for IN Application No. 202037019203", dated Mar. 19, 2021, Intellectual Property India, India.
Sujoy Sarkar, "Examination Report for IN Application No. 202037018091", dated Jun. 1, 2021, Intellectual Property India, India.
ETSI TS 126 445 V13.2.0 (Aug. 2016), Universal Mobile Telecommunications System (UMTS); LTE; Codec for Enhanced Voice Services (EVS); Detailed algorithmic description (3GPP TS 26.445 version 13.2.0 Release 13) [Online]. Available: http://www.3gpp.org/ftp/Specs/archive/26_series/26.445/26445-d00.zip.
Geiger, "Audio Coding based on integer transform", Ilmenau: https://www.db-thueringen.de/receive/dbt_mods_00010054, 2004.
Henrique S Malvar, "Biorthogonal and Nonuniform Lapped Transforms for Transform Coding with Reduced Blocking and Ringing Artifacts", IEEE Transactions on Signal Processing, IEEE Service Center, New York, NY, US, (Apr. 1998), vol. 46, No. 4, ISSN 1053-587X, XP011058114.
Anonymous, "ISO/IEC 14496-3:2005/FDAM 9, AAC-ELD", 82. MPEG Meeting;Oct. 22, 2007-Oct. 26, 2007 Shenzhen; (Motion Picture Expert Group or ISO/IEC JTC1/SC29/WG11),, (Feb. 21, 2008), No. N9499, XP030015994.
Virette, "Low Delay Transform for High Quality Low Delay Audio Coding", Université de Rennes 1, (Dec. 10, 2012), pp. 1-195, URL: https://hal.inria.fr/tel-01205574/document, (Mar. 30, 2016), XP055261425.
ISO/IEC 14496-3:2001; Information technology—Coding of audio-visual objects—Part 3: Audio.
3GPP TS 26.403 v14.0.0 (Mar. 2017); General audio codec audio processing functions; Enhanced acPlus general audio codec; Encoder specification; Advanced Audio Coding (AAC) part; (Release 14).
ISO/IEC 23003-3; Information technology—MPEG audio technologies—Part 3: Unified speech and audio coding, 2011.
3GPP TS 26.445 V14.1.0 (Jun. 2017), 3rd Generation Partnership Project; Technical Specification Group Services and System Aspects; Codec for Enhanced Voice Services (EVS); Detailed Algorithmic Description (Release 14), http://www.3gpp.org/ftp//Specs/archive/26_series/26.445/26445-e10.zip, Section 5.1.6 "Bandwidth detection".
Eksler Vaclav et al, "Audio bandwidth detection in the EVS codec", 2015 IEEE Global Conference on Signal and Information Processing (GLOBALSIP), IEEE, (Dec. 14, 2015), doi:10.1109/GLOBALSIP.2015.7418243, pp. 488-492, XP032871707.
Oger M et al, "Transform Audio Coding with Arithmetic-Coded Scalar Quantization and Model-Based Bit Allocation", International Conference on Acoustics, Speech, and Signalprocessing, IEEE, XX,Apr. 15, 2007 (Apr. 15, 2007), p. IV-545, XP002464925.
Asad et al., "An enhanced least significant bit modification technique for audio steganography", International Conference on Computer Networks and Information Technology, Jul. 11-13, 2011.
Makandar et al, "Least Significant Bit Coding Analysis for Audio Steganography", Journal of Future Generation Computing, vol. 2, No. 3, Mar. 2018.
ISO/IEC 23008-3:2015; Information technology—High efficiency coding and media delivery in heterogeneous environments—Part 3: 3D audio.
ITU-T G.718 (Jun. 2008): Series G: Transmission Systems and Media, Digital Systems and Networks, Digital terminal equipments—Coding of voice and audio signals, Frame error robust narrow-band and wideband embedded variable bit-rate coding of speech and audio from 8-32 kbit/s.
3GPP TS 26.447 V14.1.0 (Jun. 2017), Technical Specification, 3rd Generation Partnership Project; Technical Specification Group Services and System Aspects; Codec for Enhanced Voice Services (EVS); Error Concealment of Lost Packets (Release 14).
DVB Organization, "ISO-IEC 23008-3_A3 (E)_(H 3DA FDAM3).docx", DVB, Digital Video Broadcasting, C/O EBU—17A Ancienne Route—CH-1218 Grand Saconnex, Geneva—Switzerland, (Jun. 13, 2016), XP017851888.
Hill et al., "Exponential stability of time-varying linear systems," IMA J Numer Anal, pp. 865-885, 2011.

(56) References Cited

OTHER PUBLICATIONS

3GPP TS 26.090 V14.0.0 (Mar. 2017), 3rd Generation Partnership Project; Technical Specification Group Services and System Aspects; Mandatory Speech Codec speech processing functions; Adaptive Multi-Rate (AMR) speech codec; Transcoding functions (Release 14).
3GPP TS 26.190 V14.0.0 (Mar. 2017), Technical Specification, 3rd Generation Partnership Project; Technical Specification Group Services and System Aspects; Speech codec speech processing functions; Adaptive Multi-Rate-Wideband (AMR-WB) speech codec; Transcoding functions (Release 14).
3GPP TS 26.290 V14.0.0 (Mar. 2017), Technical Specification, 3rd Generation Partnership Project; Technical Specification Group Services and System Aspects; Audio codec processing functions; Extended Adaptive Multi-Rate-Wideband (AMR-WB+) codec; Transcoding functions (Release 14).
Edler et al., "Perceptual Audio Coding Using a Time-Varying Linear Pre- and Post-Filter," in AES 109th Convention, Los Angeles, 2000.
Gray et al., "Digital lattice and ladder filter synthesis," IEEE Transactions on Audio and Electroacoustics, vol. vol. 21, No. No. 6, pp. 491-500, 1973.
Lamoureux et al., "Stability of time variant filters," CREWES Research Report—vol. 19, 2007.
Herre et al., "Enhancing the performance of perceptual audio coders by using temporal noise shaping (TNS)." Audio Engineering Society Convention 101. Audio Engineering Society, 1996.
Herre et al., "Continuously signal-adaptive filterbank for high-quality perceptual audio coding." Applications of Signal Processing to Audio and Acoustics, 1997. 1997 IEEE ASSP Workshop on. IEEE, 1997.
Herre, "Temporal noise shaping, quantization and coding methods in perceptual audio coding: A tutorial introduction." Audio Engineering Society Conference: 17th International Conference: High-Quality Audio Coding. Audio Engineering Society, 1999.
Fuchs Guillaume et al, "Low delay LPC and MDCT-based audio coding in the EVS codec", 2015 IEEE International Conference on Acoustics, Speech and Signal Processing (ICASSP), IEEE, (Apr. 19, 2015), doi:10.1109/ICASSP.2015.7179068, pp. 5723-5727, XP033187858.
Niamut et al, "RD Optimal Temporal Noise Shaping for Transform Audio Coding", Acoustics, Speech and Signal Processing, 2006. ICASSP 2006 Proceedings. 2006 IEEE International Conference on Toulouse, France May 14-19, 2006, Piscataway, NJ, USA,IEEE, Piscataway, NJ, USA, (Jan. 1, 2006), doi:10.1109/ICASSP.2006.1661244, ISBN 978-1-4244-0469-8, pp. V-V, XP031015996.
ITU-T G.711 (Sep. 1999): Series G: Transmission Systems and Media, Digital Systems and Networks, Digital transmission systems—Terminal equipments—Coding of analogue signals by pulse code modulation, Pulse code modulation (PCM) of voice frequencies, Appendix I: A high quality low-complexity algorithm for packet loss concealment with G.711.
Cheveigne et al.,"YIN, a fundamental frequency estimator for speech and music." The Journal of the Acoustical Society of America 111.4 (2002): 1917-1930.
Ojala P et al, "A novel pitch-lag search method using adaptive weighting and median filtering", Speech Coding Proceedings, 1999 IEEE Workshop on Porvoo, Finland Jun. 20-23, 1999, Piscataway, NJ, USA, IEEE, US, (Jun. 20, 1999), doi:10.1109/SCFT.1999.781502, ISBN 978-0-7803-5651-1, pp. 114-116, XP010345546.
"5 Functional description of the encoder", Dec. 10, 2014 (Dec. 10, 2014), 3GPP Standard; 26445-C10_1_S05_S0501, 3rd Generation Partnership Project (3GPP)?, Mobile Competence Centre ; 650, Route Des Lucioles ; F-06921 Sophia-Antipolis Cedex; France Retrieved from the Internet:URL: http://www.3gpp.org/ftp/Specs/2014-12/Rel-12/26_series/ XP050907035.
Tomonori Kikuchi, "Office Action for JP Application No. 2020-524874", dated Jun. 2, 2021, JPO Japan.
Hiroshi Ono, "Office Action for JP Application No. 2020-526081", dated Jun. 22, 2021, JPO, Japan.
Hiroshi Ono, "Office Action for JP Application No. 2020-526084", dated Jun. 23, 2021, JPO, Japan.
John Tan, "Office Action for SG Application 11202004173P", dated Jul. 23, 2021, IPOS, Singapore.
Takeshi Yamashita, "Office Action for JP Application 2020-524877", dated Jun. 24, 2021, JPO, Japan.
Tetsuyuki Okumachi, "Office Action for JP Application 2020-118837", dated Jul. 16, 2021, JPO, Japan.
Tetsuyuki Okumachi, "Office Action for JP Application 2020-118838", dated Jul. 16, 2021, JPO, Japan.
Miao Xiaohong, "Examination Report for SG Application No. 11202004228V", dated Sep. 2, 2021, IPOS, Singapore.
Miao Xiaohong, "Search Report for SG Application No. 11202004228V", dated Sep. 3, 2021, IPOS, Singapore.
Nam Sook Lee, "Office Action for KR Application No. 10-2020-7015512", dated Sep. 9, 2021, KIPO, Republic of Korea.
Khalid Sayood, "Introduction to Data Compression", Elsevier Science & Technology, 2005, Section 16.4, Figure 16. 13, p. 526
Patterson et al., "Computer Organization and Design", The hardware/software Interface, Revised Fourth Edition, Elsevier, 2012.
Dietz, Martin et al., "Overview of the EVS codec architecture." 2015 IEEE International Conference on Acoustics, Signal Processing (ICASSP), IEEE, 2015.

* cited by examiner

| | syntax | No. of bits | mnemonic |
|---|---|---|---|
| 16a, 17a, 18a | ltpf data() | | |
| | { | | |
| 18e | ltpf_pitch_lag_present; | 1 | uimsbf |
| | if (ltpf_pitch_lag_present) { | | |
| 16c, 17c | ltpf_active; | 1 | uimsbf |
| 16b, 17b | ltpf_pitch_lag; | 9 | uimsbf |
| | } | | |
| | } | | |

Fig. 8a

| | syntax | No. of bits | mnemonic |
|---|---|---|---|
| 16a, 17a, 18a | ltpf data() | | |
| | { | | |
| 18e | ltpf_pitch_lag_present; | 1 | uimsbf |
| | if (ltpf_pitch_lag_present) { | | |
| 16c, 17c | ltpf_active; | 1 | uimsbf |
| 16b, 17b | ltpf_pitch_lag; | 9 | uimsbf |
| | if (ltpf_active) { | | |
| 17d | ltpf_gain; | 2 | uimsbf |
| | } | | |
| | } | | |
| | } | | |

Fig. 8b

ENCODING AND DECODING AUDIO SIGNALS

CROSS-REFERENCES TO RELATED APPLICATIONS

This application is a continuation of copending International Application No. PCT/EP2018/080350, filed Nov. 6, 2018, which is incorporated herein by reference in its entirety, and additionally claims priority from European Application No. EP 17 201 099.3, filed Nov. 10, 2017, which is incorporated herein by reference in its entirety.

BACKGROUND OF THE INVENTION

1. Technical Field

Examples refer to methods and apparatus for encoding/decoding audio signal information.

2. Conventional Technology

The conventional technology comprises the following disclosures:

[1] 3GPP TS 26.445; Codec for Enhanced Voice Services (EVS); Detailed algorithmic description.

[2] ISO/IEC 23008-3:2015; Information technology—High efficiency coding and media delivery in heterogeneous environments—Part 3: 3D audio.

[3] Ravelli et al. "Apparatus and method for processing an audio signal using a harmonic post-filter." U.S. Patent Application No. 2017/0140769 A1. 18 May 2017.

[4] Markovic et al. "Harmonicity-dependent controlling of a harmonic filter tool." U.S. Patent Application No. 2017/0133029 A1. 11 May 2017.

[5] ITU-T G.718: Frame error robust narrow-band and wideband embedded variable bit-rate coding of speech and audio from 8-32 kbit/s.

[6] ITU-T G.711 Appendix I: A high quality low-complexity algorithm for packet loss concealment with G.711.

[7] 3GPP TS 26.447; Codec for Enhanced Voice Services (EVS); Error concealment of lost packets.

Transform-based audio codecs generally introduce inter-harmonic noise when processing harmonic audio signals, particularly at low delay and low bitrate. This inter-harmonic noise is generally perceived as a very annoying artefact, significantly reducing the performance of the transform-based audio codec when subjectively evaluated on highly tonal audio material.

Long Term Post Filtering (LTPF) is a tool for transform-based audio coding that helps at reducing this inter-harmonic noise. It relies on a post-filter that is applied on the time-domain signal after transform decoding. This post-filter is essentially an infinite impulse response (IIR) filter with a comb-like frequency response controlled by parameters such as pitch information (e.g., pitch lag).

For better robustness, the post-filter parameters (a pitch lag and, in some examples, a gain per frame) are estimated at the encoder-side and encoded in the bitstream, e.g., when the gain is non-zero. In examples, the case of the gain being zero is signalled with one bit and corresponds to an inactive post-filter, used when the signal does not contain a harmonic part. LTPF was first introduced in the 3GPP EVS standard [1] and later integrated to the MPEG-H 3D-audio standard [2]. Corresponding patents are [3] and [4].

In known technology, other functions at the decoder may make use of pitch information. An example is packet loss concealment (PLC) or error concealment. PLC is used in audio codecs to conceal lost or corrupted packets during the transmission from the encoder to the decoder. In known technology, PLC may be performed at the decoder side and extrapolate the decoded signal either in the transform-domain or in the time-domain. Ideally, the concealed signal should be artefact-free and should have the same spectral characteristics as the missing signal. This goal is particularly difficult to achieve when the signal to conceal contains a harmonic structure.

In this case, pitch-based PLC techniques may produce acceptable results. These approaches assume that the signal is locally stationary and recover the lost signal by synthesizing a periodic signal using an extrapolated pitch period. These techniques may be used in CELP-based speech coding (see e.g. ITU-T G.718 [5]). They can also be used for PCM coding (ITU-T G.711 [6]). And more recently they were applied to MDCT-based audio coding, the best example being TCX time domain concealment (TCX TD-PLC) in the 3GPP EVS standard [7].

The pitch information (which may be the pitch lag) is the main parameter used in pitch-based PLC. This parameter can be estimated at the encoder-side and encoded into the bitstream. In this case, the pitch lag of the last good frames are used to conceal the current lost frame (like in e.g. [5] and [7]). If there is no pitch lag in the bitstream, it can be estimated at the decoder-side by running a pitch detection algorithm on the decoded signal (like in e.g. [6]).

In the 3GPP EVS standard (see [1] and [7]), both LTPF and pitch-based PLC are used in the same MDCT-based TCX audio codec. Both tools share the same pitch lag parameter. The LTPF encoder estimates and encodes a pitch lag parameter. This pitch lag is present in the bitstream when the gain is non-zero. At the decoder-side, the decoder uses this information to filter the decoded signal. In case of packet-loss, pitch-based PLC is used when the LTPF gain of the last good frame is above a certain threshold and other conditions are met (see [7] for details). In that case, the pitch lag is present in the bitstream and it can directly be used by the PLC module.

The bitstream syntax of the known technology is given by

| Syntax | No. of bits | Mnemonic |
|---|---|---|
| ltpf data( ) | | |
| { | | |
| ltpf active; | 1 | uimsbf |
| if ( ltpf active) } | | |
| ltpf pitch lag; | 9 | uimsbf |
| ltpf gain; | 2 | uimsbf |
| } | | |
| } | | |

However, some problems may arise.

The pitch lag parameter is not encoded in the bitstream for every frame. When the gain is zero in a frame (LTPF inactive), no pitch lag information is present in the bitstream. This can happen when the harmonic content of the signal is not dominant and/or stable enough.

Accordingly, by discriminating the encoding of the pitch lag on the basis of the gain, no pitch lag may be obtained by other functions (e.g., PLC).

For example, there are frames where the signal is slightly harmonic, not enough for LTPF, but sufficient for using pitch based PLC. In that case, the pitch-lag parameter may be used at the decoder-side even though it is not present in the bitstream.

One solution would be to add a second pitch detector at the decoder side, but this would add a significant amount of complexity, which is a problem for audio codecs targeting low-power devices.

SUMMARY

According to an embodiment, an apparatus for decoding audio signal information associated to an audio signal divided in a sequence of frames, each frame of the sequence of frames being one of a first frame, a second frame, and a third frame, may have: a bitstream reader configured to read encoded audio signal information including: an encoded representation of the audio signal for the first frame, the second frame, and the third frame; a first pitch information for the first frame and a first control data item including a first value; and a second pitch information for the second frame and a second control data item including a second value being different from the first value, wherein the first control data item and the second control data item are in the same field; and a third control data item for the first frame, the second frame, and the third frame, the third control data item indicating the presence or absence of the first pitch information and/or the second pitch information, the third control data item being encoded in one single bit including a value which distinguishes the third frame from the first and second frame, the third frame including a format which lacks the first pitch information, the first control data item, the second pitch information, and the second control data item; a controller configured to control a long term post filter, LTPF, and to: check the third control data item to verify whether a frame is a third frame and, in case of verification that the frame is not a third frame, check the first data item and second control data item to verify whether the frame is a first frame or second frame, so as to: filter a decoded representation of the audio signal in the second frame using the second pitch information, and store the second pitch information to conceal a subsequent non-properly decoded audio frame, in case it is verified that the second control data item includes the second value; deactivate the LTPF for the first frame, but store the first pitch information to conceal a subsequent non-properly decoded audio frame, in case it is verified that the first control data item includes the first value; and both deactivate the LTPF and the storing of pitch information to conceal a subsequent non-properly decoded audio frame, in case it is verified from the third control data item that the frame is a third frame.

According to another embodiment, an apparatus for encoding audio signals may have: a pitch estimator configured to acquire pitch information associated to a pitch of an audio signal; a signal analyzer configured to acquire harmonicity information associated to the harmonicity of the audio signal; and a bitstream former configured to prepare encoded audio signal information encoding frames so as to include in the bitstream: an encoded representation of the audio signal for a first frame, a second frame, and a third frame; a first pitch information for the first frame and a first control data item including a first value; a second pitch information for the second frame and a second control data item including a second value being different from the first value; and a third control data item for the first, second and third frame, wherein the first value and the second value depend on a second criteria associated to the harmonicity information, and the first value indicates a non-fulfilment of the second criteria for the harmonicity of the audio signal in the first frame, and the second value indicates a fulfilment of the second criteria for the harmonicity of the audio signal in the second frame, wherein the second criteria include at least a condition which is fulfilled when at least one second harmonicity measurement is greater than at least one second threshold, the third control data item being encoded in one single bit including a value which distinguishes the third frame from the first and second frame, the third frame being encoded in case of non-fulfilment of a first criteria and the first and second frames being encoded in case of fulfilment of the first criteria, wherein the first criteria include at least a condition which is fulfilled when at least one first harmonicity measurement is greater than at least one first threshold, wherein, in the bitstream, for the first frame, one single bit is reserved for the first control data item and a fixed data field is reserved for the first pitch information, wherein, in the bitstream, for the second frame, one single bit is reserved for the second control data item and a fixed data field is reserved for the second pitch information, and wherein, in the bitstream, for the third frame, no bit is reserved for the fixed data field and/or for the first and second control item.

According to another embodiment, a method for decoding audio signal information associated to an audio signal divided in a sequence of frames, wherein each frame is one of a first frame, a second frame, and a third frame, may have the steps of: reading an encoded audio signal information including: an encoded representation of the audio signal for the first frame and the second frame; a first pitch information for the first frame and a first control data item including a first value; a second pitch information for the second frame and a second control data item including a second value being different from the first value, wherein the first control data item and the second control data item are in the same field; and a third control data item for the first frame, the second frame, and the third frame, the third control data item indicating the presence or absence of the first pitch information and/or the second pitch information, the third control data item being encoded in one single bit including a value which distinguishes the third frame from the first and second frame, the third frame including a format which lacks the first pitch information, the first control data item, the second pitch information, and the second control data item, at the determination that the first control data item includes the first value, using the first pitch information for a long term post filter, LTPF, and for an error concealment function; at the determination of the second value of the second control data item, deactivating the LTPF but using the second pitch information for the error concealment function; and at the determination that the frame is a third frame, deactivating the LTPF and deactivating the use of the encoded representation of the audio signal for the error concealment function.

According to another embodiment, a method for encoding audio signal information associated to a signal divided into frames may have the steps of: acquiring measurements from the audio signal; verifying the fulfilment of a second criteria, the second criteria being based on the measurements and including at least one condition which is fulfilled when at least one second harmonicity measurement is greater than a second threshold; forming an encoded audio signal information including frames including: an encoded representation of the audio signal for a first frame and a second frame and a third frame; a first pitch information for the first frame and a first control data item including a first value and a third control data item; a second pitch information for the second frame and a second control data item including a second value being different from the first value and a third control data item, wherein the first value and the second value depend on the second criteria, and the first value indicates a non-fulfilment of the second criteria on the basis of a harmonicity of the audio signal in the first frame, and the second value indicates a fulfilment of the second criteria on the basis of a harmonicity of the audio signal in the second frame, the third control data item being one single bit including a value which distinguishes the third frame from the first and second frames in association to the fulfilment of first criteria, so as to identify the third frame when the third control data item indicates the non-fulfilment of the first criteria, on the basis of at least one condition which is fulfilled when at least one first harmonicity measurement is higher than at least one first threshold, wherein the encoded audio signal information is formed so that, for the first frame, one single bit is reserved for the first control data item and a fixed data field for the first pitch information, and wherein the encoded audio signal information is formed so that, for the second frame, one single bit is reserved for the second control data item and a fixed data field for the second pitch information, and wherein the encoded audio signal information is formed so that, for the third frame, no bit is reserved for the fixed data field and no bit is reserved for the first control data item and the second control data item.

Another embodiment may have a non-transitory digital storage medium having a computer program stored thereon to perform the method for decoding audio signal information associated to an audio signal divided in a sequence of frames, wherein each frame is one of a first frame, a second frame, and a third frame, the method having the steps of: reading an encoded audio signal information including: an encoded representation of the audio signal for the first frame and the second frame; a first pitch information for the first frame and a first control data item including a first value; a second pitch information for the second frame and a second control data item including a second value being different from the first value, wherein the first control data item and the second control data item are in the same field; and a third control data item for the first frame, the second frame, and the third frame, the third control data item indicating the presence or absence of the first pitch information and/or the second pitch information, the third control data item being encoded in one single bit including a value which distinguishes the third frame from the first and second frame, the third frame including a format which lacks the first pitch information, the first control data item, the second pitch information, and the second control data item, at the determination that the first control data item includes the first value, using the first pitch information for a long term post filter, LTPF, and for an error concealment function; at the determination of the second value of the second control data item, deactivating the LTPF but using the second pitch information for the error concealment function; and at the determination that the frame is a third frame, deactivating the LTPF and deactivating the use of the encoded representation of the audio signal for the error concealment function, when said computer program is run by a computer.

Another embodiment may have a non-transitory digital storage medium having a computer program stored thereon to perform the method for encoding audio signal information associated to a signal divided into frames, the method having the steps of: acquiring measurements from the audio signal; verifying the fulfilment of a second criteria, the second criteria being based on the measurements and including at least one condition which is fulfilled when at least one second harmonicity measurement is greater than a second threshold; forming an encoded audio signal information including frames including: an encoded representation of the audio signal for a first frame and a second frame and a third frame; a first pitch information for the first frame and a first control data item including a first value and a third control data item; a second pitch information for the second frame and a second control data item including a second value being different from the first value and a third control data item, wherein the first value and the second value depend on the second criteria, and the first value indicates a non-fulfilment of the second criteria on the basis of a harmonicity of the audio signal in the first frame, and the second value indicates a fulfilment of the second criteria on the basis of a harmonicity of the audio signal in the second frame, the third control data item being one single bit including a value which distinguishes the third frame from the first and second frames in association to the fulfilment of first criteria, so as to identify the third frame when the third control data item indicates the non-fulfilment of the first criteria, on the basis of at least one condition which is fulfilled when at least one first harmonicity measurement is higher than at least one first threshold, wherein the encoded audio signal information is formed so that, for the first frame, one single bit is reserved for the first control data item and a fixed data field for the first pitch information, and wherein the encoded audio signal information is formed so that, for the second frame, one single bit is reserved for the second control data item and a fixed data field for the second pitch information, and wherein the encoded audio signal information is formed so that, for the third frame, no bit is reserved for the fixed data field and no bit is reserved for the first control data item and the second control data item, when said computer program is run by a computer.

3. The Present Invention

According to examples, there is provided an apparatus for decoding audio signal information associated to an audio signal divided in a sequence of frames, comprising:

- a bitstream reader configured to read encoded audio signal information having:
  - an encoded representation of the audio signal for a first frame and a second frame;
  - a first pitch information for the first frame and a first control data item having a first value; and
  - a second pitch information for the second frame and a second control data item having a second value being different from the first value; and
- a controller configured to control a long term post filter, LTPF, to:
  - filter a decoded representation of the audio signal in the second frame using the second pitch information when the second control data item has the second value; and
  - deactivate the LTPF for the first frame when the first control data item has the first value.

Accordingly, it is possible for the apparatus to discriminate between frames suitable for LTPF and frames non-suitable for LTPF, while using frames for error concealment even if the LTPF would not be appropriate. For example, in case of higher harmonicity the apparatus may make use of the pitch information (e.g., pitch lag) for LTPF. In case of lower harmonicity, the apparatus may avoid the use of the pitch information for LTPF, but may make use of the pitch information for other functions (e.g., concealment).

According to examples, the bitstream reader is configured to read a third frame, the third frame having a control data item indicating the presence or absence of the first pitch information and/or the second pitch information.

According to examples, the third frame has a format which lacks the first pitch information, the first control data item, the second pitch information, and the second control data item.

According to examples, the third control data item is encoded in one single bit having a value which distinguishes the third frame from the first and second frame.

According to examples, in the encoded audio signal information, for the first frame, one single bit is reserved for the first control data item and a fixed data field is reserved for the first pitch information.

According to examples, in the encoded audio signal information, for the second frame, one single bit is reserved for the second control data item and a fixed data field is reserved for the second pitch information.

According to examples, the first control data item and the second control data item are encoded in the same portion or data field in the encoded audio signal information.

According to examples, the encoded audio signal information comprises one first signalling bit encoding the third control data item; and, in case of a value of the third control data item (18*e*) indicating the presence of the first pitch information (16*b*) and/or the second pitch information (17*b*), a second signalling bit encoding the first control data item (16*c*) and the second control data item (17*c*).

According to examples, the apparatus may further comprise a concealment unit configured to use the first and/or second pitch information to conceal a subsequent non-properly decoded audio frame.

According to examples, the concealment unit may be configured to, in case of determination of decoding of an invalid frame, check whether pitch information relating a previously correctly decoded frame is stored, so as to conceal an invalidly decoded frame with a frame obtained using the stored pitch information.

Accordingly, it is possible to obtain a good concealment every time the audio signal is compliant to concealment, and not only when the audio signal is compliant to LTPF. When the pitch information is obtained, there is no necessity of estimating the pitch lag, hence reducing the complexity.

According to examples, there is provided apparatus for encoding audio signals, comprising:

a pitch estimator configured to obtain pitch information associated to a pitch of an audio signal;

a signal analyzer configured to obtain harmonicity information associated to the harmonicity of the audio signal; and a bitstream former configured to prepare encoded audio signal information encoding frames so as to include in the bitstream:

an encoded representation of the audio signal for a first frame, a second frame, and a third frame;

a first pitch information for the first frame and a first control data item having a first value;

a second pitch information for the second frame and a second control data item having a second value being different from the first value; and a third control data item for the first, second and third frame, wherein the first value and the second value depend on a second criteria associated to the harmonicity information, and the first value indicates a non-fulfilment of the second criteria for the harmonicity of the audio signal in the first frame, and the second value indicates a fulfilment of the second criteria for the harmonicity of the audio signal in the second frame, wherein the second criteria comprise at least a condition which is fulfilled when at least one second harmonicity measurement is greater than at least one second threshold, the third control data item being encoded in one single bit having a value which distinguishes the third frame from the first and second frames, the third frame being encoded in case of non-fulfilment of first criteria and the first and second frames being encoded in case of fulfilment of the first criteria, wherein the first criteria comprise at least a condition which is fulfilled when at least one first harmonicity measurement is greater than at least one first threshold, wherein in the bitstream, for the first frame, one single bit is reserved for the first control data item and a fixed data field is reserved for the first pitch information, wherein in the bitstream, for the second frame, one single bit is reserved for the second control data item and a fixed data field is reserved for the second pitch information, and wherein in the bitstream, for the third frame, no bit is reserved for the fixed data field and/or for the first and second control item.

Accordingly, it is possible for the decoder to discriminate between frames useful for LTPF, frames useful for PLC only, and frames useless for both LTPF and PLC.

According to examples, the second criteria comprise an additional condition which is fulfilled when at least one harmonicity measurement of the previous frame is greater than the at least one second threshold.

According to examples, the signal analyzer is configured to determine whether the signal is stable between two consecutive frames as a condition for the second criteria.

Accordingly, it is possible for the decoder to discriminate, for example, between a stable signal and a non-stable signal. In case of non-stable signal, the decoder may avoid the use of the pitch information for LTPF, but may make use of the pitch information for other functions (e.g., concealment).

According to examples, the first and second harmonicity measurements are obtained at different sampling rates According to examples, the pitch information comprises a pitch lag information or a processed version thereof.

According to examples, the harmonicity information comprises at least one of an autocorrelation value and/or a normalized autocorrelation value and/or a processed version thereof.

According to examples, there is provided a method for decoding audio signal information associated to an audio signal divided in a sequence of frames, comprising:

reading an encoded audio signal information comprising:

an encoded representation of the audio signal for a first frame and a second frame;

a first pitch information for the first frame and a first control data item (16*c*) having a first value;

a second pitch information for the second frame and a second control data item having a second value being different from the first value, at the determination that the first control data item has the first value, using the first pitch information for a long term post filter, LTPF, and at the determination of the second value of the second control data item (17*c*), deactivating the LTPF.

According to examples, the method further comprises, at the determination that the first or second control data item has the first or second value, using the first or second pitch information for an error concealment function.

According to examples, there is provided a method for encoding audio signal information associated to a signal divided into frames, comprising:

obtaining measurements from the audio signal;

verifying the fulfilment of a second criteria, the second criteria being based on the measurements and comprising at least one condition which is fulfilled when at least one second harmonicity measurement is greater than a second threshold;

forming an encoded audio signal information having frames including:

an encoded representation of the audio signal for a first frame and a second frame and a third frame;

a first pitch information for the first frame and a first control data item having a first value and a third control data item;

a second pitch information for the second frame and a second control data item having a second value being different from the first value and a third control data item, wherein the first value and the second value depend on the second criteria, and the first value indicates a non-fulfilment of the second criteria on the basis of a harmonicity of the audio signal in the first frame, and the second value indicates a fulfilment of the second criteria on the basis of a harmonicity of the audio signal in the second frame, the third control data item being one single bit having a value which distinguishes the third frame from the first and second frames in association to the fulfilment of first criteria, so as to identify the third frame when the third control data item indicates the non-fulfilment of the first criteria on the basis of at least one condition which is fulfilled when at least one first harmonicity measurement is higher than at least one first threshold, wherein the encoded audio signal information is formed so that, for the first frame, one single bit is reserved for the first control data item and a fixed data field for the first pitch information, and wherein the encoded audio signal information is formed so that, for the second frame, one single bit is reserved for the second control data item and a fixed data field for the second pitch information, and wherein the encoded audio signal information is formed so that, for the third frame, no bit is reserved for the fixed data field and no bit is reserved for the first control data item and the second control data item.

According to examples, there is provided a method comprising:

encoding an audio signal;

transmitting the encoded audio signal information to a decoder or storing the encoded audio signal information;

decoding the audio signal information.

According to examples, there is provided a method for encoding/decoding audio signals, comprising:

at the encoder, encoding an audio signal and deriving harmonicity information and/or pitch information;

at the encoder, determining whether the harmonicity information and/or pitch information is suitable for at least an LTPF and/or error concealment function;

transmitting from the decoder to an encoder and/or storing in a memory a bitstream including a digital representation of the audio signal and information associated to harmonicity and signalling whether the pitch information adapted for LTPF and/or error concealment;

at the decoder, decoding the digital representation of the audio signal and using the pitch information for LTPF and/or error concealment according to the signalling form the encoder.

In examples, the encoder is according to any of the examples above or below, and/or the decoder is according to any of the examples above or below, and/or encoding is according to the examples above or below and/or decoding is according to the examples above or below.

According to examples, there is provided a non-transitory memory unit storing instructions which, when executed by a processor, perform a method as above or below.

Hence, the encoder may determine if a signal frame is useful for long term post filtering (LTPF) and/or packet lost concealment (PLC) and may encode information in accordance to the results of the determination. The decoder may apply the LTPF and/or PLC in accordance to the information obtained from the encoder.

BRIEF DESCRIPTION OF THE DRAWINGS

Embodiments of the present invention will be detailed subsequently referring to the appended drawings, in which

FIGS. 8*a* and 8*b* show formats of encoded audio signal information;

DETAILED DESCRIPTION OF THE INVENTION

4. Encoder Side

Figure 1:
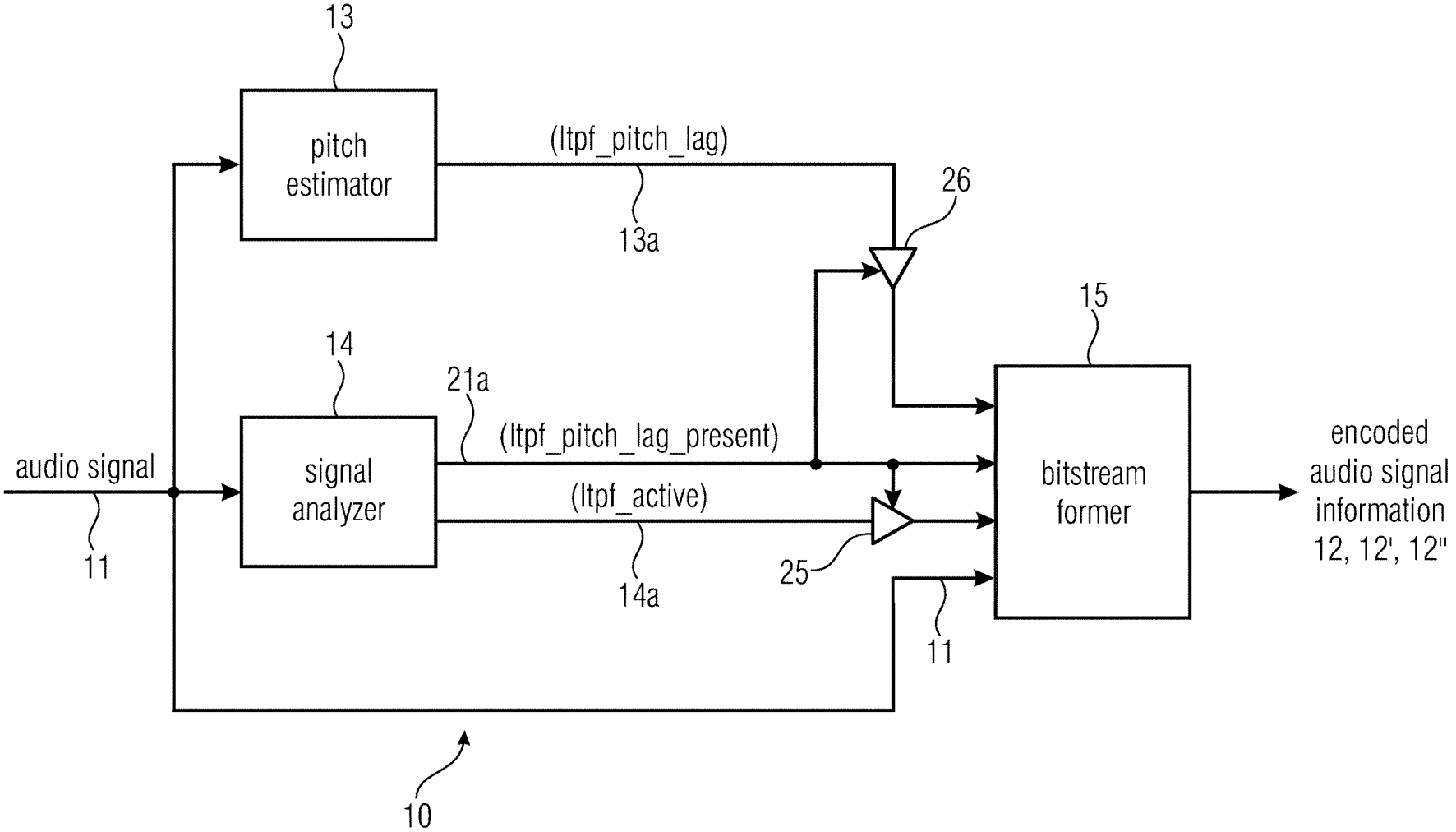
FIGS. 1 and 2 show apparatus for encoding audio signal information.

FIG. 1 shows an apparatus 10. The apparatus 10 may be for encoding signals (encoder). For example, the apparatus 10 may encode audio signals 11 to generate encoded audio signal information (e.g., information 12, 12', 12", with the terminology used below).

The apparatus 10 may include a (not shown) component to obtain (e.g., by sampling the original audio signal) the digital representation of the audio signal, so as to process it in digital form. The audio signal may be divided into frames (e.g., corresponding to a sequence of time intervals) or subframe (which may be subdivisions of frames). For example, each interval may be 20 ms long (a subframe may be 10 ms long). Each frame may comprise a finite number of samples (e.g., 1024 or 2048 samples for a 20 ms frame) in the time domain (TD). In examples, a frame or a copy or a processed version thereof may be converted (partially or completely) into a frequency domain (FD) representation. The encoded audio signal information may be, for example, of the Code-Excited Linear Prediction, (CELP), or algebraic CELP (ACELP) type, and/or TCX type. In examples, the apparatus 10 may include a (non-shown) downs ampler to reduce the number of samples per frame. In examples, the apparatus 10 may include a resampler (which may be of the upsampler, low-pass filter, and upsampler type).

In examples, the apparatus 10 may provide the encoded audio signal information to a communication unit. The communication unit may comprise hardware (e.g., with at least an antenna) to communicate with other devices (e.g., to transmit the encoded audio signal information to the other devices). The communication unit may perform communications according to a particular protocol. The communication may be wireless. A transmission under the Bluetooth standard may be performed. In examples, the apparatus 10 may comprise (or store the encoded audio signal information onto) a storage device.

The apparatus 10 may comprise a pitch estimator 13 which may estimate and provide in output pitch information 13*a* for the audio signal 11 in a frame (e.g., during a time interval). The pitch information 13*a* may comprise a pitch lag or a processed version thereof. The pitch information 13*a* may be obtained, for example, by computing the autocorrelation of the audio signal 11. The pitch information 13*a* may be represented in a binary data field (here indicated with "ltpf_pitch_lag"), which may be represented, in examples, with a number of bits comprised between 7 and 11 (e.g., 9 bits).

The apparatus 10 may comprise a signal analyzer 14 which may analyze the audio signal 11 for a frame (e.g., during a time interval). The signal analyzer 14 may, for example, obtain harmonicity information 14*a* associated to the audio signal 11. Harmonicity information may comprise or be based on, for example, at least one or a combination of correlation information (e.g., autocorrelation information), gain information (e.g., post filter gain information), periodicity information, predictability information, etc. At least one of these values may be normalized or processed, for example.

In examples, the harmonicity information 14*a* may comprise information which may be encoded in one bit (here indicated with "ltpf_active"). The harmonicity information 14*a* may carry information of the harmonicity of the signal. The harmonicity information 14*a* may be based on the fulfilment of a criteria ("second criteria") by the signal. The harmonicity information 14*a* may distinguish, for example, between a fulfilment of the second criteria (which may be associated to higher periodicity and/or higher predictability and/or stability of the signal), and a non-fulfilment of the second criteria (which may be associated to lower harmonicity and/or lower predictability and/or signal instability). Lower harmonicity is in general associated to noise. At least one of the data in the harmonicity information 14*a* may be based on the verification of the second criteria and/or the verification of at least one of the condition(s) established by the second criteria. For example, the second criteria may comprise a comparison of at least one harmonicity-related measurement (e.g., one or a combination of autocorrelation, harmonicity, gain, predictability, periodicity, etc., which may also be normalized and/or processed), or a processed version thereof, with at least one threshold. For example, a threshold may be a "second threshold" (more than one thresholds are possible). In some examples, the second criteria comprise the verification of conditions on the previous frame (e.g., the frame immediately preceding the current frame). In some examples, the harmonicity information 14*a* may be encoded in one bit. In some other examples, a sequence of bits, (e.g., one bit for the "ltpf_active" and some other bits, for example, for encoding a gain information or other harmonicity information).

As indicated by the selector 26, output harmonicity information 21*a* may control the actual encoding of pitch information 13*a*. For example, in case of extremely low harmonicity, the pitch information 13*a* may be prevented from being encoded in a bitstream.

As indicated by the selector 25, the value of the output harmonicity information 21*a* ("ltpf_pitch_lag_present") may control the actual encoding of the harmonicity information 14*a*. Therefore, in case of detection of an extremely low harmonicity (e.g., on the basis of criteria different from the second criteria), the harmonicity information 14*a* may be prevented from being encoded in a bitstream.

The apparatus 10 may comprise a bitstream former 15. The bitstream former 15 may provide encoded audio signal information (indicated with 12, 12', or 12") of the audio signal 11 (e.g., in a time interval). In particular, the bitstream former 15 may form a bitstream containing at least the digital version of the audio signal 11, the pitch information 13*a* (e.g., "ltpf_pitch_lag"), and the harmonicity information 14*a* (e.g., "ltpf_active"). The encoded audio signal information may be provided to a decoder. The encoded audio signal information may be a bitstream, which may be, for example, stored and/or transmitted to a receiver (which, in turn, may decode the audio information encoded by the apparatus 10).

The pitch information 13*a* in the encoded audio signal information may be used, at the decoder side, for a long term post filter (LTPF). The LTPF may operate in TD. In examples, when the harmonicity information 14*a* indicates a higher harmonicity, the LTPF will be activated at the decoder side (e.g., using the pitch information 13*a*). When the harmonicity information 14*a* indicates a lower (intermediate) harmonicity (or anyway a harmonicity unsuitable for LTPF), the LTPF will be deactivated or attenuated at the decoder side (e.g., without using the pitch information 13*a*, even if the pitch information is still encoded in the bitstream). When the harmonicity information 14*a* comprises the field "ltpf_active" (which may be encoded in one bit), ltpf_active=0 may mean "don't use the LTPF at the decoder", while ltpf_active=1 may mean "use the LTPF at the decoder"). For example, ltpf_active=0 may be associated to a harmonicity which is lower than the harmonicity associated to ltpf_active=1, e.g., after having compared a harmonicity measurement to the second threshold. While according to the conventions in this document ltpf_active=0 refers to a harmonicity lower than the harmonicity associated to ltpf_active=1, a different convention (e.g., based on different meanings of the binary values) may be provided. Additional or alternative criteria and/or conditions may be used for determining the value of the ltpf_active. For example, in order to state ltpf_active=1, it may also be checked whether the signal is stable (e.g., by also checking a harmonicity measurement associated to a previous frame).

In addition to the LTPF function, the pitch information 13*a* may be used, for example, for performing a packet loss concealment (PLC) operation at the decoder. In examples, irrespective of the harmonicity information 14*a* (e.g., even if ltpf_active=0), the PLC will be notwithstanding carried out. Therefore, in examples, while the pitch information 13*a* will be used by the PLC function of the decoder, the same pitch information 13*a* will only be used by a LTPF function at the decoder only under the condition set by the harmonicity information 14*a*.

It is also possible to verify the fulfilment or non-fulfilment of a "first criteria" (which may different from the second criteria), e.g., for determining if the transmission of the harmonicity information 13*a* would be a valuable information for the decoder.

In examples, when the signal analyzer 14 detects that the harmonicity (e.g., a particularly measurement of the harmonicity) does not fulfil first criteria (the first criteria being fulfilled, for example, on the condition of the harmonicity, and in particular the measurement of the harmonicity, being higher than a particular "first threshold"), then the choice of encoding no pitch information 13*a* may be taken by the apparatus 10. In that case, for example, the decoder will use the data in the encoded frame neither for an LTPF function nor for a PLC function (at least, in some examples, the decoder will use a concealment strategy not based on the pitch information, but using different concealment techniques, such as decoder-based estimations, FD concealment techniques, or other techniques).

The first and second thresholds discussed above may be chosen, in some examples, so that:

- the first threshold and/or first criteria discriminate(s) between an audio signal suitable for a PLC and an audio signal unsuitable for PLC; and
- the second threshold and/or second criteria discriminate(s) between an audio signal suitable for a LTPF and an audio signal unsuitable for LTPF.

In examples, the first and second thresholds may be chosen so that, assuming that the harmonicity measurements which are compared to the first and second thresholds have a value between 0 and 1 (where 0 means: not harmonic signal; and 1 means: perfectly harmonic signal), then the value of the first threshold is lower than the value of the second threshold (e.g., the harmonicity associated to the first threshold is lower than the harmonicity associated to the second threshold).

Amongst the conditions set out for the second criteria, it is also possible to check if the temporal evolution of the audio signal 11 is such that it is possible to use the signal for LTPF. For example, it may be possible to check whether, for the previous frame, a similar (or the same) threshold has been reached. In examples, combinations (or weighted combinations) of harmonicity measurements (or processed versions thereof) may be compared to one or more thresholds. Different harmonicity measurements (e.g., obtained at different sampling rates) may be used.

Figure 5:
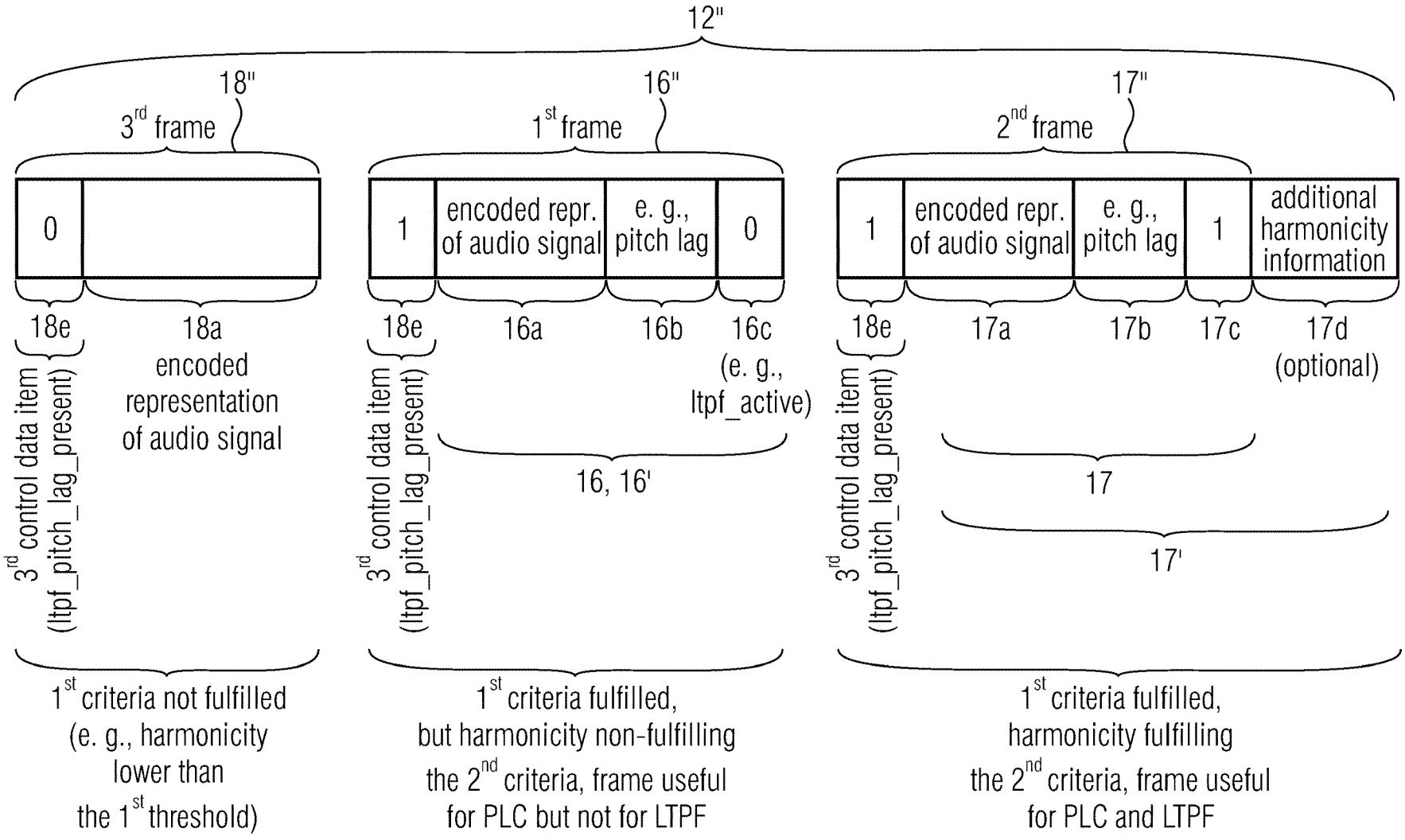

FIG. 5 shows examples of frames 12" (or portions of frames) of the encoded audio signal information which may be prepared by the apparatus 10. The frames 12" may be distinguished between first frames 16", second frames 17", and third frames 18". In the temporal evolution of the audio signal 11, first frames 16" may be replaced by second frames 17" and/or third frames, and vice versa, e.g., according to the features (e.g., harmonicity) of the audio signal in the particular time intervals (e.g., on the basis of the signal fulfilling or non-fulfilling the first and/or second criteria and/or the harmonicity being greater or smaller than the first threshold and/or second threshold).

A first frame 16" may be a frame associated to a harmonicity which is held suitable for PLC but not necessarily for LTPF (first criteria being fulfilled, second criteria non-fulfilled). For example, a harmonicity measurement may be lower than the second threshold or other conditions are not fulfilled (for example, the signal has not been stable between the previous frame and the current frame). The first frame 16" may comprise an encoded representation 16*a* of the audio signal 11. The first frame 16" may comprise first pitch information 16*b* (e.g., "ltpf_pitch_lag"). The first pitch information 16*b* may encode or be based on, for example, the pitch information 13*a* obtained by the pitch estimator 13. The first frame 16" may comprise a first control data item 16*c* (e.g., "ltpf_active", with value "0" according to the present convention), which may comprise or be based on, for example, the harmonicity information 14*a* obtained by the signal analyzer 14. This first frame 16" may contain (in the field 16*a*) enough information for decoding, at the decoder side, the audio signal and, moreover, for using the pitch information 13*a* (encoded in 16*b*) for PLC, in case of need. In examples, the decoder will not use the pitch information 13*a* for LTPF, by virtue of the harmonicity not fulfilling the second criteria (e.g., low harmonicity measurement of the signal and/or non-stable signal between two consecutive frames).

A second frame 17" may be a frame associated to a harmonicity which is retained sufficient for LTPF (e.g., it fulfils the second criteria, e.g., the harmonicity, according to a measurement, is higher than the second threshold and/or the previous frame also is greater than at least a particular threshold). The second frame 17" may comprise an encoded representation 17*a* of the audio signal 11. The second frame 17" may comprise second pitch information 17*b* (e.g., "ltpf_pitch_lag"). The second pitch information 17*b* may encode or be based on, for example, the pitch information 13*a* obtained by the pitch estimator 13. The second frame 17" may comprise a second control data item 17*c* (e.g., "ltpf_active", with value "1" according to the present convention), which may comprise or be based on, for example, the harmonicity information 14*a* obtained by the signal analyzer 14. This second frame 17" may contain enough information so that, at the decoder side, the audio signal 11 is decoded and, moreover, the pitch information 17*b* (from the output 13*a* of the pitch estimator) may be used for PLC, in case of need. Further, the decoder will use the pitch information 17*b* (13*a*) for LTPF, by virtue of the fulfilment of the second criteria, based, in particular on the high harmonicity of the signal (as indicated by ltpf_active=1 according to the present convention).

In examples, the first frames 16" and the second frames 17" are identified by the value of the control data items 16*c* and 17*c* (e.g., by the binary value of the "ltpf_active").

In examples, when encoded in the bitstream, the first and the second frames present, for the first and second pitch information (16*b*, 17*b*) and for the first and second control data items (16*c*, 17*c*), a format such that:

- one single bit is reserved for encoding the first and second control data items 16*c* and 17*c*; and
- a fixed data field is reserved for each of the first and second pitch information 16*b* and 17*b*.

Accordingly, one single first data item 16*c* may be distinguished from one single second data item 17*c* by the value of a bit in a particular (e.g., fixed) portion in the frame. Also the first and second pitch information may be inserted in one fixed bit number in a reserved position (e.g., fixed position).

In examples (e.g., shown in FIGS. 4 and/or 5), the harmonicity information 14*a* does not simply discriminate between the fulfilment and non-fulfilment of the second criteria, e.g., does not simply distinguished between higher harmonicity and lower harmonicity. In some cases, the harmonicity information may comprise additional harmonicity information such as a gain information (e.g., post filter gain), and/or correlation information (autocorrelation, normalized correlation), and/or a processed version thereof. In some cases, reference is here made a gain or other harmonicity information may be encoded in 1 to 4 bits (e.g., 2 bits) and may refer to the post filter gain as obtained by the signal analyzer 14.

In examples in which the additional harmonicity information is encoded, the decoder, by recognizing ltpf_active=1 (e.g., second frame 17' or 17"), may understand that a subsequent field of the second frame 17' or 17" encodes the additional harmonicity information 17*d*. To the contrary, by identifying ltpf_active=0 (e.g., first frame 16' or 16"), the decoder may understand that no additional harmonicity information field 17*d* is encoded in the frame 17' or 17".

In examples (e.g., FIG. 5), a third frame 18" may be encoded in the bitstream. The third frame 18" may be defined so as to have a format which lacks of the pitch information and the harmonicity information. Its data structure provides no bits for encoding the data 16*b*, 16*c*, 17*b*, 17*c*. However, the third frame 18" may still comprise an encoded representation 18*a* of the audio signal and/or other control data useful for the encoder.

In examples, the third frame 18" is distinguished from the first and second frames by a third control data 18*e* ("ltpf_pitch_lag_present"), which may have a value in the third frame different form the value in the first and second frames 16" and 17". For example, the third control data item 18*e* may be "0" for identifying the third frame 18" and 1 for identifying the first and second frames 16" and 17".

In examples, the third frame 18" may be encoded when the information signal would not be useful for LTPF and for PLC (e.g., by virtue of a very low harmonicity, for example, e.g., when noise is prevailing). Hence, the control data item 18*e* ("ltpf_pitch_lag_present") may be "0" to signal to the decoder that there would be no valuable information in the pitch lag, and that, accordingly, it does not make sense to encode it. This may be the result of the verification process based on the first criteria.

According to the present convention, when the third control data item 18*e* is "0", harmonicity measurements may be lower than a first threshold associated to a low harmonicity (this may be one technique for verifying the fulfilment of the first criteria).

Figure 3:
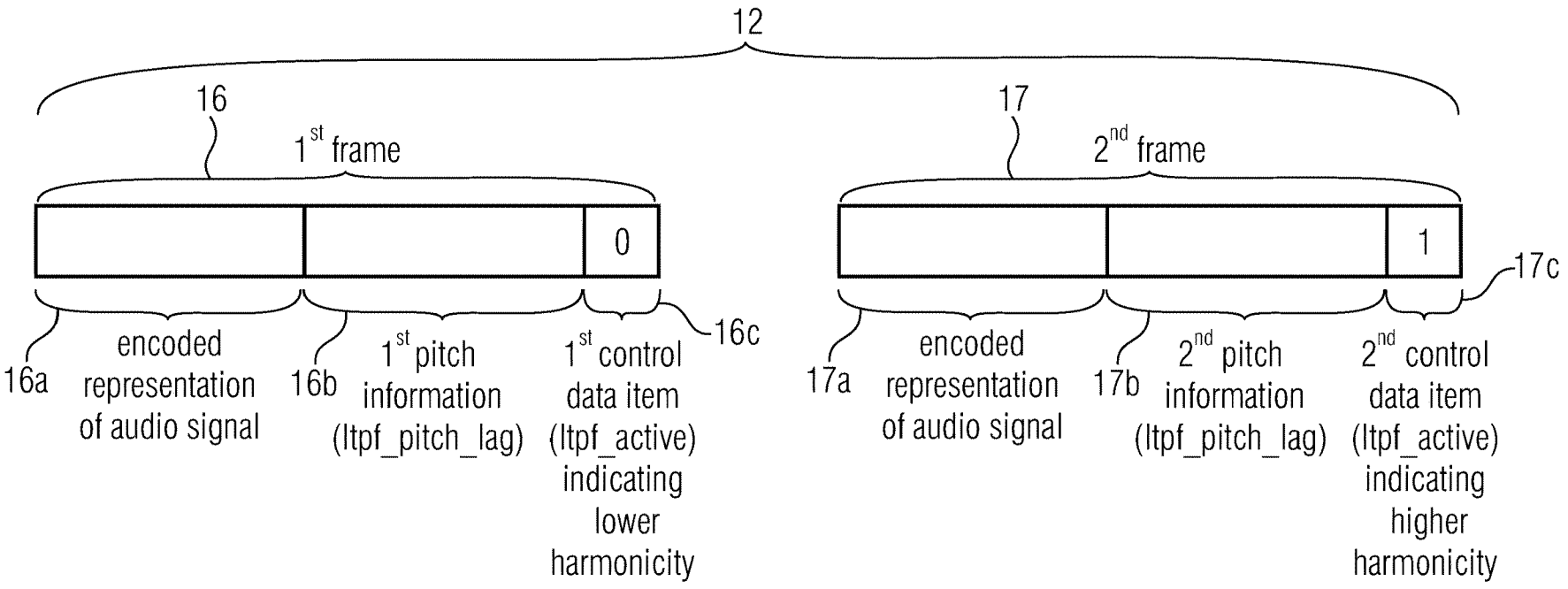
FIGS. 3-5 show formats of encoded signal information which may be encoded by the apparatus of FIG. 1 or 2.
Figure 4:
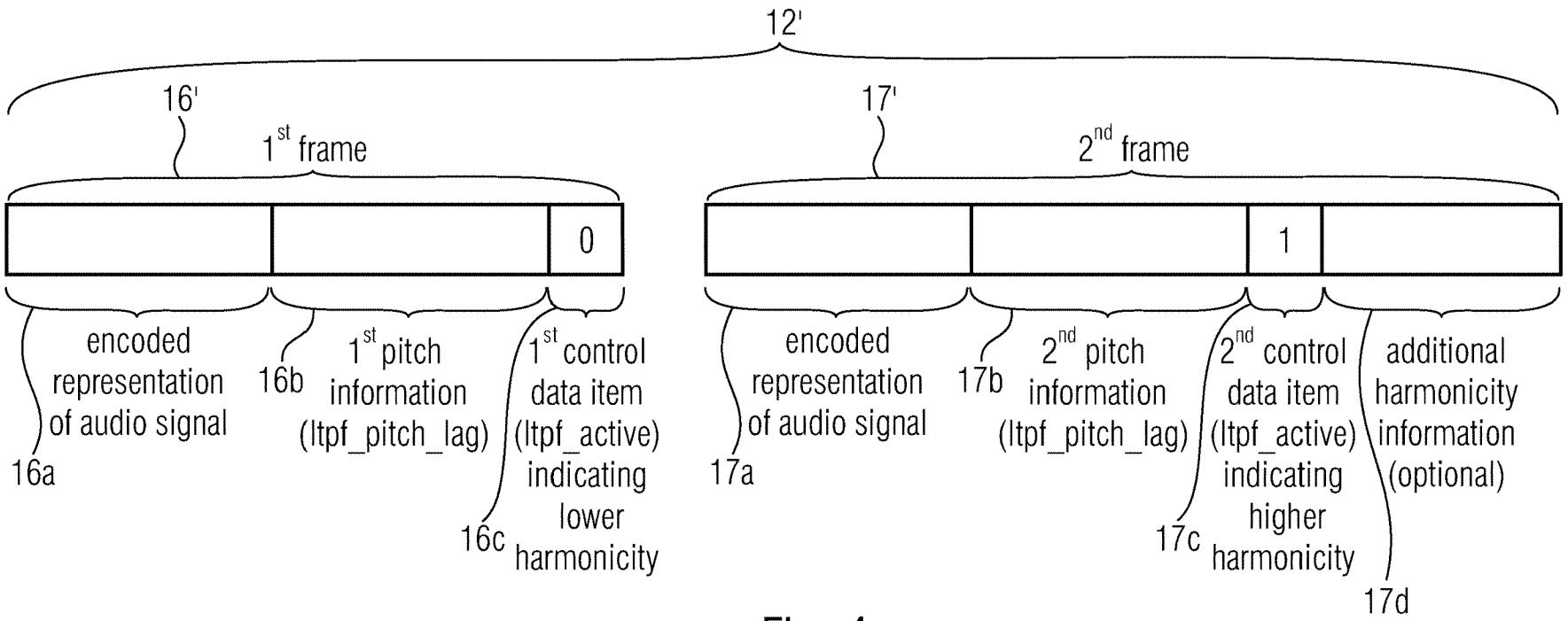

FIGS. 3 and 4 show examples of a first frame 16, 16' and a second frame 17, 17' for which the third control item 18*e* is not provided (the second frame 17' encodes additional harmonicity information, which may be optional in some examples). In some examples, these frames are not used. Notably, however, in some examples, apart from the absence of the third control item 18*e*, the frames 16, 16', 17, 17' have the same fields of the frames 16" and 17" of FIG. 5.

Figure 2:
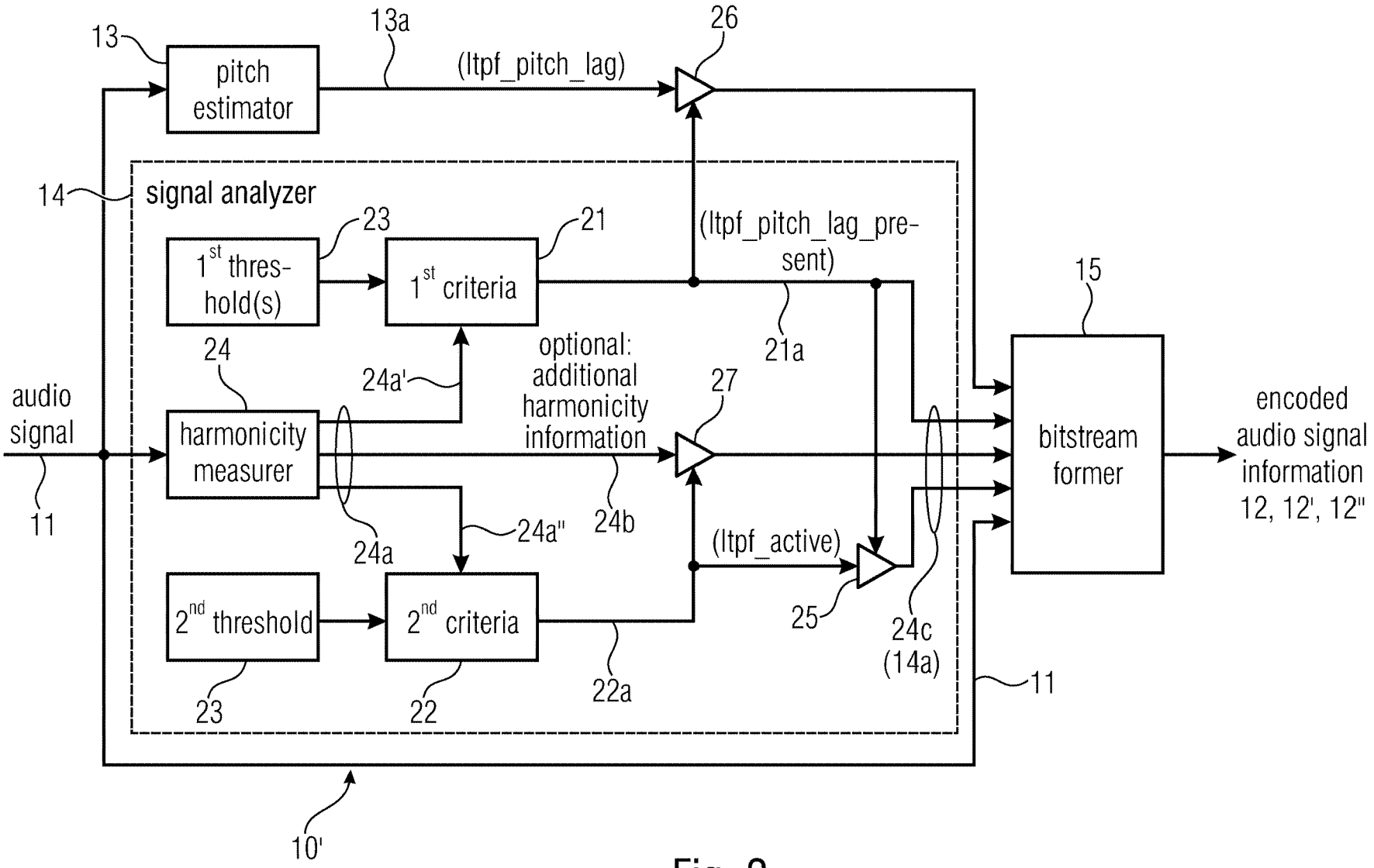

FIG. 2 shows an example of apparatus 10', which may be a particular implementation of the apparatus 10. Properties of the apparatus 10 (features of the signal, codes, transmissions/storage features, Bluetooth implementation, etc.) are therefore here not repeated. The apparatus 10' may prepare an encoded audio signal information (e.g., frames 12, 12', 12") of an audio signal 11. The apparatus 10' may comprise a pitch estimator 13, a signal analyzer 14, and a bitstream former 15, which may be as (or very similar to) those of the apparatus 10. The apparatus 10' may also comprise components for sampling, resampling, and filtering as the apparatus 10.

The pitch estimator 13 may output the pitch information 13*a* (e.g., pitch lag, such as "ltpf_pitch_lag").

The signal analyzer 14 may output harmonicity information 24*c* (14*a*), which in some examples may be formed by a plurality of values (e.g., a vector composed of a multiplicity of values). The signal analyzer 14 may comprise a harmonicity measurer 24 which may output harmonicity measurements 24*a*. The harmonicity measurements 24*a* may comprise normalized or non-normalized correlation/autocorrelation information, gain (e.g., post filter gain) information, periodicity information, predictability information, information relating the stability and/or evolution of the signal, a processed version thereof, etc. Reference sign 24*a* may refer to a plurality of values, at least some (or all) of which, however, may be the same or may be different, and/or processed versions of a same value, and/or obtained at different sampling rates.

In examples, harmonicity measurements 24*a* may comprise a first harmonicity measurement 24*a'* (which may be measured at a first sampling rate, e.g., 6.4 KHz) and a second harmonicity measurement 24*a"* (which may be measured at a second sampling rate, e.g., 12.8 KHz). In other examples, the same measurement may be used.

At block 21 it is verified if harmonicity measurements 24*a* (e.g., the first harmonicity measurement 24*a'*) fulfil the first criteria, e.g., they are over a first threshold, which may be stored in a memory element 23.

For example, at least one harmonicity measurement 24*a* (e.g., the first harmonicity measurement 24*a'*) may be compared with the first threshold. The first threshold may be stored, for example, in the memory element 23 (e.g., a non-transitory memory element). The block 21 (which may be seen as a comparer of the first harmonicity measurement 24*a'* with the first threshold) may output harmonicity information 21*a* indicating whether harmonicity of the audio signal 11 is over the first threshold (and in particular, whether the first harmonicity measurement 24*a'* is over the first threshold).

In examples, the ltpf_pitch_present may be, for example, $$\text{lftp_pitch_present} = \begin{cases} 1 & \text{if } normcorr(x_{6.4}, N_{6.4}, T_{6.4}) > \text{first_threshold} \\ 0 & \text{otherwise} \end{cases}$$

where $x_{6.4}$ is an audio signal at a sampling rate of 6.4 kHz, $N_{6.4}$ is the length of the current frame and $T_{6.4}$ is a pitch-lag obtained by the pitch estimator for the current frame and normcorr(x, L, T) is the normalized correlation of the signal x of length L at lag T $$normcorr(x, L, T) = \frac{\sum_{n=0}^{L-1} x(n)x(n-T)}{\sqrt{\sum_{n=0}^{L-1} x^2(n) \sum_{n=0}^{L-1} x^2(n-T)}}$$

In some examples, other sampling rates or other correlations may be used. In examples, the first threshold may be 0.6. It has been noted, in fact, that for harmonicity measurements over 0.6, PLC may be reliably performed. However, it is not always guaranteed that, even for values slightly over 0.6, LTPF could be reliably performed.

The output 21*a* from the block 21 may therefore be a binary value (e.g., "ltpf_pitch_lag_present") which may be "1" if the harmonicity is over the first threshold (e.g., if the first harmonicity measurement 24*a'* is over the first threshold), and may be "0" if the harmonicity is below the first threshold. The harmonicity information 21*a* (e.g., "ltpf_pitch_lag_present") may control the actual encoding of the output 13*a*: if (e.g., with the first measurement 24*a'* as shown above) the harmonicity is below the first threshold (ltpf_pitch_lag_present=0) or the first criteria is not fulfilled, no pitch information 13*a* is encoded; if the harmonicity is over the first threshold (ltpf_pitch_lag_present=1) or the first criteria are fulfilled, pitch information is actually encoded. The output 21*a* ("ltpf_pitch_lag_present") may be encoded. Hence, the output 21*a* may be encoded as the third control item 18*e* (e.g., for encoding the third frame 18" when the output 21*a* is "0", and the second or third frames when the output 21*a* is "1").

The harmonicity measurer 24 may optionally output a harmonicity measurement 24*b* which may be, for example, a gain information (e.g., "ltpf_gain") which may be encoded in the encoded audio signal information 12, 12', 12" by the bitstream former 15. Other parameters may be provided. The other harmonicity information 24*b* may be used, in some examples, for LTPF at the decoder side.

As indicated by the block 22, a verification of fulfilment of the second criteria may be performed on the basis of at least one harmonicity measurement 24*a* (e.g., a second harmonicity measurement 24*a*").

One condition on which the second criteria is based may be a comparison of at least one harmonicity measurement 24*a* (e.g., a second harmonicity measurement 24*a*") with a second threshold. The second threshold may be stored, for example, in the memory element 23 (e.g., in a memory location different from that storing the first threshold).

The second criteria may also be based on other conditions (e.g., on the simultaneous fulfilment of two different conditions). One additional condition may, for example, be based on the previous frame. For example, it is possible to compare at least one harmonicity measurement 24*a* (e.g., a second harmonicity measurement 24*a*") with a threshold.

Accordingly, the block 22 may output harmonicity information 22*a* which may be based on at least one condition or on a plurality of conditions (e.g., one condition on the present frame and one condition on the previous frame).

The block 22 may output (e.g., as a result of the verification process of the second criteria) harmonicity information 22*a* indicating whether the harmonicity of the audio signal 11 (for the present frame and/or for the previous frame) is over a second threshold (and, for example, whether the second harmonicity measurement 24*a*" is over a second threshold). The harmonicity information 22*a* may be a binary value (e.g., "ltpf_active") which may be "1" if the harmonicity is over the second threshold (e.g., the second harmonicity measurement 24*a*" is over the second threshold), and may be "0" if the harmonicity (of the present frame and/or the previous frame) is below the second threshold (e.g., the second harmonicity measurement 24*a*" is below the second threshold).

The harmonicity information 22*a* (e.g., "ltpf_active") may control (where provided) the actual encoding of the value 24*b* (in the examples in which the value 24*b* is actually provided): if the harmonicity (e.g., second harmonicity measurement 24*a*") does not fulfil the second criteria (e.g., if the harmonicity is below the second threshold and ltpf_active=0), no further harmonicity information 24*b* (e.g., no additional harmonicity information) is encoded; if the harmonicity (e.g., the second harmonicity measurement 24*a*") fulfils the second criteria (e.g., it is over the second threshold and ltpf_active=1), additional harmonicity information 24*b* is actually be encoded.

Notably, the second criteria may be based on different and/or additional conditions. For example, it is possible to verify if the signal is stable in time (e.g., if the normalized correlation has a similar behaviour in two consecutive frames).

The second threshold(s) may be defined so as to be associated to a harmonic content which is over the harmonic content associated to the first threshold. In examples, the first and second thresholds may be chosen so that, assuming that the harmonicity measurements which are compared to the first and second thresholds have a value between 0 and 1 (where 0 means: not harmonic signal; and 1 means: perfectly harmonic signal), then the value of the first threshold is lower than the value of the second threshold (e.g., the harmonicity associated to the first threshold is lower than the harmonicity associated to the second threshold).

The value 22*a* (e.g., "ltpf_active") may be encoded, e.g., to become the first or second control data item 16*c* or 17*c* (FIG. 4). The actual encoding of the value 22*a* may be controlled by the value 21*a* (e.g., using the selector 25): for example, "ltpf_active" may be encoded only if ltpf_pitch_lag_present=1, while "ltpf_active" is not provided to the bitstream former 15 when ltpf_pitch_lag_present=0 (to encode the third frame 18"). In that case, it is unnecessary to provide pitch information to the decoder: the harmonicity may be so low, that the decoder will use the pitch information neither for PLC nor for LTPF. Also harmonicity information such as "ltpf_active" may be useless in that case: as no pitch information is provided to the decoder, there is no possibility that the decoder will try to perform LTPF.

An example for obtaining the ltpf_active value (16*c*, 17*c*, 22*a*) is here provided. Other alternative strategies may be performed.

A normalized correlation may be first computed as follows $$nc = \frac{\sum_{n=0}^{127} x_i(n, 0)x_i(n - \text{pitch_int}, \text{pitch_fr})}{\sqrt{\sum_{n=0}^{127} x_i^2(n, 0) \sum_{n=0}^{127} x_i^2(n - \text{pitch_int}, \text{pitch_fr})}}$$

with pitch_int being the integer part of the pitch lag, pitch_fr being the fractional part of the pitch lag, and $$x_i(n, d) = \sum_{k=-2}^{2} x_{12.8}(n + k)h_i(4k - d)$$

with $x_{12.8}$ being the resampled input signal at 12.8 kHz (for example) and $h_i$ being the impulse response of a FIR low-pass filter given by $$h_i(n) = \begin{cases} \text{tab_ltpf_interp_x12k8}(n + 7) & , \text{if } -8 < n < 8 \\ 0 & , \text{otherwise} \end{cases}$$

with tab_ltpf_interp_x12k8 chosen, for example, from the following values:

```
double tap_ltpf_interp_x12k8[15] =
    {+6.698858366939680e − 03, +3.967114782344967e − 02,
    +1.069991860896389e − 01 + 2.098804630681809e − 01,
    +3.356906254147840e − 01, +4.592209296082350e − 01 +
    5.500750019177116e − 01, +5.835275754221211e − 01,
```

-continued $$+5.5007500191771166e-01+4.59220929608235e-01,$$

$$+3.356906254147840e-01,$$

$$+2.098804630681809e-01+1.069991860896389e-01,$$

$$+3.967114782344967e-02,+6.698858366939680e-03\};$$

The LTPF activation bit ("ltpf_active") may then be obtained according to the following procedure:

```
if (
  (mem_ltpf active ==0 && mem_nc>0.94 && nc>0.94) ||
  (mem_ltpf active ==1 && nc>0.9) ||
  (mem_ltpf active ==1 && abs(pit-mem_pit)<2 && (nc-mem_nc)>-0.1 && nc>0.84)
  )
{
  ltpf_active = 1;
}
else
{
  ltpf_active = 0;
}
```

where mem_ltpf_active is the value of ltpf_active in the previous frame (it is 0 if ltpf_pitch_present=0 in the previous frame), mem_nc is the value of nc in the previous frame (it is 0 if ltpf_pitch_present=0 in the previous frame), pit=pitch_int+pitch_fr/4 and mem_pit is the value of pit in the previous frame (it is 0 if ltpf_pitch_present=0 in the previous frame). This procedure is shown, for example, in FIG. 6*b* (see also below).

It is important to note that the schematization of FIG. 2 is purely indicative. Instead of the blocks 21, 22 and the selectors, different hardware and/or software units may be used. In examples, at least two of components such as the blocks 21 and 22, the pitch estimator, the signal analyzer and/or the harmonicity measurer and/or the bitstream former may be implemented one single element.

On the basis of the measurements performed, it is possible to distinguish between:

a third status, in which:

the first criteria are not fulfilled;

both the outputs 21*a* and 22*a* of the block 21 and the block 22 are "0";

the outputs 13*a* ("e.g., "ltpf_pitch_lag"), 24*b* (e.g., additional harmonicity information, optional), and 22*a* (e.g., "ltpf_active") are not encoded;

only the value "0" (e.g., "ltpf_pitch_lag_present") of the output 21*a* is encoded;

a third frame 18" is encoded with third control item "0" (e.g., from "ltpf_pitch_lag_present") and the signal representation of the audio signal, but without any bit encoding pitch information and/or the first and second control item;

accordingly, the decoder will understand that no pitch information and harmonicity information can be used for LTPF and PLC (e.g., by virtue of extremely low harmonicity);

a first status, in which:

the first criteria are fulfilled and the second criteria are not fulfilled;

the output 21*a* of the block 21 is "1" (e.g., by virtue of the fulfilment of the first criteria, e.g., by virtue of the first measurement 24*a*' being greater than the first threshold), while the output 22*a* of the block 22 is "0" (e.g., by virtue of the non-fulfilment of the second criteria, e.g., by virtue of the second measurement 24*a*", for the present or the previous frame, being below a second threshold);

the value "1" of the output 21*a* (e.g., "ltpf_pitch_lag_present") is encoded in 18*e;* the output 13*a* ("e.g., "ltpf_pitch_lag") is encoded in 16*b;* the value "0" of the output 22*a* (e.g., "ltpf_active") is encoded in 16*c;* the optional output 24*b* (e.g., additional harmonicity information) is not encoded;

a first frame 16" is encoded with third control data item equal to "1" (e.g., from "ltpf_pitch_lag_present" 18*e*), with one single bit encoding a first control data item equal to "0" (e.g., from "ltpf_active" 16*c*), and a fixed amount of bits (e.g., in a fixed position) to encode a first pitch information 16*b* (e.g., taken from "ltpf_pitch_lag");

accordingly, the decoder will understand that will make use of the pitch information 13*a* (e.g., a pitch lag encoded in 16*b*) only for PLC, but no pitch information or harmonicity information will be used for LTPF;

a second status, in which:

the first and second criteria are fulfilled;

both the outputs 21*a* and 22*a* of the block 21 and the block 22 are "1" (e.g., by virtue of the fulfilment of the first criteria, e.g., by virtue of the first measurement 24*a*' being greater than the second threshold and the second measurement 24*a*" fulfilling the second criteria, e.g., the second measurement 24*a*" being greater, in the current frame or in the previous frame, than a second threshold);

the value "1" of the output 21*a* (e.g., "ltpf_pitch_lag_present") is encoded;

the output 13*a* ("e.g., "ltpf_pitch_lag") is encoded;

the value "1" of the output 22*a* (e.g., "ltpf_active") is encoded;

a second frame 17" is encoded with third control data item equal to 1 (e.g., from "ltpf_pitch_lag_present" in 18*e*), with one single bit encoding a second control data item equal to "1" (e.g., from "ltpf_active" in 17*c*), a fixed amount of bits (e.g., in a fixed position) to encode a second pitch information (e.g., taken from "ltpf_pitch_lag") in 17*b*, and, optionally, additional information (such as additional harmonicity information) in 17*d;* accordingly, the decoder will make use of the pitch information 13*a* (e.g., a pitch lag) for PLC, and will make also use of the pitch information and (in case) the additional harmonicity information for LTPF (e.g., assuming that the harmonicity is enough for both LTPF and PLC).

Therefore, with reference to FIG. 5, frames 12" are shown that may be provided by the bitstream former 15, e.g., in the apparatus 10'. In particular there may be encoded:

in case of third status, a third frame 18" with the fields:
- a third control data item 18*e* (e.g., "ltpf_pitch_lag_present", obtained from 21a) with value "0"; and
- an encoded representation 18*a* of the audio signal 11;

in case of first status, a first frame 16" with the fields:
- a third control data item 18*e* (e.g., "ltpf_pitch_lag_present", obtained from 21a) with value "1";
- an encoded representation 16*a* of the audio signal 11;
- a first pitch information 16*b* (e.g., "ltpf_pitch_lag", obtained from 13*a*) in a fixed data field of the first frame 16"; and
- a first control data item 16*c* (e.g., "ltpf_active", obtained from 22*a*) with value "0"; and in case of second status, a second frame 17" with the fields:
- a third control data item 18*e* (e.g., "ltpf_pitch_lag_present", obtained from 21a) with value "1";
- an encoded representation 17*a* of the audio signal 11;
- a second pitch information 17*b* (e.g., "ltpf_pitch_lag", obtained from 13*a*) second frame 17";
- a second control data item 17*c* (e.g., "ltpf_active", obtained from 22*a*) with value "1"; and
- where provided, an (optional) harmonicity information 17*d* (e.g., obtained from 24b).

In examples, the third frame 18" does not present the fixed data field for the first or second pitch information and does not present any bit encoding a first control data item and a second control data item From the third control data item 18*e* and the first and second control data items 16*c* and 17*c*, the decoder will understand whether:

- the decoder will not implement LTPF and PLC with pitch information and harmonicity information in case of third status,
- the decoder will not implement LTPF but will implement PLC with pitch information only in case of first status, and
- the decoder will perform both LTPF using both pitch information and PLC using pitch information in case of second status.

As can be seen from FIG. 5, in some examples:

- the third frame 18 may have has a format which lacks the first pitch information 16*b*, the first control data item 16*c*, the second pitch information 17*b*, and the second control data item 17*c;*
- the third control data item 18*e* may be encoded in one single bit having a value which distinguishes the third frame 18" from the first and second frame 16", 17"; and/or
- in the encoded audio signal information, for the first frame 16", one single bit may be reserved for the first control data item 16*c* and a fixed data field 16*b* may be reserved for the first pitch information; and/or
- in the encoded audio signal information, for the second frame 17", one single bit may be reserved for the second control data item 17*c* and a fixed data field 17*b* may be reserved for the second pitch information; and/or
- the first control data item 16*c* and the second control data item 17*c* may be encoded in the same portion or data field in the encoded audio signal information; and/or
- the encoded audio signal information may comprise one first signalling bit encoding the third control data item 18*e*; and/or in case of a value of the third control data item indicating the presence of the first pitch information and/or the second pitch information, a second signalling bit encoding the first control data item and the second control data item.

Figure 6A:
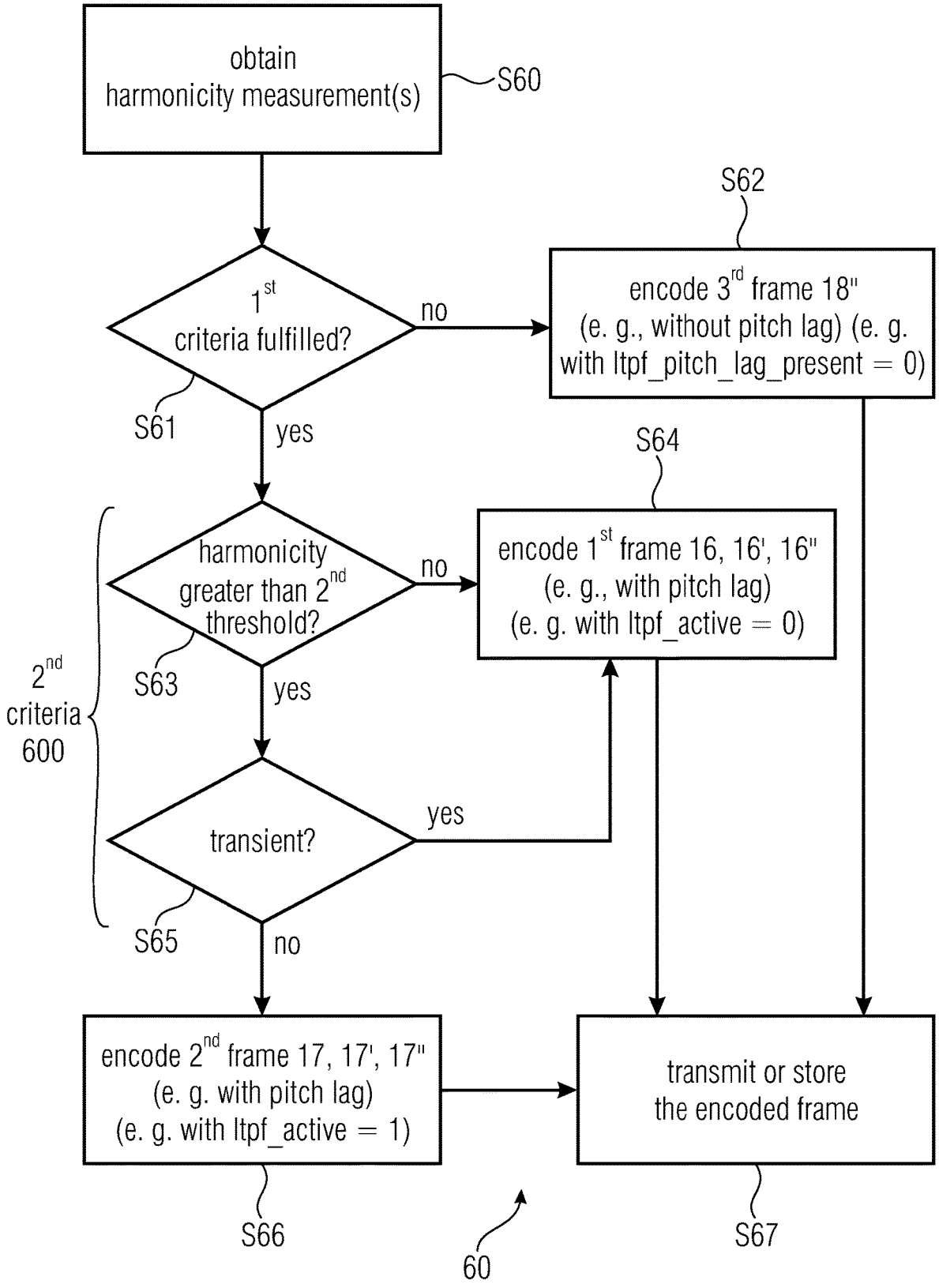
FIGS. 6*a* and 6*b* show methods for encoding audio signal information.

FIG. 6*a* shows a method 60 according to examples. The method may be operated, for example, using the apparatus 10 or 10'. The method may encode the frames 16", 17", 18" as explain above, for example.

The method 60 may comprise a step S60 of obtaining (at a particular time interval) harmonicity measurement(s) (e.g., 24*a*) from the audio signal 11, e.g., using the signal analyzer 14 and, in particular, the harmonicity measurer 24. Harmonicity measurements (harmonicity information) may comprise or be based on, for example, at least one or a combination of correlation information (e.g., autocorrelation information), gain information (e.g., post filter gain information), periodicity information, predictability information, applied to the audio signal 11 (e.g., for a time interval). In examples, a first harmonicity measurement 24*a'* may be obtained (e.g., at 6.4 KHz) and a second harmonicity measurement 24*a"* may be obtained (e.g., at 12.8 KHz). In different examples, the same harmonicity measurements may be used.

The method may comprise the verification of the fulfilment of the first criteria, e.g., using the block 21. For example, a comparison of harmonicity measurement(s) with a first threshold, may be performed. If at S61 the first criteria are not fulfilled (e.g., the harmonicity is below the first threshold, e.g., when the first measurement 24*a'* is below the first threshold), at S62 a third frame 18" may be encoded, the third frame 18" indicating a "0" value in the third control data item 18*e* (e.g., "ltpf_pitch_lag_present"), e.g., without reserving any bit for encoding values such as pitch information and additional harmonicity information. Therefore, the decoder will neither perform LTPF nor a PLC based on pitch information and harmonicity information provided by the encoder.

If at S61 it is determined that the first criteria are fulfilled (e.g., that harmonicity is greater than the first threshold and therefore is not at a lower level of harmonicity), at steps S63 and S65 it is checked if the second criteria are fulfilled. The second criteria may comprise, for example, a comparison of the harmonicity measurement, for the present frame, with at least one threshold.

For example, at step S63 the harmonicity (e.g., second harmonicity measurement 24*a"*) is compared with a second threshold (in some examples, the second threshold being set so that it is associated to a harmonic content greater than the harmonic content associated to the first threshold, for example, under the assumption that the harmonicity measurement is between a 0 value, associated to a completely non-harmonic signal, and 1 value, associated to a perfectly harmonic signal).

If at S63 it is determined that the harmonicity is not greater than a second threshold (e.g., which in some cases may be associated to an intermediate level of harmonicity), at S64 a first frame 16, 16', 16" is encoded. The first frame (indicative of an intermediate harmonicity) may be encoded to comprise a third control data item 18*e* (e.g., "ltpf_pitch_lag_present") which may be "1", a first control data item 16*b* (e.g. "ltpf_active") which may be "0", and the value of the first pitch information 16*b*, such as the pitch lag ("ltpf_pitch_lag"). Therefore, at the receipt of the first frame 16, 16', 16", the decoder will use the first pitch information 16*b* for PLC, but will not use the first pitch information 16*b* for LTPF.

Notably, the comparison performed at S61 and at S62 may be based on different harmonicity measurements, which may, for example, be obtained at different sampling rates.

If at S63 it is determined that the harmonicity is greater than the second threshold (e.g., the second harmonicity measurement is over the second threshold), at step S65 it may be checked if the audio signal is a transient signal, e.g., if the temporal structure of the audio signal 11 has varied (or if another condition on the previous frame is fulfilled). For example, it is possible to check if also the previous frame fulfilled a condition of being over a second threshold. If also the condition on the previous frame holds (no transient), then the signal is considered stable and it is possible to trigger step S66. Otherwise, the method continues to step S64 to encode a first frame 16, 16', or 16" (see above).

At step S66 the second frame 17, 17', 17" may be encoded. The second frame 17" may comprise a third control data item 18*e* (e.g., "ltpf_pitch_lag_present") with value "1" and a second control data item 17*c* (e.g. "ltpf_active") which may be "1". Accordingly, the pitch information 17*b* (such as the "pitch_lag" and, optionally, also the additional harmonicity information 17*d*) may be encoded. The decoder will understand that both PLC with pitch information and LTPF with pitch information (and, optionally, also harmonicity information) may be used.

At S67, the encoded frame may be transmitted to a decoder (e.g., via a Bluetooth connection), stored on a memory, or used in another way.

In steps S63 and S64, the normalized correlation measurement nc (second measurement 24*a*") may be the normalized correlation measurement nc obtained at 12.8 KHz (see also above and below). In step S61, the normalized correlation (first measurement 24*a*') may be the normalized correlation at 6.4 KHz (see also above and below).

Figure 6B:
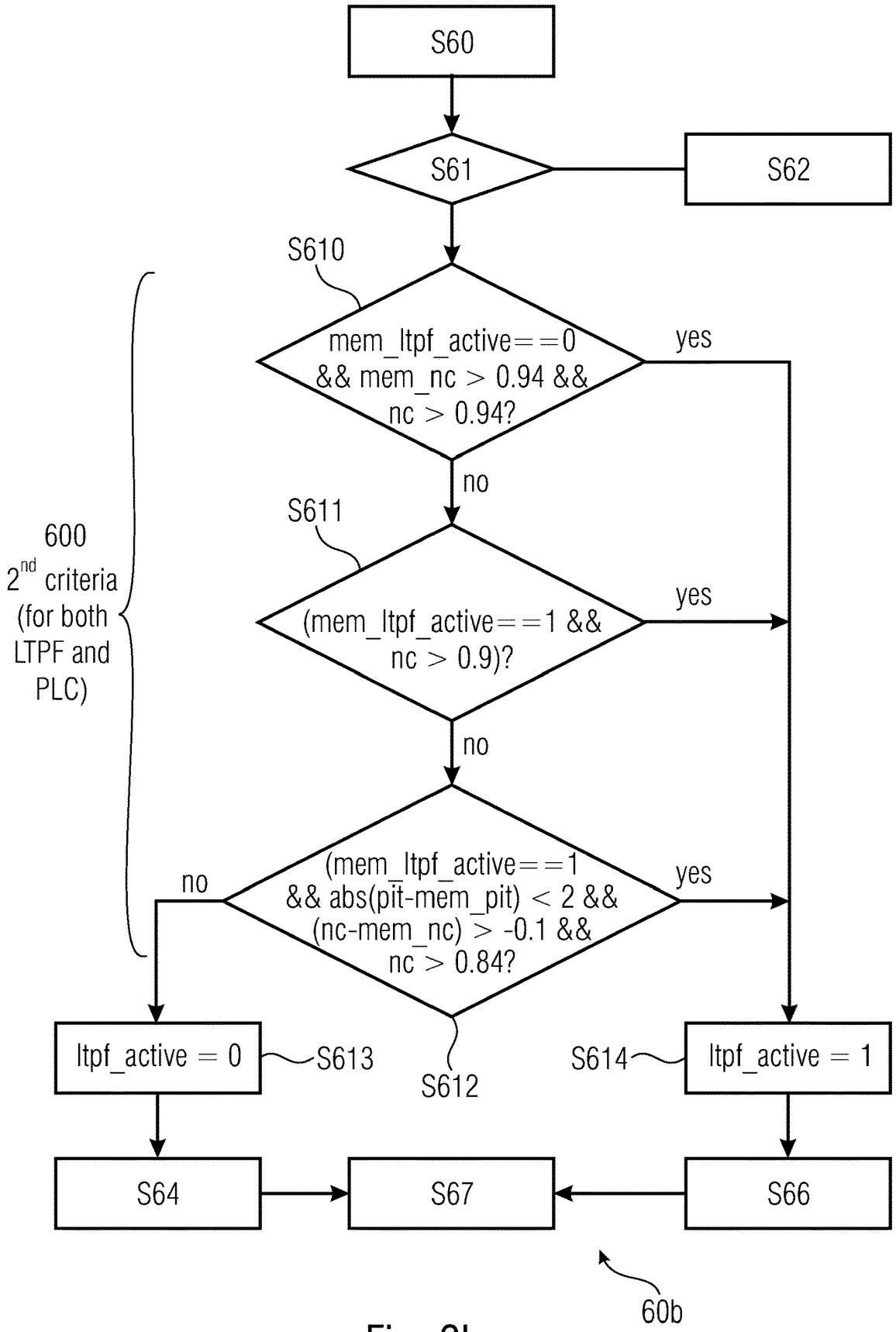

FIG. 6*b* shows a method 60*b* which also may be used. FIG. 6*b* explicitly shows examples of second criteria 600 which may be used for determining the value of ltpf_active.

As may be see, steps S60, S61, and S62 are as in the method 60 and are therefore not repeated.

At step S610, it may be checked if:

for the previous frame, it had been obtained ltpf_active=0 (indicated by mem_ltpf_active=0); and for the previous frame, the normalized correlation measurement nc (24*a*") was greater than a third threshold (e.g., a value between 0.92 and 0.96, such as 0.94); and for the present frame, the normalized correlation measurement nc (24*a*") is greater than the third threshold (e.g., a value between 0.92 and 0.96, such as 0.94).

If the result is positive, the ltpf_active is set at 1 at S614 and the steps S66 (encoding the second frame 17, 17', 17") and S67 (transmitting or storing the encoded frame) are triggered.

If the condition set at step S610 is not verified, it may be checked, at step S611:

for the previous frame, it had been obtained ltpf_active=1 (indicated by mem_ltpf_active=1);

for the present frame, the normalized correlation measurement nc (24*a*") is greater than a fourth threshold (e.g., a value between 0.85 and 0.95, e.g., 0.9).

If the result is positive, the ltpf_active is set at 1 at S614 and the steps S66 (encoding the second frame 17, 17', 17") and S67 (transmitting or storing the encoded frame) are triggered.

If the condition set at step S611 is not verified, it may be checked, at step S612, if:

for the previous frame, it had been obtained ltpf_active=0 (indicated by mem_ltpf_active=0);

for the present frame, the distance between the present pitch and the previous pitch is less than a fifth threshold (e.g., a value between 1.8 and 2.2, such as 2); and the difference between the normalized correlation measurement nc (24*a*") of the current frame and the normalized correlation measurement mem_nc of the previous frame is greater than a sixth threshold (e.g., a value between −0.15 and −0.05, such as −0.1); and for the present frame, the normalized correlation measurement nc (24*a*") is greater than a seventh threshold (e.g., a value between 0.82 and 0.86, such as 0.84).

(In some examples of steps S610-S612, some of the conditions above may be avoided while some may be maintained.)

If the result of the check at S612 is positive, the ltpf_active is set at 1 at S614 and the steps S66 (encoding the second frame 17, 17', 17") and S67 (transmitting or storing the encoded frame) are triggered.

Otherwise, if none of the checks at S610-S612 is verified, the ltpf_active is set at 0 for the present frame at S613 and step S64 is triggered, so as to encode a first frame 16, 16', 16".

In steps S610-S612, the normalized correlation measurement nc (second measurement 24*a*") may be the normalized correlation measurement obtained at 12.8 KHz (see above). In step S61, the normalized correlation (first measurement 24*a*') may be the normalized correlation at 6.4 KHz (see above).

As can be seen, several metrics, relating to the current frame and/or the previous frame, may be taken into account. The fulfilment of the second criteria may therefore be verified by checking if several measurements (e.g., associated to the present and/or previous frame) are, respectively, over or under several thresholds (e.g., at least some of the third to seventh thresholds of the steps S610-S612).

Some examples on how to obtain parameters for LTPF at the encoder side are herewith provided.

An example of resampling technique is here discussed (other techniques may be used).

The input signal at sampling rate $f_s$ is resampled to a fixed sampling rate of 12.8 kHz. The resampling is performed using an upsampling+low-pass-filtering+downsampling approach that can be formulated as follows $$x_{12.8}(n) = P\sum_{k=-\frac{120}{P}}^{\frac{120}{P}} x\left(\left\lfloor\frac{15n}{P}\right\rfloor + k - \frac{120}{P}\right) h_{6.4}(Pk - 15n \bmod P) \text{ for } n = 0..127$$

with x(n) is the input signal, $x_{12.8}(n)$ is the resampled signal at 12.8 kHz.

$$P = \frac{192\text{ kHz}}{f_s}$$

is the upsampling factor and $h_{6.4}$ is the impulse response of a FIR low-pass filter given by $$h_{6.4}(n) = \begin{cases} \text{tab_resamp_filter}[n + 119] & \text{, if } -120 < n < 120 \\ 0 & \text{, otherwise} \end{cases}$$

An example of tab_resamp_filter is provided here:

```
double tab_resamp_filter[239]={-2.043055832879108e-05, -4.463458936757081e-05, -7.163663994481459e-05,
-1.001011132655914e-04, -1.283728480660395e-04,
-1.545438297704662e-04, -1.765445671257668e-04,
-1.922569599584802e-04, -1.996438192500382e-04,
-1.968886856400547e-04, -1.825383318834690e-04,
-1.556394266046803e-04, -1.158603651792638e-04,
-6.358930335348977e-05, +2.810064795067786e-19,
+7.292180213001337e-05, +1.523970757644272e-04,
+2.349207769898906e-04, +3.163786496265269e-04,
+3.922117380894736e-04, +4.576238491064392e-04,
+5.078242936704864e-04, +5.382955231045915e-04,
+5.450729176175875e-04, +5.250221548270982e-04,
+4.760984242947349e-04, +3.975713799264791e-04,
+2.902002172907180e-04, +1.563446669975615e-04,
-5.818801416923580e-19, -1.732527127898052e-04,
-3.563859653300760e-04, -5.411552308801147e-04,
-7.184140229675020e-04, -8.785052315963854e-04,
-1.011714513697282e-03, -1.108767055632304e-03,
-1.161345220483996e-03, -1.162601694464620e-03,
-1.107640974148221e-03, -9.939415631563015e-04,
-8.216921898513225e-04, -5.940177657925908e-04,
-3.170746535382728e-04, +9.746950818779534e-19,
+3.452937604228947e-04, +7.044808705458705e-04,
+1.061334465662964e-03, +1.398374734488549e-03,
+1.697630799350524e-03, +1.941486748731660e-03,
+2.113575906669355e-03, +2.199682452179964e-03,
+2.188606246517629e-03, +2.072945458973295e-03,
+1.849752491313908e-03, +1.521021876908738e-03,
+1.093974255016849e-03, +5.811080624426164e-04,
-1.422482656398999e-18, -6.271537303228204e-04,
-1.274251404913447e-03, -1.912238389850182e-03,
-2.510269249380764e-03, -3.037038298629825e-03,
-3.462226871101535e-03, -3.758006719596473e-03,
-3.900532466948409e-03, -3.871352309895838e-03,
-3.658665583679722e-03, -3.258358512646846e-03,
-2.674755551508349e-03, -1.921033054368456e-03,
-1.019254326838640e-03, +1.869623690895593e-18,
+1.098415446732263e-03, +2.231131973532823e-03,
+3.348309272768835e-03, +4.397022774386510e-03,
+5.323426722644900e-03, +6.075105310368700e-03,
+6.603520247552113e-03, +6.866453987193027e-03,
+6.830342695906946e-03, +6.472392343549424e-03,
+5.782375213956374e-03, +4.764012726389739e-03,
+3.435863514113467e-03, +1.831652835406657e-03,
-2.251898372838663e-18, -1.996476188279370e-03,
-4.082668858919100e-03, -6.173080374929424e-03,
-8.174448945974208e-03, -9.988823864332691e-03,
-1.151698705819990e-02, -1.266210056063963e-02,
-1.333344579518481e-02, -1.345011199343934e-02,
-1.294448809639154e-02, -1.176541543002924e-02,
-9.880867320401294e-03, -7.280036402392082e-03,
-3.974730209151807e-03, +2.509617777250391e-18,
+4.586044219717467e-03, +9.703248998383679e-03,
+1.525124770818010e-02, +2.111205854013017e-02,
+2.715337236094137e-02, +3.323242450843114e-02,
+3.920032029020130e-02, +4.490666443426786e-02,
+5.020433088017846e-02, +5.495420172681558e-02,
+5.902970324375908e-02, +6.232097270672976e-02,
+6.473850225260731e-02, +6.621612450840858e-02,
+6.671322871619612e-02, +6.621612450840858e-02,
+6.473850225260731e-02, +6.232097270672976e-02,
+5.902970324375908e-02, +5.495420172681558e-02,
+5.020433088017846e-02, +4.490666443426786e-02,
+3.920032029020130e-02, +3.323242450843114e-02,
+2.715337236094137e-02, +2.111205854013017e-02,
+1.525124770818010e-02, +9.703248998383679e-03,
+4.586044219717467e-03, +2.509617777250391e-18,
-3.974730209151807e-03, -7.280036402392082e-03,
-9.880867320401294e-03, -1.176541543002924e-02,
-1.294448809639154e-02, -1.345011199343934e-02,
-1.333344579518481e-02, -1.266210056063963e-02,
-1.151698705819990e-02, -9.988823864332691e-03,
-8.174448945974208e-03, -6.173080374929424e-03,
-4.082668858919100e-03, -1.996476188279370e-03,
-2.251898372838663e-18, +1.831652835406657e-03,
+3.435863514113467e-03, +4.764012726389739e-03,
+5.782375213956374e-03, +6.472392343549424e-03,
+6.830342695906946e-03, +6.866453987193027e-03,
+6.603520247552113e-03, +6.075105310368700e-03,
+5.323426722644900e-03, +4.397022774386510e-03,
+3.348309272768835e-03, +2.231131973532823e-03,
+1.098415446732263e-03, +1.869623690895593e-18,
-1.019254326838640e-03, -1.921033054368456e-03,
-2.674755551508349e-03, -3.258358512646846e-03,
-3.658665583679722e-03, -3.871352309895838e-03,
-3.900532466948409e-03, -3.758006719596473e-03,
-3.462226871101535e-03, -3.037038298629825e-03,
-2.510269249380764e-03, -1.912238389850182e-03,
-1.274251404913447e-03, -6.271537303228204e-04,
-1.422482656398999e-18, +5.811080624426164e-04,
+1.093974255016849e-03, +1.521021876908738e-03,
+1.849752491313908e-03, +2.072945458973295e-03,
+2.188606246517629e-03, +2.199682452179964e-03,
+2.113575906669355e-03, +1.941486748731660e-03,
+1.697630799350524e-03, +1.398374734488549e-03,
+1.061334465662964e-03, +7.044808705458705e-04,
+3.452937604228947e-04, +9.746950818779534e-19,
-3.170746535382728e-04, -5.940177657925908e-04,
-8.216921898513225e-04, -9.939415631563015e-04,
-1.107640974148221e-03, -1.162601694464620e-03,
-1.161345220483996e-03, -1.108767055632304e-03,
-1.011714513697282e-03, -8.785052315963854e-04,
-7.184140229675020e-04, -5.411552308801147e-04,
-3.563859653300760e-04, -1.732527127898052e-04,
-5.818801416923580e-19, +1.563446669975615e-04,
+2.902002172907180e-04, +3.975713799264791e-04,
+4.760984242947349e-04, +5.250221548270982e-04,
+5.450729176175875e-04, +5.382955231045915e-04,
+5.078242936704864e-04, +4.576238491064392e-04,
+3.922117380894736e-04, +3.163786496265269e-04,
+2.349207769898906e-04, +1.523970757644272e-04,
+7.292180213001337e-05, +2.810064795067786e-19,
-6.358930335348977e-05, -1.158603651792638e-04,
-1.556394266046803e-04, -1.825383318834690e-04,
-1.968886856400547e-04, -1.996438192500382e-04,
-1.922569599584802e-04, -1.765445671257668e-04,
-1.545438297704662e-04, -1.283728480660395e-04,
-1.001011132655914e-04, -7.163663994481459e-05,
-4.463458936757081e-05, -2.043055832879108e-05};
```

An example of high-pass filter technique is here discussed (other techniques may be used).

The resampled signal may be high-pass filtered using a 2-order IIR filter whose transfer function may be given by $$H_{50}(z) = \frac{0.9827947082978771 - 1.965589416595754z^{-1} + 0.9827947082978771z^{-2}}{1 - 1.9652933726226904z^{-1} + 0.9658854605688177z^{-2}}$$

An example of pitch detection technique is here discussed (other techniques may be used).

The signal $x_{12.8}(n)$ may be downsampled by a factor of 2 using $$x_{6.4}(n) = \sum_{k=0}^{4} x_{12.8}(2n+k-3)h_2(k) \text{ for } n = 0..63$$

with $h_2$={0.1236796411180537, 0.2353512128364889, 0.2819382920909148, 0.2353512128364889, 0.1236796411180537}.

The autocorrelation of $x_{6.4}(n)$ may be computed by $$R_{6.4}(k) = \sum_{n=0}^{63} x_{6.4}(n)x_{6.4}(n-k) \text{ for } k = k_{min} ..k_{max}$$

with $k_{min}$=17 and $k_{max}$=114 are the minimum and maximum lags.

An autocorrelation may be weighted using $$R_{6.4}^{w}(k)=R_{6.4}(k)w(k) \text{ for } k=k_{min} \ldots k_{max}$$

with w(k) is defined as follows $$w(k) = 1 - 0.5\frac{(k-k_{min})}{(k_{max}-k_{min})} \text{ for } k = k_{min} ..k_{max}$$

A first estimate of the pitch lag $T_1$ may be the lag that maximizes the weighted autocorrelation $$T_1 = \underset{k=k_{min}\ldots k_{max}}{\text{argmax}} R_{6.4}^{w}(k)$$

A second estimate of the pitch lag $T_2$ may be the lag that maximizes the non-weighted autocorrelation in the neighborhood of the pitch lag estimated in the previous frame $$T_2 = \underset{k=k'_{min}\ldots k'_{max}}{\text{argmax}} R_{6.4}(T)$$

with $k'_{min}$=max ($k_{min}$, $T_{prev}$−4), $k'_{max}$=min ($k_{max}$, $T_{prev}$+4) and $T_{prev}$ is the final pitch lag estimated in the previous frame.

The final estimate of the pitch lag in the current frame may then be given by $$T_{curr} = \begin{cases} T_1 & \text{if } normcorr(x_{6.4}, 64, T_2) \le 0.85 \cdot normcorr(x_{64}, 64, T_1) \\ T_2 & \text{otherwise} \end{cases}$$

with normcorr(x, L, T) is the normalized correlation of the signal x of length L at lag T $$normcorr(x, L, T) = \frac{\sum_{n=0}^{L-1} x(n)x(n-T)}{\sqrt{\sum_{n=0}^{L-1} x^2(n) \sum_{n=0}^{L-1} x^2(n-T)}}$$

The normalized correlation may be at least one of the harmonicity measurements obtained by the signal analyzer 14 and/or the harmonicity measurer 24. This is one of the harmonicity measurements that may be used, for example, for the comparison with the first threshold.

An example for obtaining an LTPF bitstream technique is here discussed (other techniques may be used).

The first bit of the LTPF bitstream signals the presence of the pitch lag parameter in the bitstream. It is obtained by $$\text{ltpf_pitch_present} = \begin{cases} 1 & \text{if } normcorr(x_{6.4}, 64, T_{curr}) > 0.6 \\ 0 & \text{otherwise} \end{cases}$$

If ltpf_pitch_present is 0, no more bits are encoded, resulting in a LTPF bitstream of only one bit (see third frame 18").

If ltpf_pitch_present is 1, two more parameters are encoded, one pitch lag parameter (e.g., encoded on 9 bits), and one bit to signal the activation of LTPF (see frames 16" and 17"). In that case, the LTPF bitstream (frame) may be composed by 11 bits.

$$nbits_{LTPF} = \begin{cases} 1, & \text{if ltpf_pitch_present} = 0 \\ 11, & \text{otherwise} \end{cases}$$

The pitch lag parameter and the activation bit are obtained as described in the following sections.

These data may be encoded in the frames 12, 12', 12" according to the modalities discussed above.

An example for obtaining an LTPF pitch lag parameters is here discussed (other techniques may be used).

The integer part of the LTPF pitch lag parameter may be given by $$\text{ltpf_pitch_int} = \underset{k=k''_{min} \ldots k''_{max}}{\text{argmax}} R_{12.8}(k)$$

with $$R_{12.8}(k) = \sum_{n=0}^{127} x_{12.8}(n)x_{12.8}(n-k)$$

and $k''_{min}$=max (32, $2T_{curr}$−4), $k''_{max}$=min (228, $2T_{curr}$+4).

The fractional part of the LTPF pitch lag may then be given by $$\text{pitch_fr} = \begin{cases} 0 & \text{if pitch_int} \ge 157 \\ \underset{d=-2,0,2}{\text{argmax}}\ interp(R_{12.8}, \text{pitch_int}, d) & \text{if } 157 > \text{pitch_int} \ge 127 \\ \underset{d=-3 \ldots 3}{\text{argmax}}\ interp(R_{12.8}, \text{pitch_int}, d) & \text{if } 127 > \text{pitch_int} > 32 \\ \underset{d=0 \ldots 3}{\text{argmax}}\ interp(R_{12.8}, \text{pitch_int}, d) & \text{if pitch_int} = 32 \end{cases}$$

with $$interp(R, T, d) = \sum_{k=-4}^{4} R(T+k)h_4(4k-d)$$

and $h_4$ is the impulse response of a FIR low-pass filter given by $$h_4(n) = \begin{cases} \text{tab_ltpf_interp_R}(n+15), & \text{if } -16 < n < 16 \\ 0, & \text{otherwise} \end{cases}$$

The values of tab_ltpf_interp_R may be, for example:

double tab_ltpf_interp_R[31]={−2.874561161519444e−03, −3.001251025861499e−03, +2.745471654059321e−03 +1.535727698935322e−02, +2.868234046665657e−02, +2.950385026557377e−02 +4.598334491135473e−03, −4.729632459043440e−02, −1.058359163062837e−01 −1.303050213607112e−01, −7.544046357555201e−02, +8.357885725250529e−02 +3.301825710764459e−01, +6.032970076366158e−01, +8.174886856243178e−01 +8.986382851273982e−01, +8.174886856243178e−01, +6.032970076366158e−01 +3.301825710764459e−01, +8.357885725250529e−02, −7.544046357555201e−02 −1.303050213607112e−01, −1.058359163062837e−01, −4.729632459043440e−02 +4.598334491135473e−03, +2.950385026557377e−02, +2.868234046665657e−02 +1.535727698935322e−02, +2.745471654059321e−03, −3.001251025861499e−03 −2.874561161519444e−03};

If pitch_fr<0 then both pitch_int and pitch_fr are modified according to pitch_int=pitch_int−1 pitch_*fr*=pitch_*fr*+4

Finally, the pitch lag parameter index is given by $$\text{pitch_index} = \begin{cases} \text{pitch_int} + 283 & \text{if pitch_int} \geq 157 \\ 2\text{pitch_int} + \frac{\text{pitch_fr}}{2} + 126 & \text{if } 157 > \text{pitch_int} \geq 127 \\ 4\text{pitch_int} + \text{pitch_fr} - 128 & \text{if } 127 > \text{pitch_int} \end{cases}$$

A normalized correlation may be first computed as follows $$nc = \frac{\sum_{n=0}^{127} x_i(n, 0) x_i(n - \text{pitch_int}, \text{pitch_fr})}{\sqrt{\sum_{n=0}^{127} x_i^2(n, 0) \sum_{n=0}^{127} x_i^2(n - \text{pitch_int}, \text{pitch_fr})}}$$

with $$x_i(n, d) = \sum_{k=-2}^{2} x_{12.8}(n+k) h_i(4k - d)$$

and $h_i$ is the impulse response of a FIR low-pass filter given by $$h_i(n) = \begin{cases} \text{tab_ltpf_interp_x12k8}(n+7), & \text{if } -8 < n < 8 \\ 0, & \text{otherwise} \end{cases}$$

with tab_ltpf_interp_x12k8 chosen, for example, from the following values:

double tab_ltpf_interp_x12k8[15]={+ 6.698858366939680e−03, +3.967114782344967e−02, +1.069991860896389e−01 +2.098804630681809e−01, +3.356906254147840e−01, +4.592209296082350e−01 +5.500750019177116e−01, +5.835275754221211e−01, +5.500750019177116e−01 +4.592209296082350e−01, +3.356906254147840e−01, +2.098804630681809e−01 +1.069991860896389e−01, +3.967114782344967e−02, +6.698858366939680e−03};

The LTPF activation bit ("ltpf_active") may then be set according to

```
if (
   (mem_ltpf active ==0 && mem_nc>0.94 && nc>0.94) ||
   (mem_ltpf active ==1 && nc>0.9) ||
   (mem_ltpf active ==1 && abs(pit-mem_pit)<2 && (nc-mem_nc)>−0.1 && nc>0.84)
   )
{
   ltpf_active = 1;
}
else
{
   ltpf_active = 0;
}
```

where mem_ltpf_active is the value of ltpf_active in the previous frame (it is 0 if pitch_present=0 in the previous frame), mem_nc is the value of nc in the previous frame (it is 0 if pitch_present=0 in the previous frame), pit=pitch_int+pitch_fr/4 and mem_pit is the value of pit in the previous frame (it is 0 if pitch_present=0 in the previous frame).

5. Decoder Side

Figure 7:
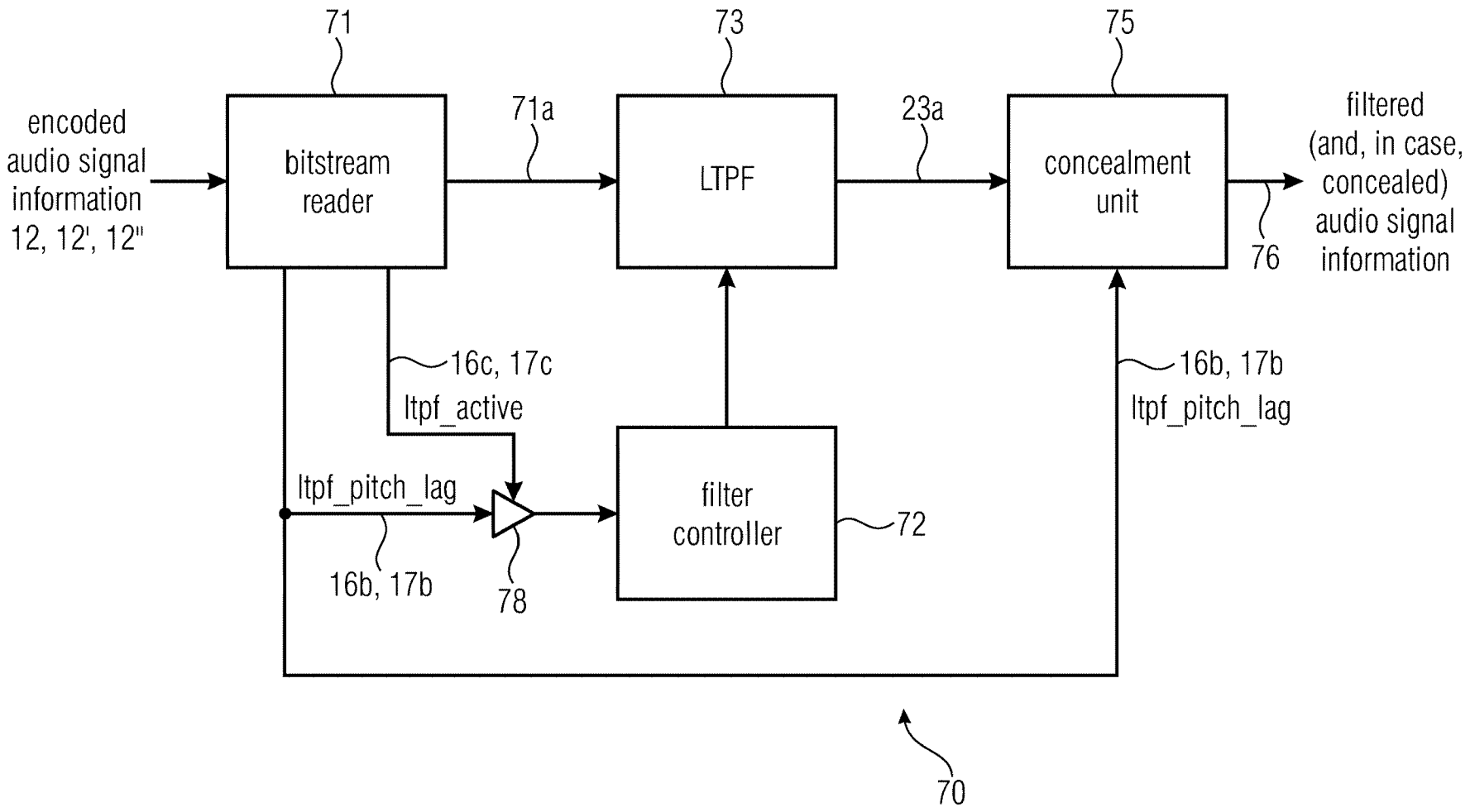
FIG. 7 shows an apparatus for decoding audio signal information.

FIG. 7 shows an apparatus 70. The apparatus 70 may be a decoder. The apparatus 70 may obtain data such as the encoded audio signal information 12, 12', 12". The apparatus 70 may perform operations described above and/or below. The encoded audio signal information 12, 12', 12" may have been generated, for example, by an encoder such as the apparatus 10 or 10' or by implementing the method 60. In examples, the encoded audio signal information 12, 12', 12" may have been generated, for example, by an encoder which is different from the apparatus 10 or 10' or which does not implement the method 60. The apparatus 70 may generate filtered decoded audio signal information 76.

The apparatus 70 may comprise (o receive data from) a communication unit (e.g., using an antenna) for obtaining encoded audio signal information. A Bluetooth communication may be performed. The apparatus 70 may comprise (o receive data from) a storage unit (e.g., using a memory) for obtaining encoded audio signal information. The apparatus 70 may comprise equipment operating in TD and/or FD.

The apparatus 70 may comprise a bitstream reader 71 (or "bitstream analyzer", or "bitstream deformatter", or "bitstream parser") which may decode the encoded audio signal information 12, 12', 12". The bitstream reader 71 may comprise, for example, a state machine to interpret the data obtained in form of bitstream. The bitstream reader 71 may output a decoded representation 71*a* of the audio signal 11.

The decoded representation 71*a* may be subjected to one or more processing techniques downstream to the bitstream reader (which are here not shown for simplicity).

The apparatus 70 may comprise an LTPF 73 which may, in turn provide the filtered decoded audio signal information 73'.

The apparatus 70 may comprise a filter controller 72, which may control the LTPF 73.

In particular, the LTPF 73 may be controlled by additional harmonicity information (e.g., gain information), when provided by the bitstream reader 71 (in particular, when present in field 17*d*, "ltpf_gain", in the frame 17' or 17").

In addition or in alternative, the LTPF 73 may be controlled by pitch information (e.g., pitch lag). The pitch information may be present in fields 16*b* or 17*b* of frames 16, 16', 16", 17, 17', 17". However, as indicated by the selector 78, the pitch information is not always used for controlling the LTPF: when the control data item 16*c* ("ltpf_active") is "0", then the pitch information is not used for the LTPF (by virtue of the harmonicity being too low for the LTPF).

The apparatus 70 may comprise a concealment unit 75 for performing a PLC function to provide audio information 76. When present in the decoded frame, the pitch information may be used for PLC.

An example of LTPF at the apparatus 70 is discussed in following passages.

FIGS. 8*a* and 8*b* show examples of syntax for frames that may be used. The different fields are also indicated.

As shown in FIG. 8*a*, the bitstream reader 71 may search for a first value in a specific position (field) of the frame which is being encoded (under the hypothesis that the frame is one of the frames 16", 17" and 18" of FIG. 5). The specific position may be interpreted, for example, as the position associated to the third control item 18*e* in frame 18" (e.g., "ltpf_pitch_lag_present").

If the value of "ltpf_pitch_lag_present" 18*e* is "0", the bitstream reader 71 understands that there is no other information for LTPF and PLC (e.g., no "ltpf_active", "ltpf_pitch_lag", "ltpf_gain").

If the value of "ltpf_pitch_lag_present" 18*e* is "1", the reader 71 may search for a field (e.g., a 1-bit field) containing the control data 16*c* or 17*c* (e.g., "ltpf_active"), indicative of harmonicity information (e.g., 14*a*, 22*a*). For example, if "ltpf_active" is "0", it is understood that the frame is a first frame 16", indicative of harmonicity which is not held valuable for LTPF but may be used for PLC. If the "ltpf_active" is "1", it is understood that the frame is a second frame 17", which may carry valuable information for both LTPF and PLC.

The reader 71 also searches for a field (e.g., a 9-bit field) containing pitch information 16*b* or 17*b* (e.g., "ltpf_pitch_lag"). This pitch information may be provided to the concealment unit 75 (for PLC). This pitch information may be provided to the filter controller 72/LTPF 73, but only if "ltpf_active" is "1" (e.g., higher harmonicity), as indicated in FIG. 7 by the selector 78.

A similar operation is performed in the example of FIG. 8*b*, in which, additionally, the gain 17*d* may be optionally encoded.

6. An Example of LTPF at the Decoder Side

The decoded signal after MDCT (Modified Discrete Cosine Transformation) synthesis, MDST (Modified Discrete Sine Transformation) synthesis, or a synthesis based on another transformation, may be postfiltered in the time-domain using a IIR filter whose parameters may depend on LTPF bitstream data "pitch_index" and "ltpf_active". To avoid discontinuity when the parameters change from one frame to the next, a transition mechanism may be applied on the first quarter of the current frame.

In examples, an LTPF IIR filter can be implemented using $$\widehat{x_{ltpf}}(n) = \hat{x}(n) - \sum_{k=0}^{L_{num}} c_{num}(k)\hat{x}(n-k) + \sum_{k=0}^{L_{den}} c_{den}(k, p_{fr})\widehat{x_{ltpf}} - \left(n - p_{int} + \frac{L_{den}}{2} - k\right)$$

with $\hat{x}(n)$ is the filter input signal (i.e. the decoded signal after MDCT synthesis) and $\widehat{x_{ltpf}}(n)$ is the filter output signal.

The integer part $p_{int}$ and the fractional part $p_{fr}$ of the LTPF pitch lag may be computed as follows. First the pitch lag at 12.8 kHz is recovered using $$\text{pitch_int} = \begin{cases} \text{pitch_index} - 283 & \text{if pitch_index} \geq 440 \\ \left\lfloor \frac{\text{pitch_index}}{2} \right\rfloor - 63 & \text{if } 440 > \text{pitch_index} \geq 380 \\ \left\lfloor \frac{\text{pitch_index}}{4} \right\rfloor + 32 & \text{if } 380 > \text{pitch_index} \end{cases}$$

$$\text{pitch_fr} = \begin{cases} 0 & \text{if pitch_index} \geq 440 \\ 2 * \text{pitch_index} - 4 * \text{pitch_int} + 508 & \text{if } 440 > \text{pitch_index} \geq 380 \\ \text{pitch_index} - 4 * \text{pitch_int} + 128 & \text{if } 380 > \text{pitch_index} \end{cases}$$

$$\text{pitch} = \text{pitch_int} + \frac{\text{pitch_fr}}{4}$$

The pitch lag may then be scaled to the output sampling rate $f_s$ and converted to integer and fractional parts using $$pich_{f_s} = * \frac{f_s}{12800}$$

$$p_{up} = (pitch_{f_s} * 4)$$

$$p_{int} = \left\lfloor \frac{p_{up}}{4} \right\rfloor$$

$$p_{fr} = p_{up} - 4 * p_{int}$$

where $f_s$ is the sampling rate.

The filter coefficients $c_{num}(k)$ and $c_{den}(k, p_{fr})$ may be computed as follows $$c_{num}(k) = 0.85 * \text{gain_ltpf} * \text{tab_ltpf_num_}fs[\text{gain_ind}][k] \quad \text{for } k = 0 \ldots L_{num}$$

$$c_{den}(k, p_{fr}) = \text{gain_ltpf} * \text{tab_ltpf_den_}fs[p_{fr}][k] \quad \text{for } k = 0 \ldots L_{den}$$

with $$L_{den} = \max\left(4, \frac{f_s}{4000}\right)$$

$$L_{num} = L_{den} - 2$$

and gain_ltpf and gain_ind may be obtained according to

```
fs_idx = min(4,(f_s/8000-1));
if (nbits < 320 + fs_idx*80)
{
  gain_ltpf = 0.4;
  gain_ind = 0;
}
else if (nbits < 400 + fs_idx*80)
{
  gain_ltpf = 0.35;
  gain_ind = 1;
}
else if (nbits < 480 + fs_idx*80)
{
  gain_ltpf =0.3;
  gain_ind =2;
}
else if (nbits < 560 + fs_idx*80)
{
  gain_ltpf = 0.25;
  gain_ind = 3;
}
else
{
  gain_ltpf = 0;
}
```

and the tables tab_ltpf_num_fs[gain_ind][k] and tab_ltpf_den_fs [$p_{fr}$][k] are predetermined.

Examples of tab_ltpf_num_fs[gain_ind][k] are here provided (instead of "fs", the sampling rate is indicated):

double tab_ltpf_num_8000 [4][3] ={{6.023618207009578e−01, 4.197609261363617e−01, −1.883424527883687e−02}, {5.994768582584314e−01, 4.197609261363620e−01, −1.594928283631041e−02}, {5.967764663733787e−01, 4.197609261363617e−01, −1.324889095125780e−02}, {5.942410120098895e−01, 4.197609261363618e−01, −1.071343658776831e−02}};

double tab_ltpf_num_16000 [4][3]={{6.023618207009578e−01, 4.197609261363617e−01, −1.883424527883687e−02}, {5.994768582584314e−01, 4.197609261363620e−01, −1.594928283631041e−02}, {5.967764663733787e−01, 4.197609261363617e−01, −1.324889095125780e−02}, {5.942410120098895e−01, 4.197609261363618e−01, −1.071343658776831e−02}};

double tab_ltpf_num_24000[4][5]={{3.989695588963494e−01, 5.142508607708275e−01, 1.004382966157454e−01, −1.278893956818042e−02, −1.572280075461383e−03}, {3.948634911286333e−01, 5.123819208048688e−01, 1.043194926386267e−01, −1.091999960222166e−02, −1.347408330627317e−03}, {3.909844475885914e−01, 5.106053522688359e−01, 1.079832524685944e−01, −9.143431066188848e−03, −1.132124620551895e−03}, {3.873093888199928e−01, 5.089122083363975e−01, 1.114517380217371e−01, −7.450287133750717e−03, −9.255514050963111e−04}};

double_tab_ltpf_num_32000 [4][7]={{2.982379446702096e−01, 4.652809203721290e−01, 2.105997428614279e−01, 3.766780380806063e−02, −1.015696155796564e−02, −2.535880996101096e−03, −3.182946168719958e−04}, {2.943834154510240e−01, 4.619294002718798e−01, 2.129465770091844e−01, 4.066175002688857e−02, −8.693272297010050e−03, −2.178307114679820e−03, −2.742888063983188e−04}, {2.907439213122688e−01, 4.587461910960279e−01, 2.151456974108970e−01, 4.350104772529774e−02, −7.295495347716925e−03, −1.834395637237086e−03, −2.316920186482416e−04}, {2.872975852589158e−01, 4.557148886861379e−01, 2.172126950911401e−01, 4.620088878229615e−02, −5.957463802125952e−03, −1.502934284345198e−03, −1.903851911308866e−04}};

double tab_ltpf_num_48000[4][11]={{1.981363739883217e−01, 3.524494903964904e−01, 2.513695269649414e−01, 1.424146237314458e−01, 5.704731023952599e−02, 9.293366241586384e−03, −7.226025368953745e−03, −3.172679890356356e−03, −1.121835963567014e−03, −2.902957238400140e−04, −4.270815593769240e−05}, {1.950709426598375e−01, 3.484660408341632e−01, 2.509988459466574e−01, 1.441167412482088e−01, 5.928947317677285e−02, 1.108923827452231e−02, −6.192908108653504e−03, −2.726705509251737e−03, −9.667125826217151e−04, −2.508100923165204e−04, −3.699938766131869e−05}, {1.921810055196015e−01, 3.446945561091513e−01, 2.506220094626024e−01, 1.457102447664837e−01, 6.141132133664525e−02, 1.279941396562798e−02, −5.203721087886321e−03, −2.297324511109085e−03, −8.165608133217555e−04, −2.123857748277408e−04, −3.141271330981649e−05}, {1.894485314175868e−01, 3.411139251108252e−01, 2.502406876894361e−01, 1.472065631098081e−01, 6.342477229539051e−02, 1.443203434150312e−02, −4.254449144657098e−03, −1.883081472613493e−03, −6.709619060722140e−04, −1.749363341966872e−04, −2.593864735284285e−05}};

Examples of tab_ltpf_den_fs [pfr] [k] are here provided (instead of "fs", the sampling rate is indicated):

double_tab_ltpf_den_8000[4][5]={{0.000000000000000e+00, 2.098804630681809e−01, 5.835275754221211e−01, 2.098804630681809e−01, 0.000000000000000e+00}, {0.000000000000000e+00, 1.069991860896389e−01, 5.500750019177116e−01, 3.356906254147840e−01, 6.698858366939680e−03), {0.000000000000000e+00, 3.967114782344967e−02, 4.592209296082350e−01, 4.592209296082350e−01, 3.967114782344967e−02}, {0.000000000000000e+00, 6.698858366939680e−03, 3.356906254147840e−01, 5.500750019177116e−01, 1.069991860896389e−01}};

double_tab_ltpf_den_16000[4][5] ={{0.000000000000000e+00, 2.098804630681809e−01, 5.835275754221211e−01, 2.098804630681809e−01, 0.000000000000000e+00}, {0.000000000000000e+00, 1.069991860896389e−01, 5.500750019177116e−01, 3.356906254147840e−01, 6.698858366939680e−03}, {0.000000000000000e+00, 3.967114782344967e−02, 4.592209296082350e−01, 4.592209296082350e−01, 3.967114782344967e−02}, {0.000000000000000e+00, 6.698858366939680e−03, 3.356906254147840e−01, 5.500750019177116e−01, 1.069991860896389e−01}};

double_tab_ltpf_den_24000[4][7]={{0.000000000000000e+00, 6.322231627323796e−02, 2.507309606013235e−01, 3.713909428901578e−01, 2.507309606013235e−01, 6.322231627323796e−02, 0.000000000000000e+00}, {0.000000000000000e+00, 3.459272174099855e−02, 1.986515602645028e−01, 3.626411726581452e−01, 2.986750548992179e−01, 1.013092873505928e−01, 4.263543712369752e−03}, {0.000000000000000e+00, 1.535746784963907e−02, 1.474344878058222e−01, 3.374259553990717e−01, 3.374259553990717e−01, 1.474344878058222e−01, 1.535746784963907e−02}, {0.000000000000000e+00, 4.263543712369752e−03, 1.013092873505928e−01, 2.986750548992179e−01, 3.626411726581452e−01, 1.986515602645028e−01, 3.459272174099855e−02}};

double_tab_ltpf_den_32000[4][9]={{0.000000000000000e+00, 2.900401878228730e−02, 1.129857420560927e−01, 2.212024028097570e−01, 2.723909472446145e−01,
2.212024028097570e−01, 1.129857420560927e−01,
2.900401878228730e−02, 0.000000000000000e+00},
{0.000000000000000e+00, 1.703153418385261e−02,
8.722503785537784e−02, 1.961407762232199e−01,
2.689237982237257e−01, 2.424999102756389e−01,
1.405773364650031e−01, 4.474877169485788e−02,
3.127030243100724e−03}, {0.000000000000000e+00,
8.563673748488349e−03, 6.426222944493845e−02,
1.687676705918012e−01, 2.587445937795505e−01,
2.587445937795505e−01, 1.687676705918012e−01,
6.426222944493845e−02, 8.563673748488349e−03},
{0.000000000000000e+00, 3.127030243100724e−03,
4.474877169485788e−02, 1.405773364650031e−01,
2.424999102756389e−01, 2.689237982237257e−01,
1.961407762232199e−01, 8.722503785537784e−02,
1.703153418385261e−02}};
double_tab_ltpf_den_48000[4][13]={{0.000000000000000
e+00, 1.082359386659387e−02, 3.608969221303979e−02,
7.676401468099964e−02, 1.241530577501703e−01,
1.627596438300696e−01, 1.776771417779109e−01,
1.627596438300696e−01, 1.241530577501703e−01,
7.676401468099964e−02, 3.608969221303979e−02,
1.082359386659387e−02, 0.000000000000000e+00},
{0.000000000000000e+00, 7.041404930459358e−03,
2.819702319820420e−02, 6.547044935127551e−02,
1.124647986743299e−01, 1.548418956489015e−01,
1.767122381341857e−01, 1.691507213057663e−01,
1.352901577989766e−01, 8.851425011427483e−02,
4.499353848562444e−02, 1.557613714732002e−02,
2.039721956502016e−03}, {0.000000000000000e+00,
4.146998467444788e−03, 2.135757310741917e−02,
5.482735584552816e−02, 1.004971444643720e−01,
1.456060342830002e−01, 1.738439838565869e−01,
1.738439838565869e−01, 1.456060342830002e−01,
1.004971444643720e−01, 5.482735584552816e−02,
2.135757310741917e−02, 4.146998467444788e−03},
{0.000000000000000e+00, 2.039721956502016e−03,
1.557613714732002e−02, 4.499353848562444e−02,
8.851425011427483e−02, 1.352901577989766e−01,
1.691507213057663e−01, 1.767122381341857e−01,
1.548418956489015e−01, 1.124647986743299e−01,
6.547044935127551e−02, 2.819702319820420e−02,
7.041404930459358e−03}}

With reference to the transition handling, five different cases are considered.

First case: ltpf_active=0 and mem_ltpf_active=0

$$\widehat{x_{ltpf}}(n) = \hat{x}(n) \text{ for } n = 0 \ldots \frac{N_F}{4}$$

Second case: ltpf_active=1 and mem_ltpf_active=0

$$\widehat{x_{ltpf}}(n) = \hat{x}(n) - \frac{n}{\frac{N_F}{4}}\left[\sum_{k=0}^{L_{num}} c_{num}(k)\hat{x}(n-k) + \sum_{k=0}^{L_{den}} c_{den}(k, p_{fr})\widehat{x_{ltpf}}\left(n - p_{int} + \frac{L_{den}}{2} - k\right)\right] \text{ for } n = 0 \ldots \frac{N_F}{4}$$

Third case: ltpf_active=0 and mem_ltpf_active=1

$$\widehat{x_{ltpf}}(n) = \hat{x}(n) - \left(1 - \frac{n}{\frac{N_F}{4}}\right)\left[\sum_{k=0}^{L_{num}} c_{num}^{mem}(k)\hat{x}(n-k) + \sum_{k=0}^{L_{den}} c_{den}^{mem}(k, p_{fr}^{mem})\widehat{x_{ltpf}}\left(n - p_{int}^{mem} + \frac{L_{den}}{2} - k\right)\right] \text{ for } n = 0 \ldots \frac{N_F}{4}$$

with $c_{num}^{mem}$, $c_{den}^{mem}$, $p_{int}^{mem}$ and $p_{fr}^{mem}$ are the filter parameters computed in the previous frame.

Fourth case: ltpf_active=1 and mem_ltpf_active=1 and $p_{int}=p_{int}^{mem}$ and $p_{fr}=p_{fr}^{mem}$ $$\widehat{x_{ltpf}}(n) = \hat{x}(n) - \sum_{k=0}^{L_{num}} c_{num}(k)\hat{x}(n-k) + \sum_{k=0}^{L_{den}} c_{den}(k, p_{fr})\widehat{x_{ltpf}}\left(n - p_{int} + \frac{L_{den}}{2} - k\right) \text{ for } n = 0 \ldots \frac{N_F}{4}$$

Fifth case: ltpf_active=1 and mem_ltpf_active=1 and ($p_{int}\neq p_{int}^{mem}$ or $p_{fr}\neq p_{fr}^{mem}$)

$$\widehat{x_{ltpf}}'(n) = \hat{x}(n) - \left(1 - \frac{n}{\frac{N_F}{4}}\right)\left[\sum_{k=0}^{L_{num}} c_{num}^{mem}(k)\hat{x}(n-k) + \sum_{k=0}^{L_{den}} c_{den}^{mem}(k, p_{fr}^{mem})\widehat{x_{ltpf}}'\left(n - p_{int}^{mem} + \frac{L_{den}}{2} - k\right)\right] \text{ for } n = 0 \ldots \frac{N_F}{4}$$

$$\widehat{x_{ltpf}}(n) = \widehat{x_{ltpf}}'(n) - \frac{n}{\frac{N_F}{4}}\left[\sum_{k=0}^{L_{num}} c_{num}(k)\widehat{x_{ltpf}}'(n-k) + \sum_{k=0}^{L_{den}} c_{den}(k, p_{fr})\widehat{x_{ltpf}}\left(n - p_{int} + \frac{L_{den}}{2} - k\right)\right] \text{ for } n = 0 \ldots \frac{N_F}{4}$$

7. Packet Lost Concealment

An examples of packet lost concealment (PLC) or error concealment is here provided.

7.1 General Information

A corrupted frame does not provide a correct audible output and shall be discarded.

For each decoded frame, its validity may be verified. For example, each frame may have a field carrying a cyclical redundancy code (CRC) which is verified by performing predetermined operations provided by a predetermined algorithm. The reader 71 (or another logic component, such as the concealment unit 75) may repeat the algorithm and verify whether the calculated result corresponds to the value on the CRC field. If a frame has not been properly decoded, it is assumed that some errors have affected it. Therefore, if the verification provides a result of incorrect decoding, the frame is held non-properly decoded (invalid, corrupted).

When a frame is determined as non-properly decoded, a concealment strategy may be used to provide an audible output: otherwise, something like an annoying audible hole could be heard. Therefore, it may be useful to find some form of frame which "fills the gap" kept open by the non-properly decoded frame. The purpose of the frame loss concealment procedure is to conceal the effect of any unavailable or corrupted frame for decoding.

A frame loss concealment procedure may comprise concealment methods for the various signal types. Best possible codec performance in error-prone situations with frame losses may be obtained through selecting the most suitable method. One of the packet loss concealment method may be, for example, TCX Time Domain Concealment 7.2 TCX Time Domain Concealment The TCX Time Domain Concealment method is a pitch-based PLC technique operating in the time domain. It is best suited for signals with a dominant harmonic structure. An example of the procedure is as follow: the synthesized signal of the last decoded frames is inverse filtered with the LP filter as described in Section 8.2.1 to obtain the periodic signal as described in Section 8.2.2. The random signal is generated by a random generator with approximately uniform distribution in Section 8.2.3. The two excitation signals are summed up to form the total excitation signal as described in Section 8.2.4, which is adaptively faded out with the attenuation factor described in Section 8.2.6 and finally filtered with the LP filter to obtain the synthesized concealed time signal. If LTPF was active in the last good frame, the LTPF is also applied on the synthesized concealed time signal as described in Section 8.3. To get a proper overlap with the first good frame after a lost frame, the time domain alias cancelation signal is generated in Section 8.2.5.

7.2.1 LPC Parameter Calculation

The TCX Time Domain Concealment method is operating in the excitation domain. An autocorrelation function may be calculated on 80 equidistant frequency domain bands. Energy is pre-emphasized with the fixed pre-emphasis factor μ

| $f_s$ | μ |
|---|---|
| 8000 | 0.62 |
| 16000 | 0.72 |
| 24000 | 0.82 |
| 32000 | 0.92 |
| 48000 | 0.92 |

The autocorrelation function is lag windowed using the following window $$w_{lag}(i) = \exp\left[-\frac{1}{2}\left(\frac{120\pi i}{f_s}\right)^2\right], \text{ for } i = 1 \ldots 16$$

before it is transformed to time domain using an inverse evenly stacked DFT. Finally a Levinson Durbin operation may be used to obtain the LP filter, $a_c(k)$, for the concealed frame. An example is provided below:

$$\begin{aligned}
&e = R_L(0)\\
&a^0(0) = 1\\
&\text{for } k = 1 \text{ to } N_L \text{ do}\\
&\quad rc = \frac{-\sum_{n=0}^{k-1} a^{k-1}(n) R_L(k-n)}{e}\\
&\quad a^k(0) = 1
\end{aligned}$$

-continued $$\begin{aligned}
&\quad \text{for } n = 1 \text{ to } k-1 \text{ do}\\
&\quad\quad a^k(n) = a^{k-1}(n) + rc \cdot a^{k-1}(k-n)\\
&\quad a^k(k) = rc\\
&\quad e = (1 - rc^2)e
\end{aligned}$$

The LP filter is calculated only in the first lost frame after a good frame and remains in subsequently lost frames.

7.2.2 Construction of the Periodic Part of the Excitation

The last $$N_L + T_c + \frac{N}{2}$$

decoded time samples are first pre-emphasized with the pre-emphasis factor from Section 8.2.1 using the filter $$H_{pre\text{-}emph}(z) = 1 - \mu z^{-1}$$

to obtain the signal $x_{pre}(k)$, where $T_c$ is the pitch lag value pitch_int or pitch_int+1 if pitch_fr>0. The values pitch_int and pitch_fr are the pitch lag values transmitted in the bitstream.

The pre-emphasized signal, $x_{pre}(k)$, is further filtered with the calculated inverse LP filter to obtain the prior excitation signal $exc'_p(k)$. To construct the excitation signal, $exc_p(k)$, for the current lost frame, $exc'_p(k)$ is repeatedly copied with $T_c$ as follows $$exc_p(k) = exc'_p(E - T_c + k), \text{ for } k = 0 \ldots N-1$$

where E corresponds to the last sample in $exc'_p(k)$. If the stability factor θ is lower than 1, the first pitch cycle of $exc'_p(k)$ is first low pass filtered with an 11-tap linear phase FIR filter described in the table below

| $f_s$ | Low pass FIR filter coefficients |
|---|---|
| 8000 – 16000 | {0.0053, 0.0000, −0.0440, 0.0000, 0.2637, 0.5500, 0.2637, 0.0000, −0.0440, 0.0000, 0.0053} |
| 24000 – 48000 | {−0.0053, −0.0037, −0.0140, 0.0180, 0.2668, 0.4991, 0.2668, 0.0180, −0.0140, −0.0037, −0.0053} |

The gain of pitch, $g'_p$, is calculated as follows $$g'_p = \frac{\sum_{k=0}^{N/2} x_{pre}(N_L + k) \cdot x_{pre}(N_L + T_c + k)}{\sum_{k=0}^{N/3} x_{pre}(N_L + k)^2}$$

If pitch_fr=0 then $g_p = g'_p$. Otherwise, a second gain of pitch, $g''_p$, is calculated as follows $$g''_p = \frac{\sum_{k=0}^{N/2} x_{pre}(N_L + 1 + k) \cdot x_{pre}(N_L + T_c + k)}{\sum_{k=0}^{N/3} x_{pre}(N_L + 1 + k)^2}$$

and $g_p = \max(g'_p, g''_p)$. If $g''_p > g'_p$ then $T_c$ is reduced by one for further processing.

Finally, $g_p$ is bounded by $0 \le g_p \le 1$.

The formed periodic excitation, $exc_p(k)$, is attenuated sample-by-sample throughout the frame starting with one and ending with an attenuation factor, α, to obtain $\widetilde{exc}_p(k)$.

The gain of pitch is calculated only in the first lost frame after a good frame and is set to $\alpha$ for further consecutive frame losses.

7.2.3 Construction of the Random Part of the Excitation

The random part of the excitation may be generated with a random generator with approximately uniform distribution as follows $$exc_{n,FB}(k)=extract(exc_{n,FB}(k-1)\cdot 12821+16831),\ for\ k=0\ldots N-1$$

where $exc_{n,FB}(-1)$ is initialized with 24607 for the very first frame concealed with this method and extract( ) extracts the 16 LSB of the value. For further frames, $exc_{n,FB}(N-1)$ is stored and used as next $exc_{n,FB}(-1)$.

To shift the noise more to higher frequencies, the excitation signal is high pass filtered with an 11-tap linear phase FIR filter described in the table below to get $exc_{n,HP}(k)$.

| $f_s$ | High pass FIR filter coefficients |
|---|---|
| 8000 – 16000 | {0, −0.0205, −0.0651, −0.1256, −0.1792, 0.8028, −0.1792, −0.1256, −0.0651, −0.0205, 0} |
| 24000 – 48000 | {−0.0517, −0.0587, −0.0820, −0.1024, −0.1164, 0.8786, −0.1164, −0.1024, −0.0820, −0.0587, −0.0517} |

To ensure that the noise may fade to full band noise with the fading speed dependently on the attenuation factor $\alpha$, the random part of the excitation, $exc_n(k)$, is composed via a linear interpolation between the full band, $exc_{n,FB}(k)$, and the high pass filtered version, $exc_{n,HP}(k)$, as $$exc_n(k)=(1-\beta)\cdot exc_{n,FB}(k)+\beta\cdot exc_{n,HP}(k),\ for\ k=0\ldots N-1$$

where $\beta=1$ for the first lost frame after a good frame and $$\beta=\beta_{-1}\cdot\alpha$$

for the second and further consecutive frame losses, where $\beta_{-1}$ is $\beta$ of the previous concealed frame.

For adjusting the noise level, the gain of noise, $g_n'$, is calculated as $$g_n'=\sqrt{\frac{\sum_{k=0}^{N/2-1}(exc_p'(E-N/2+1+k)-g_p\cdot exc_p'(E-N/2+1-T_c+k))^2}{N/2}}$$

If $T_c$=pitch_int after Section 8.2.2, then $g_n=g'_n$. Otherwise, a second gain of noise, $g''_n$, is calculated as in the equation above, but with $T_c$ being pitch_int. Following, $g_n=\min(g'_n, g''_n)$.

For further processing, $g_n$ is first normalized and then multiplied by $(1.1-0.75g_p)$ to get $\widehat{g_n}$.

The formed random excitation, $exc_n(k)$, is attenuated uniformly with $\widehat{g_n}$ from the first sample to sample five and following sample-by-sample throughout the frame starting with $\widehat{g_n}$ and ending with $\widehat{g_n}\cdot\alpha$ to obtain $\widehat{exc_n}(k)$. The gain of noise, $g_n$, is calculated only in the first lost frame after a good frame and is set to $g_n\cdot\alpha$ for further consecutive frame losses.

7.2.4 Construction of the Total Excitation, Synthesis and Post-Processing

The random excitation, $\widehat{exc_n}(k)$, is added to the periodic excitation, $\widehat{exc_p}(k)$, to form the total excitation signal $exc_t(k)$. The final synthesized signal for the concealed frame is obtained by filtering the total excitation with the LP filter from Section 8.2.1 and post-processed with the de-emphasis filter.

7.2.5 Time Domain Alias Cancelation

To get a proper overlap-add in the case the next frame is a good frame, the time domain alias cancelation part, $x_{TDAc}(k)$, may be generated. For that, N−Z additional samples are created the same as described above to obtain the signal x(k) for k=0 . . . 2N−Z. On that, the time domain alias cancelation part is created by the following steps:

Zero filling the synthesized time domain buffer x(k)

$$\hat{x}(k)=\begin{cases}0, & 0\le k<Z\\ x(k-Z), & Z\le k<2N\end{cases}$$

Windowing $\hat{x}(k)$ with the MDCT window $w_N(k)$ $$\widehat{x_w}(k)=w_N(k)\cdot\hat{x}(k),0\le k<2N$$

Reshaping from 2N to N $$y(k)=\begin{cases}-\widehat{x_w}\left(\frac{3N}{2}+k\right)-\widehat{x_w}\left(\frac{3N}{2}-1-k\right), & 0\le k<\frac{N}{2}\\ \widehat{x_w}\left(-\frac{N}{2}+k\right)-\widehat{x_w}\left(\frac{3N}{2}-1-k\right), & \frac{N}{2}\le k<N\end{cases}$$

Reshaping from N to 2N $$\hat{y}(k)=\begin{cases}y\left(\frac{N}{2}+k\right), & 0\le k<\frac{N}{2}\\ -y\left(\frac{3N}{2}-1-k\right), & \frac{N}{2}\le k<N\\ -y\left(\frac{3N}{2}-1-k\right), & N\le k<\frac{3N}{2}\\ -y\left(-\frac{3N}{2}+k\right), & \frac{3N}{2}\le k<2N\end{cases}$$

Windowing $\hat{y}(k)$ with the flipped MDCT window $w_N(k)$ $$x_{TDAc}(k)=w_N(2N-1-k)\cdot\hat{y}(k),0\le k<2N$$

7.2.6 Handling of Multiple Frame Losses

The constructed signal fades out to zero. The fade out speed is controlled by an attenuation factor, $\alpha$, which is dependent on the previous attenuation factor, $\alpha_{-1}$, the gain of pitch, $g_p$, calculated on the last correctly received frame, the number of consecutive erased frames, nbLostCmpt, and the stability, $\theta$. The following procedure may be used to compute the attenuation factor, $\alpha$

```
if (nbLostCmpt == 1)
  α = √g_p
    if (α > 0.98)
      α = 0.98
    else if (α < 0.925)
      α = 0.925
else if (nbLostCmpt == 2)
    α = (0.63 + 0.35 θ)· α_-1
    if α <0.919
      α = 0.919;
else if (nbLostCmpt == 3)
    α = (0.652 + 0.328 θ) · α_-1
else if (nbLostCmpt == 4)
    α = (0.674 + 0.3 θ) · α_-1
else if (nbLostCmpt == 5) 1
    α = (0.696 + 0.266 θ) · α_-1
```

-continued else
$\alpha = (0.725 + 0.225\ \theta) \cdot \alpha_{-1}$
$g_p = \alpha$ The factor θ (stability of the last two adjacent scalefactor vectors $scf_{-2}(k)$ and $scf_{-1}(k)$) may be obtained, for example, as:

$$\theta = 1.25 - \frac{1}{25}\sum_{k=0}^{15}(scf_{-1}(k) - scf_{-2}(k))^2$$

where $scf_{-2}(k)$ and $scf_{-1}(k)$ are the scalefactor vectors of the last two adjacent frames. The factor θ is bounded by $0 \le \theta \le 1$, with larger values of θ corresponding to more stable signals. This limits energy and spectral envelope fluctuations. If there are no two adjacent scalefactor vectors present, the factor θ is set to 0.8.

To prevent rapid high energy increase, the spectrum is low pass filtered with $X_s(0)=X_s(0)\cdot 0.2$ and $X_s(1)=X_s(1)\cdot 0.5$.

7.3 Concealment Operation Related to LTPF

If mem_ltpf_active=1 in the concealed frame, ltpf_active is set to 1 if the concealment method is MDCT frame repetition with sign scrambling or TCX time domain concealment. Therefore, the Long Term Postfilter is applied on the synthesized time domain signal as described in Section 5, but with $$gain_ltpf = gain_ltpf_past \cdot \alpha$$

where gain_ltpf past is the LTPF gain of the previous frame and a is the attenuation factor. The pitch values pitch_int and pitch_fr which are used for the LTPF are reused from the last frame.

8. Decoder of FIG. 9

Figure 9:
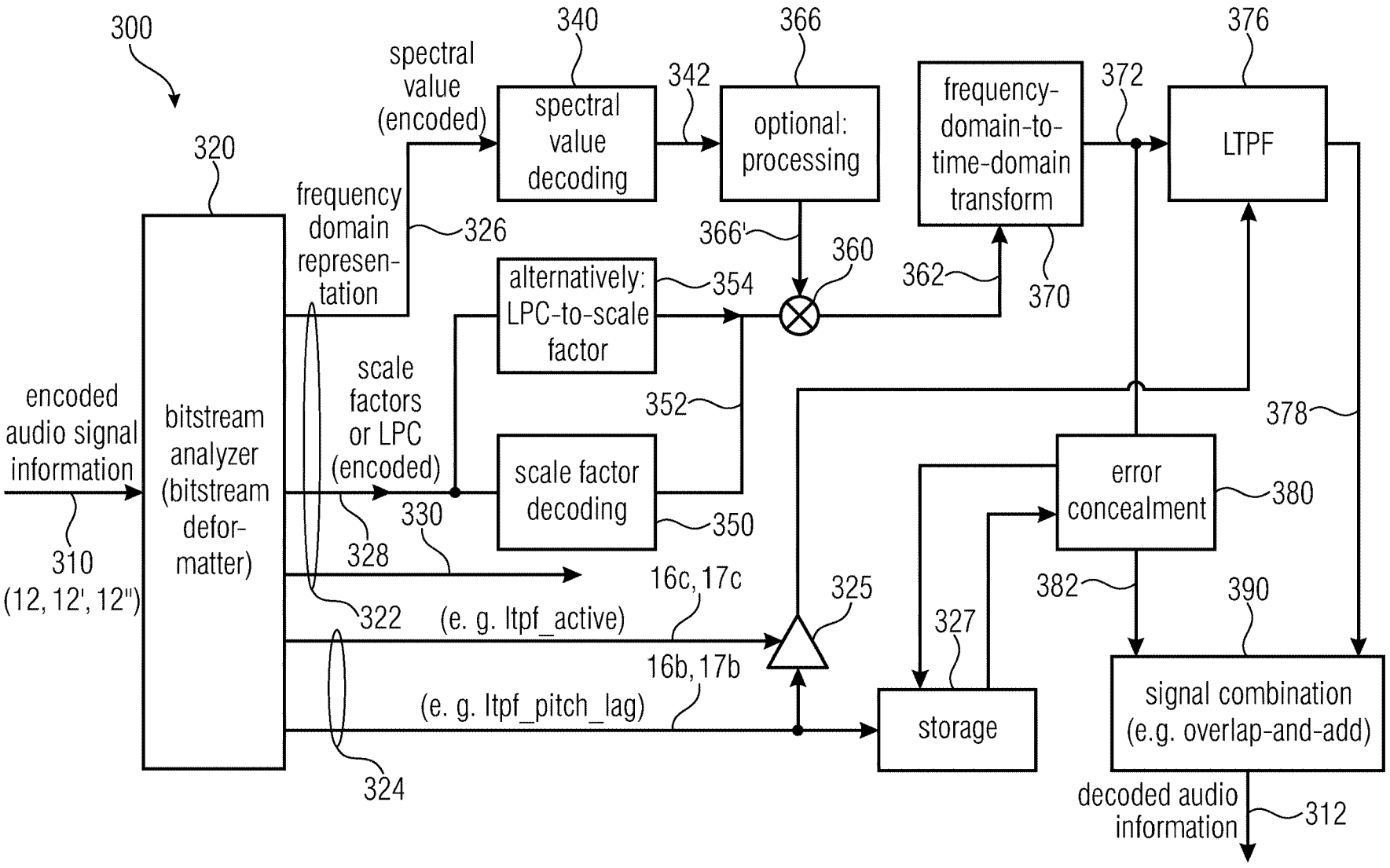
FIG. 9 shows an apparatus for decoding audio signal information.

FIG. 9 shows a block schematic diagram of an audio decoder 300, according to an example (which may, for example, be an implementation of the apparatus 70).

The audio decoder 300 may be configured to receive an encoded audio signal information 310 (which may, for example, be the encoded audio signal information 12, 12', 12") and to provide, on the basis thereof, a decoded audio information 312).

The audio decoder 300 may comprise a bitstream analyzer 320 (which may also be designated as a "bitstream deformatter" or "bitstream parser"), which may correspond to the bitstream reader 71. The bitstream analyzer 320 may receive the encoded audio signal information 310 and provide, on the basis thereof, a frequency domain representation 322 and control information 324.

The control information 324 may comprise pitch information 16*b*, 17*b* (e.g., "ltpf_pitch_lag"), and additional harmonicity information, such as additional harmonicity information or gain information (e.g., "ltpf_gain"), as well as control data items such as 16*c*, 17*c*, 18*c* associated to the harmonicity of the audio signal 11 at the decoder.

The control information 324 may also comprise data control items (e.g., 16*c*, 17*c*). A selector 325 (e.g., corresponding to the selector 78 of FIG. 7) shows that the pitch information is provided to the LTPF component 376 under the control of the control items (which in turn are controlled by the harmonicity information obtained at the encoder): if the harmonicity of the encoded audio signal information 310 is too low (e.g., under the second threshold discussed above), the LTPF component 376 does not receive the pitch information.

The frequency domain representation 322 may, for example, comprise encoded spectral values 326, encoded scale factors 328 and, optionally, an additional side information 330 which may, for example, control specific processing steps, like, for example, a noise filling, an intermediate processing or a post-processing. The audio decoder 300 may also comprise a spectral value decoding component 340 which may be configured to receive the encoded spectral values 326, and to provide, on the basis thereof, a set of decoded spectral values 342. The audio decoder 300 may also comprise a scale factor decoding component 350, which may be configured to receive the encoded scale factors 328 and to provide, on the basis thereof, a set of decoded scale factors 352.

Alternatively to the scale factor decoding, an LPC-to-scale factor conversion component 354 may be used, for example, in the case that the encoded audio information comprises encoded LPC information, rather than a scale factor information. However, in some coding modes (for example, in the TCX decoding mode of the USAC audio decoder or in the EVS audio decoder) a set of LPC coefficients may be used to derive a set of scale factors at the side of the audio decoder. This functionality may be reached by the LPC-to-scale factor conversion component 354.

The audio decoder 300 may also comprise an optional processing block 366 for performing optional signal processing (such as, for example, noise-filling; and/or temporal noise shaping; TNS, and so on), which may be applied to the decoded spectral values 342. A processed version 366' of the decoded spectral values 342 may be output by the processing block 366.

The audio decoder 300 may also comprise a scaler 360, which may be configured to apply the set of scaled factors 352 to the set of spectral values 342 (or their processed versions 366'), to thereby obtain a set of scaled values 362. For example, a first frequency band comprising multiple decoded spectral values 342 (or their processed versions 366') may be scaled using a first scale factor, and a second frequency band comprising multiple decoded spectral values 342 may be scaled using a second scale factor. Accordingly, a set of scaled values 362 is obtained.

The audio decoder 300 may also comprise a frequency-domain-to-time-domain transform 370, which may be configured to receive the scaled values 362, and to provide a time domain representation 372 associated with a set of scaled values 362. For example, the frequency-domain-to-time domain transform 370 may provide a time domain representation 372, which is associated with a frame or sub-frame of the audio content. For example, the frequency-domain-to-time-domain transform may receive a set of MDCT (or MDST) coefficients (which can be considered as scaled decoded spectral values) and provide, on the basis thereof, a block of time domain samples, which may form the time domain representation 372.

The audio decoder 300 also comprises an LTPF component 376, which may correspond to the filter controller 72 and the LTPF 73. The LTPF component 376 may receive the time domain representation 372 and somewhat modify the time domain representation 372, to thereby obtain a post-processed version 378 of the time domain representation 372.

The audio decoder 300 may also comprise an error concealment component 380 which may, for example, correspond to the concealment unit 75 (to perform a PLC function). The error concealment component 380 may, for example, receive the time domain representation 372 from the frequency-domain-to-time-domain transform 370 and which may, for example, provide an error concealment audio information 382 for one or more lost audio frames. In other words, if an audio frame is lost, such that, for example, no encoded spectral values 326 are available for said audio frame (or audio sub-frame), the error concealment component 380 may provide the error concealment audio information on the basis of the time domain representation 372 associated with one or more audio frames preceding the lost audio frame. The error concealment audio information may typically be a time domain representation of an audio content.

Regarding the error concealment, it should be noted that the error concealment does not happen at the same time of the frame decoding. For example if a frame n is good then we do a normal decoding, and at the end we save some variable that will help if we have to conceal the next frame, then if n+1 is lost we call the concealment function giving the variable coming from the previous good frame. We will also update some variables to help for the next frame loss or on the recovery to the next good frame.

Therefore, the error concealment component 380 may be connected to a storage component 327 on which the values 16*b*, 17*b*, 17*d* are stored in real time for future use. They will be used only if subsequent frames will be recognized as being impurely decoded. Otherwise, the values stored on the storage component 327 will be updated in real time with new values 16*b*, 17*b*, 17*d*.

In examples, the error concealment component 380 may perform MDCT (or MDST) frame resolution repetition with signal scrambling, and/or TCX time domain concealment, and/or phase ECU. In examples, it is possible to actively recognize the advantageous technique on the fly and use it.

The audio decoder 300 may also comprise a signal combination component 390, which may be configured to receive the filtered (post-processed) time domain representation 378. The signal combination 390 may receive the error concealment audio information 382, which may also be a time domain representation of an error concealment audio signal provided for a lost audio frame. The signal combination 390 may, for example, combine time domain representations associated with subsequent audio frames. In the case that there are subsequent properly decoded audio frames, the signal combination 390 may combine (for example, overlap-and-add) time domain representations associated with these subsequent properly decoded audio frames. However, if an audio frame is lost, the signal combination 390 may combine (for example, overlap-and-add) the time domain representation associated with the properly decoded audio frame preceding the lost audio frame and the error concealment audio information associated with the lost audio frame, to thereby have a smooth transition between the properly received audio frame and the lost audio frame. Similarly, the signal combination 390 may be configured to combine (for example, overlap-and-add) the error concealment audio information associated with the lost audio frame and the time domain representation associated with another properly decoded audio frame following the lost audio frame (or another error concealment audio information associated with another lost audio frame in case that multiple consecutive audio frames are lost).

Accordingly, the signal combination 390 may provide a decoded audio information 312, such that the time domain representation 372, or a post processed version 378 thereof, is provided for properly decoded audio frames, and such that the error concealment audio information 382 is provided for lost audio frames, wherein an overlap-and-add operation may be performed between the audio information (irrespective of whether it is provided by the frequency-domain-to-time-domain transform 370 or by the error concealment component 380) of subsequent audio frames. Since some codecs have some aliasing on the overlap and add part that need to be cancelled, optionally we can create some artificial aliasing on the half a frame that we have created to perform the overlap add.

Notably, the concealment component 380 may receive, in input, pitch information and/or gain information (16*b*, 17*b*, 17*d*) even if the latter is not provided to the LTPF component: this is because the concealment component 380 may operate with harmonicity lower than the harmonicity at which the LTPF component 370 shall operate. As explained above, where the harmonicity is over the first threshold but under the second threshold, a concealment function may be active even if the LTPF function is deactivated or reduced.

Notably, other implementations may be chosen. In particular, components different from the components 340, 350, 354, 360, and 370 may be used.

Notably, in the examples in which there is provided that a third frame 18" may be used (e.g., without the fields 16*b*, 17*b*, 16*c*, 17*c*), when the third frame 18" is obtained, no information from the third frame 18" is used for the LTPF component 376 and for the error concealment component 380.

9. Method of FIG. 10

Figure 10:
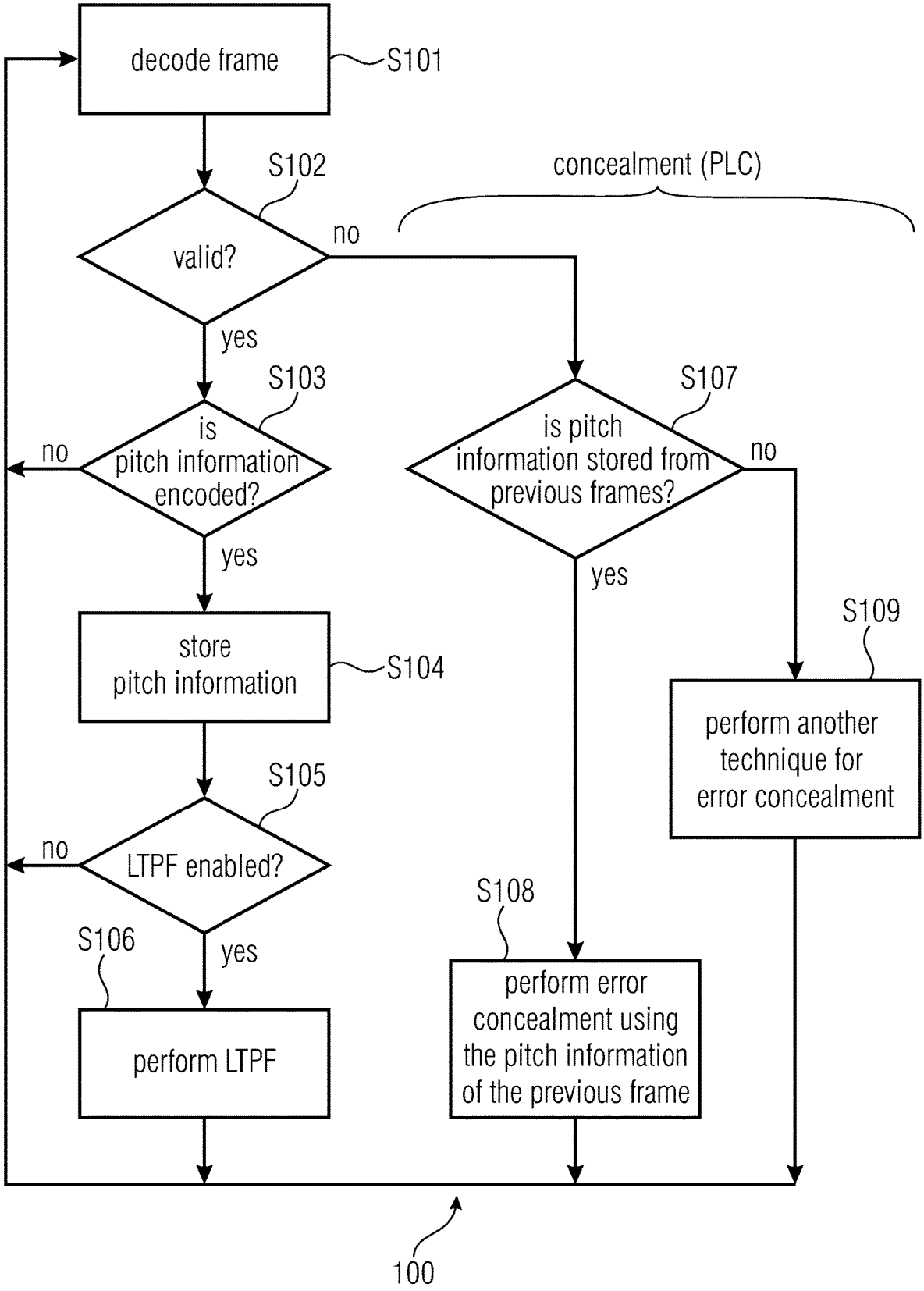
FIG. 10 shows a method for decoding audio signal information.

A method 100 is shown in FIG. 10. At step S101, a frame (12, 12', 12") may be decoded by the reader (71, 320). In examples, the frame may be received (e.g., via a Bluetooth connection) and/or obtained from a storage unit.

At step S102, the validity of the frame is checked (for example with CRC, parity, etc.). If the invalidity of the frame is acknowledged, concealment is performed (see below).

Otherwise, if the frame is held valid, at step S103 it is checked whether pitch information is encoded in the frame. For example, the value of the field 18*e* ("ltpf_pitch_lag_present") in the frame 12" is checked. In examples, the pitch information is encoded only if the harmonicity has been acknowledged as being over the first threshold (e.g., by block 21 and/or at step S61). However, the decoder does not perform the comparison.

If at S103 it is acknowledged that the pitch information is actually encoded (e.g., ltpf_pitch_lag_present=1 with the present convention), then the pitch information is decoded (e.g., from the field encoding the pitch information 16*b* or 17*b*, "ltpf_pitch_lag") and stored at step S104. Otherwise, the cycle ends and a new frame may be decoded at S101.

Subsequently, at step S105, it is checked whether the LTPF is enabled, i.e., if it is possible to use the pitch information for LTPF. This verification may be performed by checking the respective control item (e.g., 16*c*, 17*c*, "ltpf_active"). This may mean that the harmonicity is over the second threshold (e.g., as recognized by the block 22 and/or at step S63) and/or that the temporal evolution is not extremely complicated (the signal is enough flat in the time interval). However, the comparison(s) is(are) not carried out by the decoder.

If it is verified that the LTPF is active, then LTPF is performed at step S106. Otherwise, the LTPF is skipped. The cycle ends. A new frame may be decoded at S101.

With reference to the concealment, the latter may be subdivided into steps. At step S107, it is verified whether the pitch information of the previous frame (or a pitch information of one of the previous frames) is stored in the memory (i.e., it is at disposal).

If it is verified that the searched pitch information is stored, then error concealment may be performed (e.g., by the component 75 or 380) at step S108. MDCT (or MDST) frame resolution repetition with signal scrambling, and/or TCX time domain concealment, and/or phase ECU may be performed.

Otherwise, if at S107 it is verified that no fresh pitch information is stored (as a consequence that the previous frames were associated to extremely low harmonicity or extremely high variation of the signal) a different concealment technique, per se known and not implying the use of a pitch information provided by the encoder, may be used at step S109. Some of these techniques may be based on estimating the pitch information and/or other harmonicity information at the decoder. In some examples, no concealment technique may be performed in this case.

After having performed the concealment, the cycle ends and a new frame may be decoded at S101.

10. Discussion on the Solution

The proposed solution may be seen as keeping only one pitch detector at the encoder-side and sending the pitch lag parameter whenever LTPF or PLC needs this information. One bit is used to signal whether the pitch information is present or not in the bitstream. One additional bit is used to signal whether LTPF is active or not.

By the use of two signalling bits instead of one, the proposed solution is able to directly provide the pitch lag information to both modules without any additional complexity, even in the case where pitch based PLC is active but not LTPF.

Accordingly, a low-complexity combination of LTPF and pitch-based PLC may be obtained.

10.1 Encoder a. One pitch-lag per frame is estimated using a pitch-detection algorithm. This can be done in 3 steps to reduce complexity and improve accuracy. A first pitch-lag is coarsely estimated using an "open-loop pitch analysis" at a reduced sampling-rate (see e.g. [1] or [5] for examples). The integer part of the pitch-lag is then refined by maximizing a correlation function at a higher sampling-rate. The third step is to estimate the fractional part of the pitch-lag by e.g. maximizing an interpolated correlation function.
b. A decision is made to encode or not the pitch-lag in the bitstream. A measure of the harmonicity of the signal can be used such as e.g. the normalized correlation. The bit ltpf_pitch_lag_present is then set to 1 if the signal harmonicity is above a threshold and 0 otherwise. The pitch-lag ltpf_pitch_lag is encoded in the bitstream if ltpf_pitch_lag_present is 1.
c. In the case ltpf_pitch_lag_present is 1, a second decision is made to activate or not the LTPF tool in the current frame. This decision can also be based on the signal harmonicity such as e.g. the normalized correlation, but with a higher threshold and additionally a hysteresis mechanism in order to provide a stable decision. This decision sets the bit ltpf_active.
d. (optional) in the case ltpf_active is 1, a LTPF gain is estimated and encoded in the bitstream. The LTPF gain can be estimated using a correlation-based function and quantized using uniform quantization.

10.2 Bitstream

The bitstream syntax is shows in FIGS. 8*a* and 8*b*, according to examples.

10.3 Decoder

If the decoder correctly receives a non-corrupted frame:

a. The LTPF data is decoded from the bitstream
b. If ltpf_pitch_lag_present is 0 or ltpf_active is 0, then the LTPF decoder is called with a LTPF gain of 0 (there is no pitch-lag in that case).
c. If ltpf_pitch_lag_present is 1 and ltpf_active is 1, then the LTPF decoder is called with the decoded pitch-lag and the decoded gain.

If the decoder receives a corrupted frame or if the frame is lost:

a. A decision is made whether to use the pitch-based PLC for concealing the lost/corrupted frame. This decision is based on the LTPF data of the last good frame plus possibly other information.
b. If ltpf_pitch_lag_present of the last good frame is 0, then pitch-based PLC is not used. Another PLC method is used in that case, such as e.g. frame repetition with sign scrambling (see [7]).
c. If ltpf_pitch_lag_present of the last good frame is 1 and possibly other conditions are met, then pitch-based PLC is used to conceal the lost/corrupted frame. The PLC module uses the pitch-lag ltpf_pitch_lag decoded from the bitstream of the last good frame.

11. Further Examples

Figure 11:
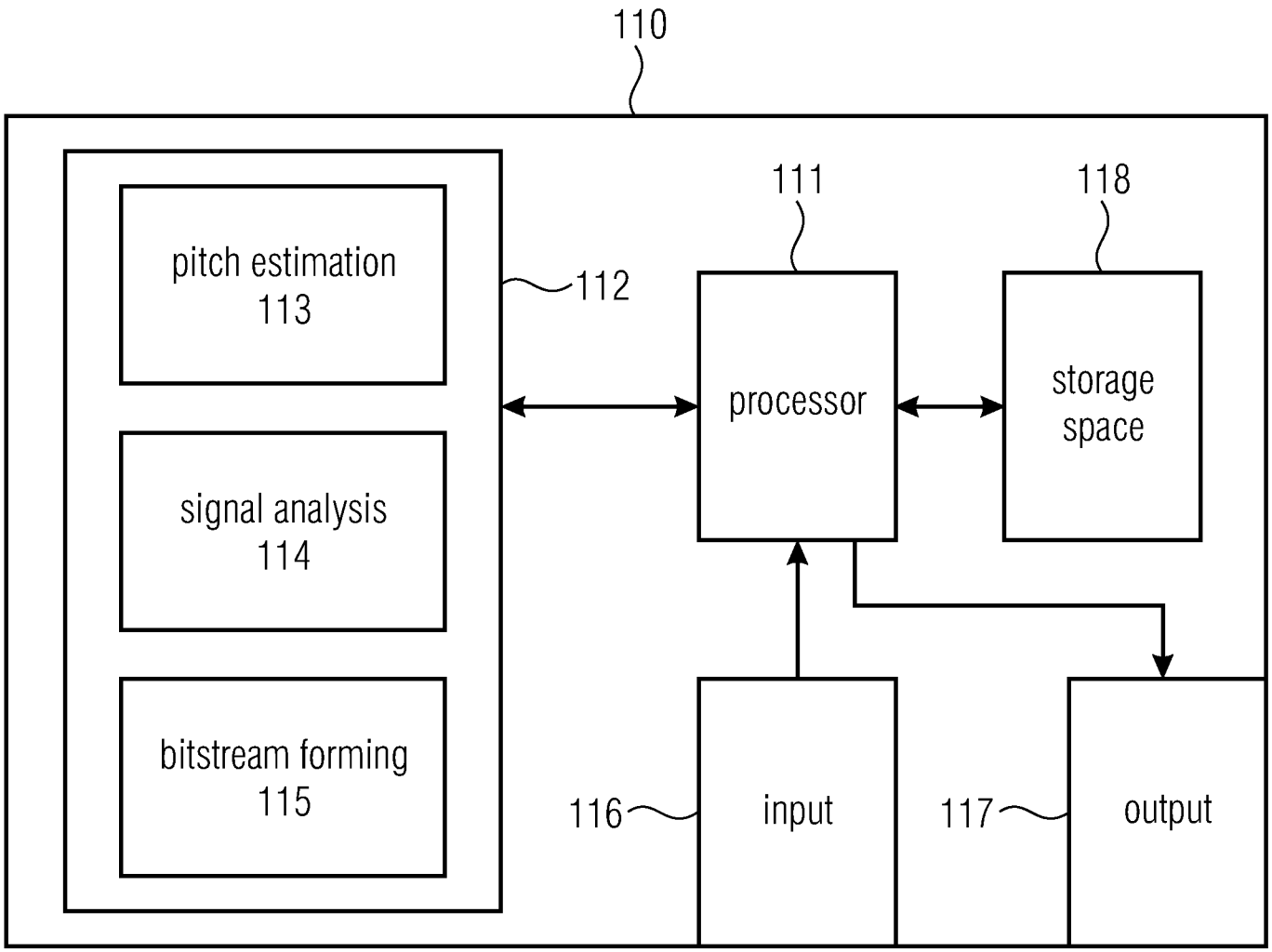
FIGS. 11 and 12 show systems for encoding/decoding audio signal information.

FIG. 11 shows a system 110 which may implement the encoding apparatus 10 or 10' and/or perform the method 60. The system 110 may comprise a processor 111 and a non-transitory memory unit 112 storing instructions which, when executed by the processor 111, may cause the processor 111 to perform a pitch estimation 113 (e.g., to implement the pitch estimator 13), a signal analysis 114 (e.g., to implement the signal analyser 14 and/or the harmonicity measurer 24), and a bitstream forming 115 (e.g., to implement the bitstream former 15 and/or steps S62, S64, and/or S66). The system 110 may comprise an input unit 116, which may obtain an audio signal (e.g., the audio signal 11). The processor 111 may therefore perform processes to obtain an encoded representation (e.g., in the format of frames 12, 12', 12") of the audio signal. This encoded representation may be provided to external units using an output unit 117. The output unit 117 may comprise, for example, a communication unit to communicate to external devices (e.g., using wireless communication, such as Bluetooth) and/or external storage spaces. The processor 111 may save the encoded representation of the audio signal in a local storage space 118.

Figure 12:
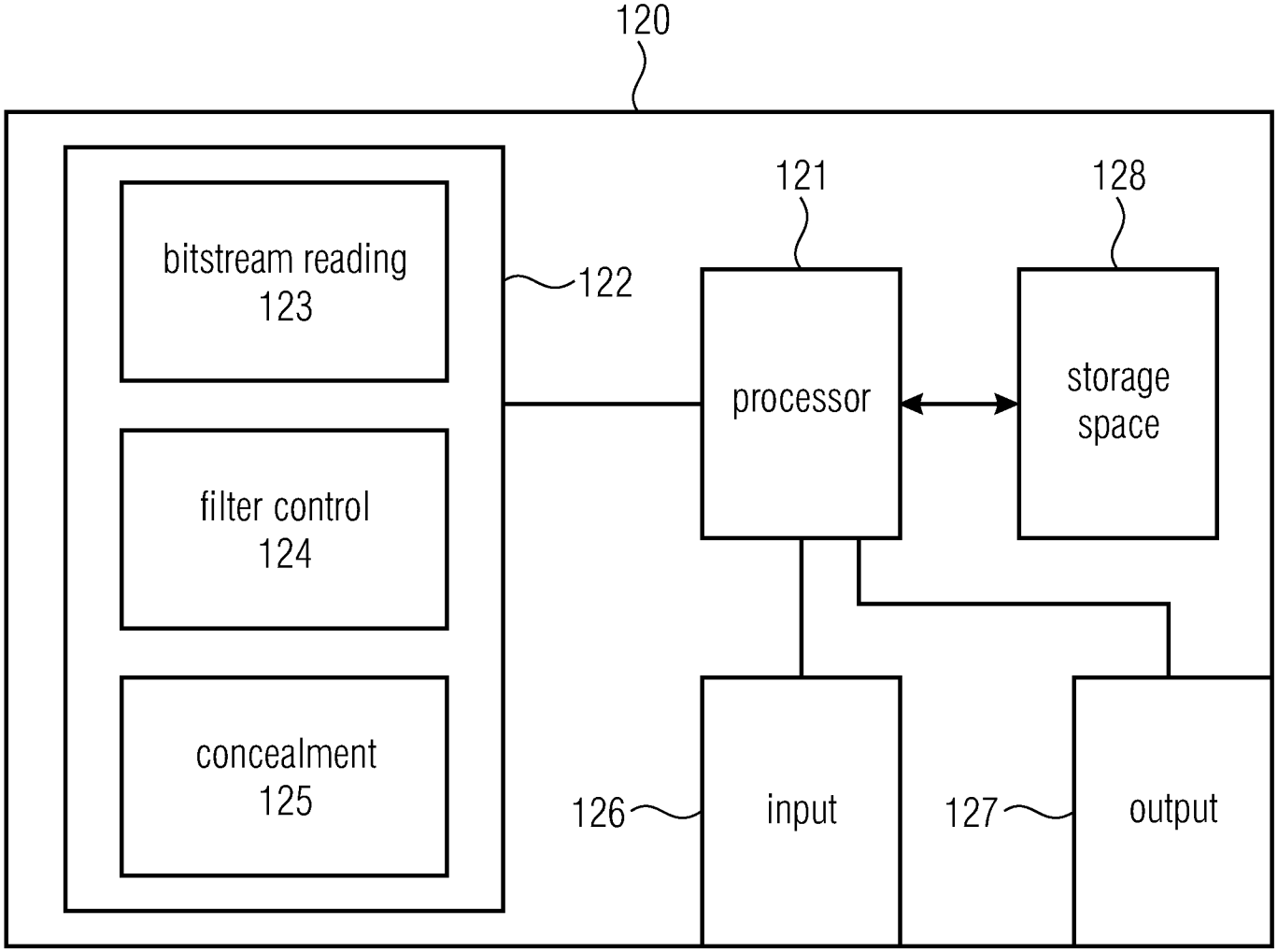

FIG. 12 shows a system 120 which may implement the decoding apparatus 70 or 300 and/or perform the method 100. The system 120 may comprise a processor 121 and a non-transitory memory unit 122 storing instructions which, when executed by the processor 121, may cause the processor 121 to perform a bitstream reading 123 (e.g., to implement the pitch reader 71 and/or 320 and/or step S101 unit 75 or 380 and/or steps S107-S109), a filter control 124 (e.g., to implement the LTPF 73 or 376 and/or step S106), and a concealment 125 (e.g., to implement the). The system 120 may comprise an input unit 126, which may obtain a decoded representation of an audio signal (e.g., in the form of the frames 12, 12', 12"). The processor 121 may therefore perform processes to obtain a decoded representation of the audio signal. This decoded representation may be provided to external units using an output unit 127. The output unit 127 may comprise, for example, a communication unit to communicate to external devices (e.g., using wireless communication, such as Bluetooth) and/or external storage spaces. The processor 121 may save the decoded representation of the audio signal in a local storage space 128.

In examples, the systems 110 and 120 may be the same device.

Figure 13:
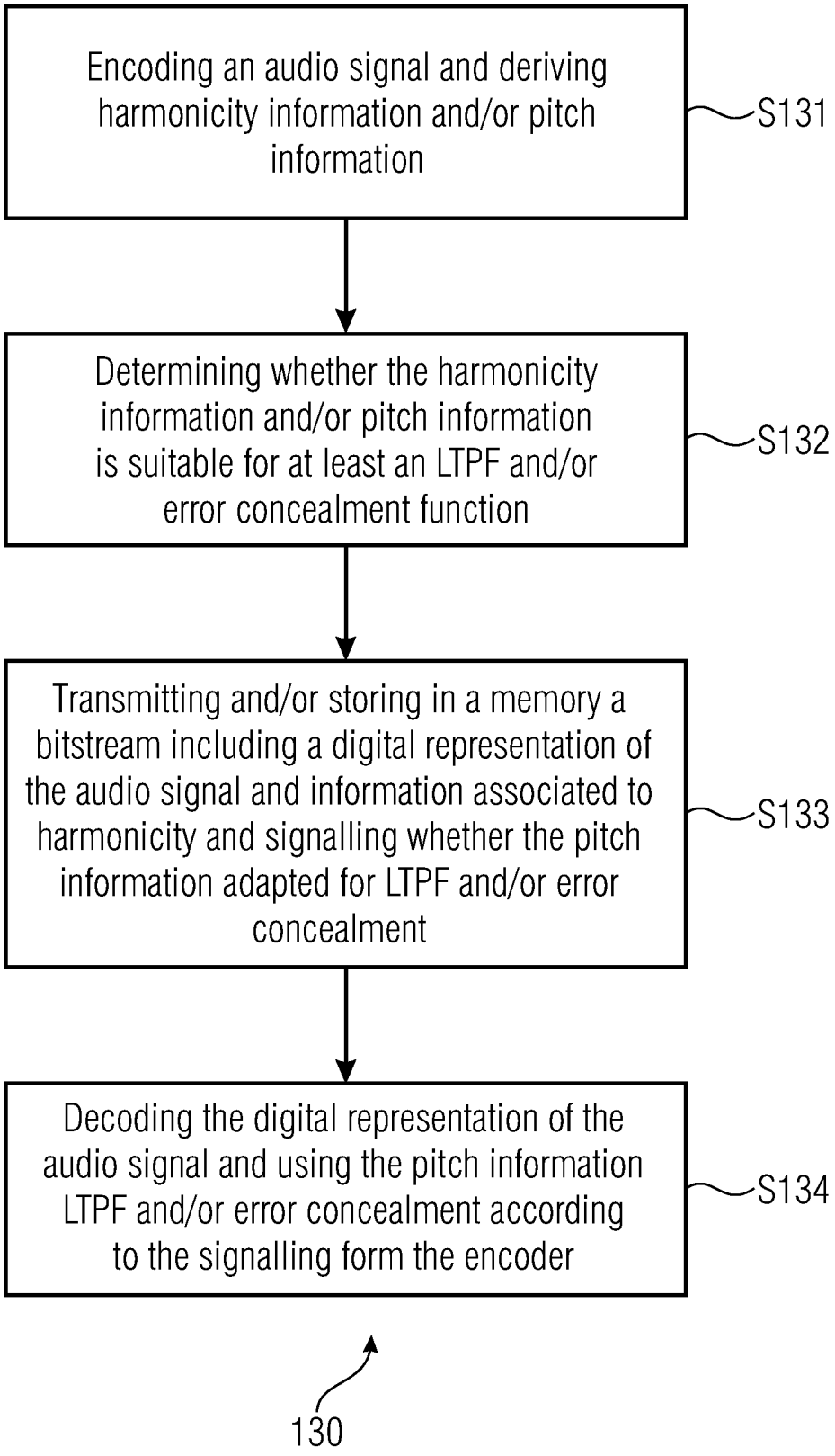
FIG. 13 shows a method of encoding/decoding.

FIG. 13 shows a method 1300 according to an example. At an encoder side, at step S130 the method may provide encoding an audio signal (e.g., according to any of the methods above or using at least some of the devices discuss above) and deriving harmonicity information and/or pitch information.

At an encoder side, at step S131 the method may provide determining (e.g., on the basis of harmonicity information such as harmonicity measurements) whether the pitch information is suitable for at least an LTPF and/or error concealment function to be operated at the decoder side.

At an encoder side, at step S132 the method may provide transmitting from an encoder (e.g., wirelessly, e.g., using Bluetooth) and/or storing in a memory a bitstream including a digital representation of the audio signal and information associated to harmonicity. The step may also provide signalling to the decoder whether the pitch information is adapted for LTPF and/or error concealment. For example, the third control item 18*e* ("ltpf_pitch_lag_present") may signal that pitch information (encoded in the bitstream) is adapted or non-adapted for at least error concealment according to the value encoded in the third control item 18*e*. For example, the first control item 16*a* (ltpf_active=0) may signal that pitch information (encoded in the bitstream as "ltpf_pitch_lag") is adapted for error concealment but is not adapted for LTPF (e.g., by virtue of its intermediate harmonicity). For example, the second control item 17*a* (ltpf_active=1) may signal that pitch information (encoded in the bitstream as "ltpf_pitch_lag") is adapted for both error concealment and LTPF (e.g., by virtue of its higher harmonicity).

At a decoder side, the method may provide, at step S134, decoding the digital representation of the audio signal and using the pitch information LTPF and/or error concealment according to the signalling form the encoder.

Depending on certain implementation requirements, examples may be implemented in hardware. The implementation may be performed using a digital storage medium, for example a floppy disk, a Digital Versatile Disc (DVD), a Blu-Ray Disc, a Compact Disc (CD), a Read-only Memory (ROM), a Programmable Read-only Memory (PROM), an Erasable and Programmable Read-only Memory (EPROM), an Electrically Erasable Programmable Read-Only Memory (EEPROM) or a flash memory, having electronically readable control signals stored thereon, which cooperate (or are capable of cooperating) with a programmable computer system such that the respective method is performed. Therefore, the digital storage medium may be computer readable.

Generally, examples may be implemented as a computer program product with program instructions, the program instructions being operative for performing one of the methods when the computer program product runs on a computer. The program instructions may for example be stored on a machine readable medium.

Other examples comprise the computer program for performing one of the methods described herein, stored on a machine readable carrier. In other words, an example of method is, therefore, a computer program having a program instructions for performing one of the methods described herein, when the computer program runs on a computer.

A further example of the methods is, therefore, a data carrier medium (or a digital storage medium, or a computer-readable medium) comprising, recorded thereon, the computer program for performing one of the methods described herein. The data carrier medium, the digital storage medium or the recorded medium are tangible and/or non-transitionary, rather than signals which are intangible and transitory.

A further example comprises a processing unit, for example a computer, or a programmable logic device performing one of the methods described herein.

A further example comprises a computer having installed thereon the computer program for performing one of the methods described herein.

A further example comprises an apparatus or a system transferring (for example, electronically or optically) a computer program for performing one of the methods described herein to a receiver. The receiver may, for example, be a computer, a mobile device, a memory device or the like. The apparatus or system may, for example, comprise a file server for transferring the computer program to the receiver.

In some examples, a programmable logic device (for example, a field programmable gate array) may be used to perform some or all of the functionalities of the methods described herein. In some examples, a field programmable gate array may cooperate with a microprocessor in order to perform one of the methods described herein. Generally, the methods may be performed by any appropriate hardware apparatus.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations and equivalents as fall within the true spirit and scope of the present invention.

The invention claimed is:

1. An apparatus for decoding audio signal information associated to an audio signal divided in a sequence of frames, each frame of the sequence of frames being one of a first frame, a second frame, and a third frame, the apparatus comprising:

a bitstream reader configured to read encoded audio signal information comprising:

an encoded representation of the audio signal for the first frame, the second frame, and the third frame;

a first pitch information for the first frame and a first control data item comprising a first value; and a second pitch information for the second frame and a second control data item comprising a second value being different from the first value, wherein the first control data item and the second control data item are in the same field; and a third control data item for the first frame, the second frame, and the third frame, the third control data item indicating the presence or absence of the first pitch information and/or the second pitch information, the third control data item being encoded in one single bit comprising a value which distinguishes the third frame from the first and second frame, the third frame comprising a format which lacks the first pitch information, the first control data item, the second pitch information, and the second control data item;

a controller configured to control a long term post filter, LTPF, and to:

check the third control data item to verify whether a frame is a third frame and, in case of verification that the frame is not a third frame, check the first data item and second control data item to verify whether the frame is a first frame or second frame, so as to:

filter a decoded representation of the audio signal in the second frame using the second pitch information, and store the second pitch information to conceal a subsequent non-properly decoded audio frame, in case it is verified that the second control data item comprises the second value;

deactivate the LTPF for the first frame, but store the first pitch information to conceal a subsequent non-properly decoded audio frame, in case it is verified that the first control data item comprises the first value; and both deactivate the LTPF and the storing of pitch information to conceal a subsequent non-properly decoded audio frame, in case it is verified from the third control data item that the frame is a third frame.

2. The apparatus of claim 1, wherein:

in the encoded audio signal information, for the first frame, one single bit is reserved for the first control data item and a fixed data field is reserved for the first pitch information.

3. The apparatus of claim 1, wherein:

in the encoded audio signal information, for the second frame, one single bit is reserved for the second control data item and a fixed data field is reserved for the second pitch information.

4. The apparatus of claim 1, further comprising:

a concealment unit configured to use the first and/or second pitch information to conceal a subsequent non-properly decoded audio frame.

5. The apparatus of claim 4, the concealment unit being configured to:

in case of determination of decoding of an invalid frame, check whether pitch information relating a previously correctly decoded frame is stored, so as to conceal an invalidly decoded frame with a frame acquired using the stored pitch information.

6. A method for decoding audio signal information associated to an audio signal divided in a sequence of frames, wherein each frame is one of a first frame, a second frame, and a third frame, the method comprising:

reading an encoded audio signal information comprising:

an encoded representation of the audio signal for the first frame and the second frame;

a first pitch information for the first frame and a first control data item comprising a first value;

a second pitch information for the second frame and a second control data item comprising a second value being different from the first value, wherein the first control data item and the second control data item are in the same field; and a third control data item for the first frame, the second frame, and the third frame, the third control data item indicating the presence or absence of the first pitch information and/or the second pitch information, the third control data item being encoded in one single bit comprising a value which distinguishes the third frame from the first and second frame, the third frame comprising a format which lacks the first pitch information, the first control data item, the second pitch information, and the second control data item, at the determination that the first control data item comprises the first value, using the first pitch information for a long term post filter, LTPF, and for an error concealment function;

at the determination of the second value of the second control data item, deactivating the LTPF but using the second pitch information for the error concealment function; and at the determination that the frame is a third frame, deactivating the LTPF and deactivating the use of the encoded representation of the audio signal for the error concealment function.

7. A non-transitory digital storage medium having a computer program stored thereon to perform the method for decoding audio signal information associated to an audio signal divided in a sequence of frames, wherein each frame is one of a first frame, a second frame, and a third frame, the method comprising:

reading an encoded audio signal information comprising:

an encoded representation of the audio signal for the first frame and the second frame;

a first pitch information for the first frame and a first control data item comprising a first value;

a second pitch information for the second frame and a second control data item comprising a second value being different from the first value, wherein the first control data item and the second control data item are in the same field; and a third control data item for the first frame, the second frame, and the third frame, the third control data item indicating the presence or absence of the first pitch information and/or the second pitch information, the third control data item being encoded in one single bit comprising a value which distinguishes the third frame from the first and second frame, the third frame comprising a format which lacks the first pitch information, the first control data item, the second pitch information, and the second control data item, at the determination that the first control data item comprises the first value, using the first pitch information for a long term post filter, LTPF, and for an error concealment function;

at the determination of the second value of the second control data item, deactivating the LTPF but using the second pitch information for the error concealment function; and at the determination that the frame is a third frame, deactivating the LTPF and deactivating the use of the encoded representation of the audio signal for the error concealment function, when said computer program is run by a computer.

* * * * *